US005778856A

United States Patent [19]

Okada et al.

[11] Patent Number: 5,778,856

[45] Date of Patent: Jul. 14, 1998

[54] CONTROL DEVICE AND CONTROL METHOD FOR LEAN-BURN ENGINE

[75] Inventors: Kojiro Okada; Kazuhide Togai; Masaji Ishida, all of Tokyo, Japan

[73] Assignee: Mitsubishi Jidosha Kogyo Kabushiki Kaisha, Tokyo, Japan

[21] Appl. No.: 501,050

[22] PCT Filed: Dec. 27, 1994

[86] PCT No.: PCT/JP94/02270

§ 371 Date: Sep. 28, 1995

§ 102(e) Date: Sep. 28, 1995

[87] PCT Pub. No.: WO95/18298

PCT Pub. Date: Jul. 6, 1995

[30] Foreign Application Priority Data

| | | | |
|---|---|---|---|
| Dec. 28, 1993 | [JP] | Japan | 5-338537 |
| Dec. 28, 1993 | [JP] | Japan | 5-338538 |
| Mar. 24, 1994 | [JP] | Japan | 6-053386 |

[51] Int. Cl.[6] ..... F02D 41/04; F02D 43/04

[52] U.S. Cl. ..... 123/417; 123/480; 123/585

[58] Field of Search ..... 123/327, 680–684, 123/585–587, 406, 417, 339.23, 478, 480

[56] References Cited

U.S. PATENT DOCUMENTS

| | | | |
|---|---|---|---|
| 4,434,768 | 3/1984 | Ninomiya et al. | 123/682 |
| 4,616,621 | 10/1986 | Kuroiwa et al. | 123/585 |
| 5,381,768 | 1/1995 | Togai et al. | 123/585 |
| 5,413,078 | 5/1995 | Mitsunaga et al. | 123/682 |

FOREIGN PATENT DOCUMENTS

| | | |
|---|---|---|
| 0549810 | 7/1993 | European Pat. Off. . |
| 57-83645 | 5/1982 | Japan . |
| 58-211543 | 12/1983 | Japan . |
| 61-167134 | 7/1986 | Japan . |
| 62-165544 | 7/1987 | Japan . |
| 62-218632 | 9/1987 | Japan . |
| 63-12852 | 1/1988 | Japan . |
| 63-12854 | 1/1988 | Japan . |
| 63-12862 | 1/1988 | Japan . |
| 2-267340 | 11/1990 | Japan . |

*Primary Examiner*—Andrew M. Dolinar

[57] ABSTRACT

A control device of a lean-burn engine has an electronic control unit. Upon start of switching from stoichiometric driving to lean driving, the control unit (10) derives, from a map, a target pressure (P0) and a basic opening degree (D0) of an idling speed control valve, serving as an air bypass valve, based on the throttle opening degree (TPS) and the engine rotation speed (Ne) at the start of the switching. The control unit supplies driving pulses (N) of a number corresponding to the basic opening degree (D0) to a stepper motor (32) of the idling speed control valve. Then, the control unit supplies the stepper motor with driving pulses of a number corresponding to an opening degree correction amount (D1) which in turn corresponds to a deviation between the target intake pressure (P0) and an actual intake pressure (PB), to thereby suppress a change in the torque at the time of switching between the rich driving, including the stoichiometric driving, and the lean driving of the lean-burn engine.

18 Claims, 39 Drawing Sheets

CONTROL DEVICE AND CONTROL METHOD FOR LEAN-BURN ENGINE

TECHNICAL FIELD

This invention relates to a control device and control method for a lean-burn engine.

BACKGROUND ART

In order to improve the fuel consumption or exhaust gas characteristic of an internal combustion engine, it is well known to control the air-fuel ratio of a mixture supplied to the engine to an air-fuel ratio on the fuel-lean side with respect to the theoretical air-fuel ratio, to effect the lean driving (lean-burn driving) of the engine. In the air-fuel ratio control of this type, to prevent the engine output from becoming insufficient in the acceleration driving region and the like, the air-fuel ratio is controlled to a value near the theoretical air-fuel ratio in the acceleration driving region and the like, so as to effect the stoichiometric driving (in a broad sense, rich driving) of the engine. Therefore, for example, if the step-on operation of the accelerator pedal is released so that the driving state departs from the acceleration driving region during the running of a vehicle on which an engine controlled in the above described manner is mounted, only the amount of fuel is reduced to allow switching from the rich driving to the lean driving. In this case, the engine output is rapidly lowered to cause a shock, thus degrading the drivability of the vehicle.

To obviate this, an air-fuel ratio control device which changes only the intake air amount, without changing the supply amount of fuel to the engine, so as to keep the engine output constant at the time of switching from the rich driving to the lean driving is proposed in Japanese Patent Application KOKAI Publication No. H5-187295.

The proposed device, which carries out the rich driving in a particular driving state of the engine and which effects the lean driving in the other state, includes two bypass passages bypassing the throttle valve. An idling speed control (ISC) valve is provided in one of the bypass passages, and a vacuum-sensitive valve is provided in the other bypass passage. In the lean driving, a bypass valve provided in a control pressure passage which connects a throttle-valve-mounting-portion of the intake passage to the control chamber of the vacuum-sensitive valve is opened, so that bypass air of an amount suitable for the negative pressure in the intake passage and hence suitable for the engine driving state will be supplied to the engine via the bypass passage disposed on the vacuum-sensitive valve side. Further, a target amount of intake air for attaining the air-fuel ratio on the fuel-lean side is calculated according to the opening degree of the throttle valve, and the opening degree of the ISC valve is controlled according to a deviation between the target intake air amount and an actual intake air amount, so that the target intake air amount can be supplied to the engine.

According to the proposed device, a fluctuation in the engine output torque at the time of switching between the rich driving and the lean driving can be suppressed to a relatively small degree. However, since the intake air amount control of the proposed device is based on the control of the opening degree of the vacuum-sensitive valve according to the intake negative pressure in the throttle-valve-mounting-portion of the intake pipe, there is a limitation in optimizing the intake air amount control or in suppressing a fluctuation in the torque during the switching of driving modes.

That is, when the switching to the lean driving is made in an air-fuel ratio region where the fuel consumption is small and a generation amount of nitrogen oxide is small, the bypass air amount may become insufficient to lower the torque, or the bypass air may become excessive to accelerate the engine. To obviate this, if the air-fuel ratio is set near the theoretical air-fuel ratio to cope with the lowering in the torque, the generation amount of nitrogen oxide increases and the fuel consumption becomes large.

As shown in FIG. 1, a required amount of bypass air can be derived from volumetric efficiency and engine rotation speed, for example. According to the knowledge of the present inventors, however, in the actual bypass air control, the bypass air becomes insufficient in a driving region on the low-rotation-speed side or high-volumetric-efficiency side, and the bypass air becomes excessive in a driving region on the high-rotation-speed side or low-volumetric-efficiency side.

The proposed device, which uses an air bypass valve (ABV), constructed by a bypass valve and vacuum-sensitive valve, as a mixture-leaning-air supply device, has such advantages that a fluctuation in the engine output torque at the time of switching between the stoichiometric driving and the lean driving can be reduced, and that the switching can be made within a short period of time. FIG. 2 shows, by way of example, variations in the intake air amount, ignition timing, air-fuel ratio (A/F) and engine output torque with elapse of time at the time of switching from the stoichiometric driving to the lean driving in a case where the ignition timing control is introduced into the proposed device. As shown in the drawing, the intake air amount increases with the first-order lag as the ISC opening degree increases. Further, the fluctuation in the torque at the time of switching from the stoichiometric driving to the lean driving is small.

The proposed device has the aforementioned advantages, but necessitates an auxiliary device such as the ISC valve for precisely measuring the amount of bypass air necessary to keep the torque at the time of lean driving and the torque at the time of stoichiometric driving at the same level. This results in a complicated device construction.

To simplify the device construction, one may conceive an idea of removing the air bypass valve from the proposed device and supplying the bypass air by use of only the ISC valve. In this case, however, since the response of intake air amount to a change in the ISC valve opening degree is slow, the engine output torque rapidly drops at the time of switching between the lean driving and the stoichiometric driving, as indicated by the solid line in FIG. 3, so that a shock will occur. Further, if the air-fuel ratio is changed towards the lean side to an increase in the intake air amount, as indicated by the broken lines in FIG. 3, a drop in the torque becomes small, but a discharged amount of nitrogen oxide is increased since the engine is driven for a long time in the air-fuel ratio region where a generation amount of nitrogen oxide is large.

In the driving control for a typical lean-burn internal combustion engine (lean-burn engine), a determination of switching is made, and the engine driving mode is switched between the stoichiometric mode and the lean mode based on the result of the determination, as required. At the time of switching to the lean-burn driving where the air-fuel ratio is set to a value on the fuel-lean side with respect to the theoretical air-fuel ratio, the control of switching from the stoichiometric mode to the lean mode is effected, as shown in FIG. 4A. In the switching control, the target air-fuel ratio is changed from the target air-fuel ratio in the stoichiometric mode to that in the lean mode, as shown in FIG. 4B. Generally, in the lean mode, the air-fuel ratio is set to a largest permissible value (for example, a value near a limit (lean limit) below which stable combustion can be attained), thereby setting a mixture as lean as possible so as to significantly improve the fuel consumption and reduce the discharging amount of NOx.

To effect the lean-burn driving, the mixture-leaning air is introduced into the internal combustion engine. For example, as is described in Japanese Patent Application KOKAI Publication No. H4-265437, the mixture-leaning air is introduced by opening an air bypass valve (ABV) by a preset amount, the ABV valve being disposed in the bypass passage provided to bypass the throttle valve in the intake passage. The amount of mixture-leaning air to be introduced is controlled by controlling the bypass valve opening degree so as to prevent an occurrence of a deceleration shock.

However, as shown in FIG. 5, the response (change in the opening degree) of the air bypass valve is accompanied by the dead time and the first-order lag. Further, the intake air amount varies with the first-order lag in response to a change in the air bypass valve opening degree which has the lag mentioned above. Owing to the intake lag, the intake air amount does not rapidly increase immediately after the switching to the lean-burn driving. Therefore, the volumetric efficiency Ev does not sufficiently rise (FIG. 6A).

For this reason, if a mixture-leaning coefficient KA/F used for calculation of a fuel injection amount is decreasingly changed as shown in FIG. 6B to increase the target air-fuel ratio at the time of switching to the lean-burn driving, a correction of reducing the fuel injection amount is effected prior to a correction of increasing the intake air amount. Thus, the mixture is excessively leaned. In this case, a load cell output representing the engine output torque is rapidly reduced after the switching to the lean-burn driving, and then rises (FIG. 6C). That is, a trough appears in the load cell output. The trough represents a deceleration shock caused by the insufficient intake air amount (intake lag). If such a deceleration shock occurs, the driving feeling is degraded. Further, if the air-fuel ratio of the mixture exceeds the lean limit by the intake lag, an ignition failure occurs in the engine, and the engine output is rapidly lowered to further degrade the vehicle driving feeling.

The degree of intake lag changes in dependence on the engine rotation speed. That is, in an engine having an intake air amount characteristic shown by way of example in FIG. 5, a time period required for the intake air amount to reach 85% of the target value from the moment when the control of switching to the lean-burn driving is started is approximately 0.83 second when the engine rotation speed is 1000 rpm, is approximately. 0.56 second when the rotation speed is 2000 rpm, and is approximately 0.47 second when the rotation speed is 3000 rpm. Therefore, in the engine having the above intake air amount characteristic, if the mixture-leaning air is introduced based on the same pattern (for example, at the same switching determination interval) irrespective of the engine rotation speed, a lag occurs in the operation of increasingly correcting the intake air amount at the time of switching to the lean-burn driving, and a degraded driving feeling occurs, particularly in a high engine rotation speed range.

DISCLOSURE OF THE INVENTION

An object of this invention is to provide a control device and control method for a lean-burn engine which can suppress a fluctuation in the engine output torque at the time of switching between the stoichiometric or rich driving and the lean driving of the engine to reduce a shock and improve the drivability.

Another object of this invention is to provide a control device and control method for a lean-burn engine, which is capable of carrying out the switching between the stoichiometric or rich driving and the lean driving of the engine even by use of a simple control system, while suppressing a fluctuation in engine output and generation of nitrogen oxide.

Still another object of this invention is to provide a control device and control method for a lean-burn engine which can positively prevent a degraded driving feeling, such as deceleration feeling, at the time of switching to the lean-burn driving.

In order to attain the above objects, a control device for a lean-burn engine according to one aspect of this invention comprises: load state detecting means for detecting the load state of the engine; intake air amount adjusting means for adjusting an amount of intake air supplied to the engine; and control means for controlling the intake air amount adjusting means according to the engine load state detected by the load state detecting means so as to cause that change in the load state which permits a difference between output torques of the engine before and after switching of the driving states to be reduced or canceled, when the switching is made from the driving with a first air-fuel ratio which is set equal to a theoretical air-fuel ratio or on the fuel-rich side with respect thereto to the driving with a second air-fuel ratio which is set on the fuel-lean side with respect to the theoretical air-fuel ratio.

Further, a control method for a lean-burn engine according to another aspect of this invention comprises the steps of: (a) detecting the load state of the engine; and (b) controlling an amount of intake air supplied to the engine according to the detected engine load state to cause that change in the load state which permits a difference between output torques of the engine before and after switching of the driving states to be reduced or canceled, when the switching is made from the driving with a first air-fuel ratio which is set equal to a theoretical air-fuel ratio or on the fuel-rich side with respect thereto to the driving with a second air-fuel ratio which is set on the fuel-lean side with respect to the theoretical air-fuel ratio.

According to the above control device and control method of this invention, a shock can be reduced and the drivability can be improved by suppressing a fluctuation in the engine output torque at the time of switching between the stoichiometric or rich driving and the lean driving of the engine.

In the control device, preferably, the control means controls the intake air amount of the engine towards the increasing side, and temporarily delays the ignition timing of the engine to the increase of the intake air amount, and then controls the ignition timing towards the advance side and controls the air-fuel ratio towards the lean side. Alternatively, the control means delays the ignition timing of the engine to a change in the actual intake air amount towards the increasing side caused by the air amount adjusting means, and then controls the ignition timing towards the advance side and sets the air-fuel ratio to the advancement of the ignition timing to thereby control the air-fuel ratio toward the lean side.

Further, in the control method, preferably, the step (b) includes the sub-steps of detecting the rotation speed of the engine, setting a quantity by which an air amount is to be increased based on the load state detected in the step (a), setting a controlled amount of the opening degree based on the detected engine load state and the detected engine rotation speed, and controlling the drive of a bypass valve, disposed in a bypass passage provided to bypass a throttle valve in an intake passage of the engine, according to the set controlled amount of the opening degree so as to permit the air amount to increase by the set quantity.

According to the control device and control method of the preferred embodiments, the switching between the rich or stoichiometric driving and the lean driving of the engine can be made even by a simple control system, while suppressing a fluctuation in the engine output and generation of nitrogen oxide.

More preferably, the control device includes fuel supply means for supplying fuel to the engine. Further, the control device includes target air-fuel ratio setting means for setting a target air-fuel ratio according to the driving state of the engine, and fuel amount setting means for setting a fuel amount required to realize the target air-fuel ratio thus set. The fuel supply means supplies fuel to the engine according to the fuel amount set by the fuel setting means. The target air-fuel ratio setting means includes follow-up changing means for successively changing the air-fuel ratio to follow a change in the actual intake air amount at the time of switching from the driving with the first air-fuel ratio to the driving with the second air-fuel ratio.

In the control method, preferably, the step (b) includes the sub-steps of (b1) setting the target air-fuel ratio according to the driving state of the engine, (b2) setting the fuel amount required to realize the target air-fuel ratio set in the sub-step (b1), and (b3) supplying fuel to the engine according to the fuel amount set in the sub-step (b2). The sub-step (b1) includes a sub-step (b11) of successively changing the air-fuel ratio to follow a change in the actual intake air amount at the time of switching from the driving with the first air-fuel ratio to the driving with the second air-fuel ratio.

According to the control device and control method for the lean-burn engine of the preferred embodiments, the control which follows a change in the actual intake air amount can be made at the time of switching to the lean-burn driving. Therefore, it is possible to prevent a lag in the intake air amount control with respect to the fuel injection amount control. As a result, an occurrence of a deceleration feeling can be prevented without fail. Further, the air-fuel ratio can be changed to the lean side to an increase in the actual air amount, and therefore, the engine output can be kept substantially constant. As a result, an occurrence of a shock caused by the switching of the driving modes can be prevented. Further, even if an artificial or driver's accelerator operation is made, the driving state with the final target air-fuel ratio can be attained. Further, no additional sensor is required, thus making it possible to simplify the algorithm concerned.

In the control device, preferably, the follow-up changing means includes backup air-fuel ratio setting means for setting a backup air-fuel ratio which gradually changes from the air-fuel ratio just prior to the switching of the driving states to reach the final target air-fuel ratio after the switching. The fuel setting means sets the fuel amount according to a larger one of a transitional target air-fuel ratio and the backup air-fuel ratio.

According to the control device of the preferred embodiment, after the transitional switching driving state proceeds so that a set characteristic curve of the transitional target air-fuel ratio intersects with a set characteristic curve of the backup air-fuel ratio, and therefore, a sufficiently long time period has already elapsed from the start of the switching to the lean-burn driving and hence a sufficiently large quantity of increase in the air amount can be attained, the backup air-fuel ratio is used instead of the transitional target air-fuel ratio, so as to smoothly change the target air-fuel ratio towards the final target air-fuel ratio. In this case, even if the target air-fuel ratio is changed irrespective of the actual intake air amount, a deceleration feeling will not occur in the running vehicle.

More preferably, in the control device, the follow-up changing means includes transitional target air-fuel ratio setting means for setting the transitional target air-fuel ratio which gradually changes from the air-fuel ratio just prior to the start of switching of the driving states to reach the final target air-fuel ratio after the switching. The transitional target air-fuel ratio is set such that the changing rate of the transitional target air-fuel ratio will become higher as the rotation speed of the engine becomes higher. Further, in the control method, the sub-step (b11) includes a sub-step of setting the transitional target air-fuel ratio which gradually changes from the air-fuel ratio just prior to the start of switching of the driving states to reach the final target air-fuel ratio after the switching. The transitional target air-fuel ratio is set such that the changing rate of the transitional target air-fuel ratio will become higher as the rotation speed of the engine becomes higher. According to the control device and control method of the preferred embodiments, since the transitional target air-fuel ratio is set according to the rotation speed of the engine, a proper air-fuel ratio control can be attained.

More preferably, the backup air-fuel ratio setting means sets the backup air-fuel ratio such that the changing rate of the backup air-fuel ratio will become higher as the engine rotation speed becomes higher. According to the control device of the preferred embodiment, since the backup air-fuel ratio is set according to the engine rotation speed, a proper air-fuel ratio control can be attained.

More preferably, in the control device, the follow-up changing means includes transitional target air-fuel ratio setting means for setting the transitional target air-fuel ratio which gradually changes from the air-fuel ratio just prior to the start of switching of the driving states towards the final target air-fuel ratio after the switching. The transitional target air-fuel ratio setting means sets the transitional target air-fuel ratio such that the changing rate of the transitional target air-fuel ratio will be changed from the rate corresponding to the high rotation speed driving state of the engine to the rate corresponding to the low rotation speed driving state. Further, in the control method, the sub-step (b11) includes a sub-step of setting the transitional target air-fuel ratio which gradually changes from the air-fuel ratio just prior to the start of switching of the driving states towards the final target air-fuel ratio after the switching. The transitional target air-fuel ratio is set such that the changing rate of the transitional target air-fuel ratio will be changed from the rate corresponding to the high rotation speed driving state of the engine to the rate corresponding to the low rotation speed driving state.

According to the control device and control method of the preferred embodiments, during the air-fuel ratio switching control, the transitional target air-fuel ratio changes, as a whole, similarly to a change in the actual intake air amount. Therefore, it is possible to prevent an occurrence of a deceleration feeling caused by a change in the intake air amount which change is accompanied by the dead time and the first-order lag. Since the changing rate of the transitional target air-fuel ratio becomes higher during the time the target air-fuel ratio changes from the target air-fuel ratio just prior to the switching to a predetermined intermediate target air-fuel ratio, the air-fuel ratio region where nitrogen oxide tends to generate is rapidly passed through.

More preferably, the follow-up changing means includes transitional target air-fuel ratio setting means for setting the transitional target air-fuel ratio which gradually changes from the air-fuel ratio just prior to the start of switching of the driving states towards the final target air-fuel ratio after the switching, and change inhibiting/suppressing means for inhibiting or suppressing a change in the transitional target air-fuel ratio in a time period immediately after the switching of the driving states. According to the control device of this preferred embodiment, an increase in the target air-fuel ratio is inhibited or suppressed in the time period from the moment when the switching to the lean-burn driving is made to the moment when the dead time has elapsed and the actual intake air amount starts to increase, thereby preventing an occurrence of a deceleration feeling.

More preferably, the follow-up changing means includes correction means for correcting the intake air amount during the transitional switching driving according to a change in the throttle opening degree caused by an artificial operation. According to the control device of the preferred embodiment, even if an artificial accelerator operation is made, a correction corresponding to the artificial accelerator operation is made, so that an occurrence of a deceleration feeling can be prevented.

More preferably, the transitional target air-fuel ratio setting means sets the transitional target air-fuel ratio, for a predetermined time period, based on the result of a comparison made by comparing means. After elapse of the predetermined time period, this setting means gradually changes the transitional target air-fuel ratio from the transitional target air-fuel ratio at the time of elapse of the predetermined time period to the final target air-fuel ratio. According to this preferred embodiment, a lag in the attainment of the final target air-fuel ratio can be prevented, which would be caused when the transitional target air-fuel ratio is set according to the actual intake air amount which slowly varies. Thus, the transitional switching driving can be completed at a proper timing.

More preferably, the correction means includes memory means for storing intake air amounts which have no relation to the switching to the driving with the second air-fuel ratio in correspondence to throttle opening degrees and engine rotation speeds. According to this preferred embodiment, a correction for compensating for an artificial accelerator operation can be made, without the need of detecting the actual intake air amount. Thus, the cost of the control device can be lowered.

BEST MODE OF CARRYING OUT THE INVENTION

Figure 1:
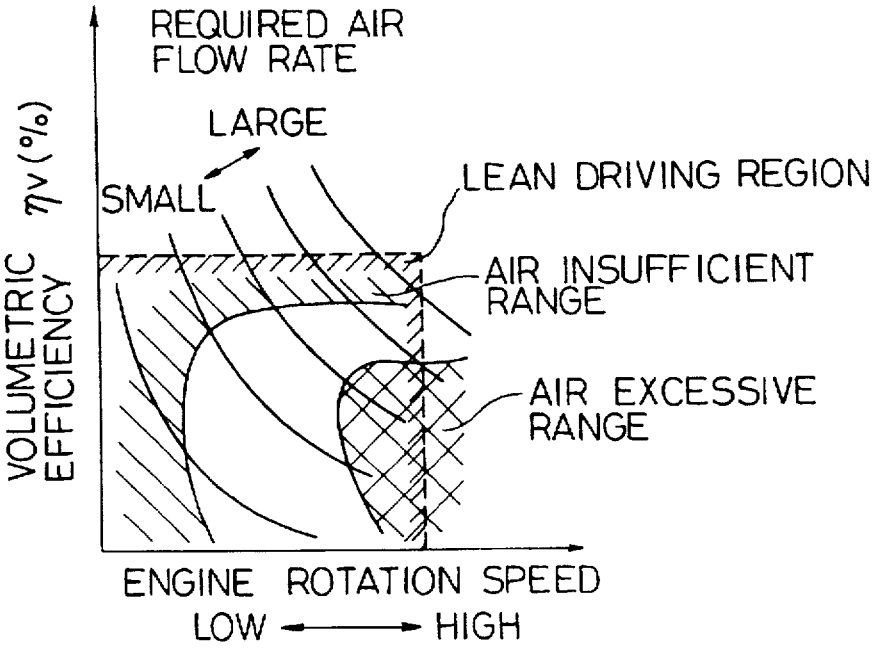
FIG. 1 is a graph showing required bypass air flow rate, bypass air insufficient range and excessive range as a function of volumetric efficiency and engine rotation speed.
Figure 7:
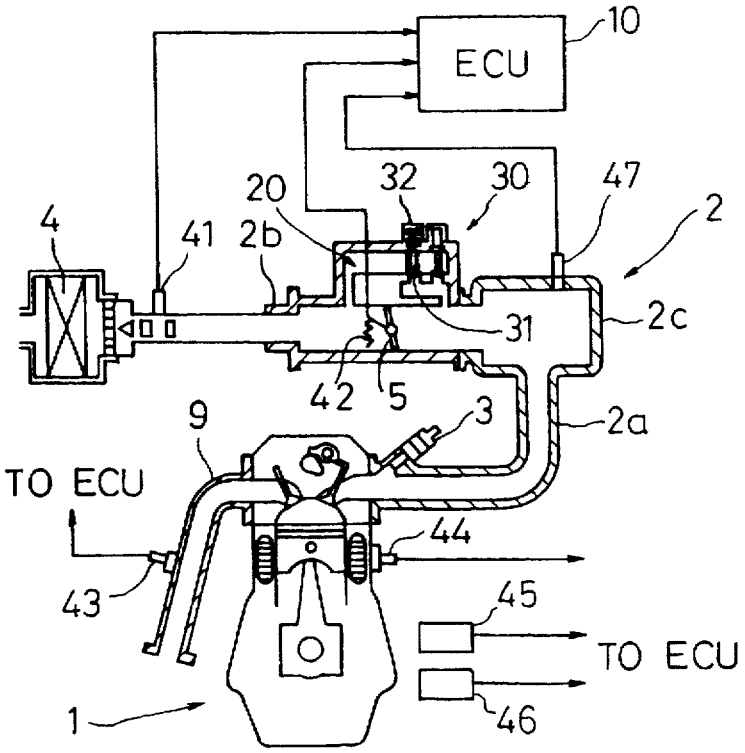
FIG. 7 is a schematic view showing a control device according to a first embodiment of this invention together with peripheral elements.
Figure 2:
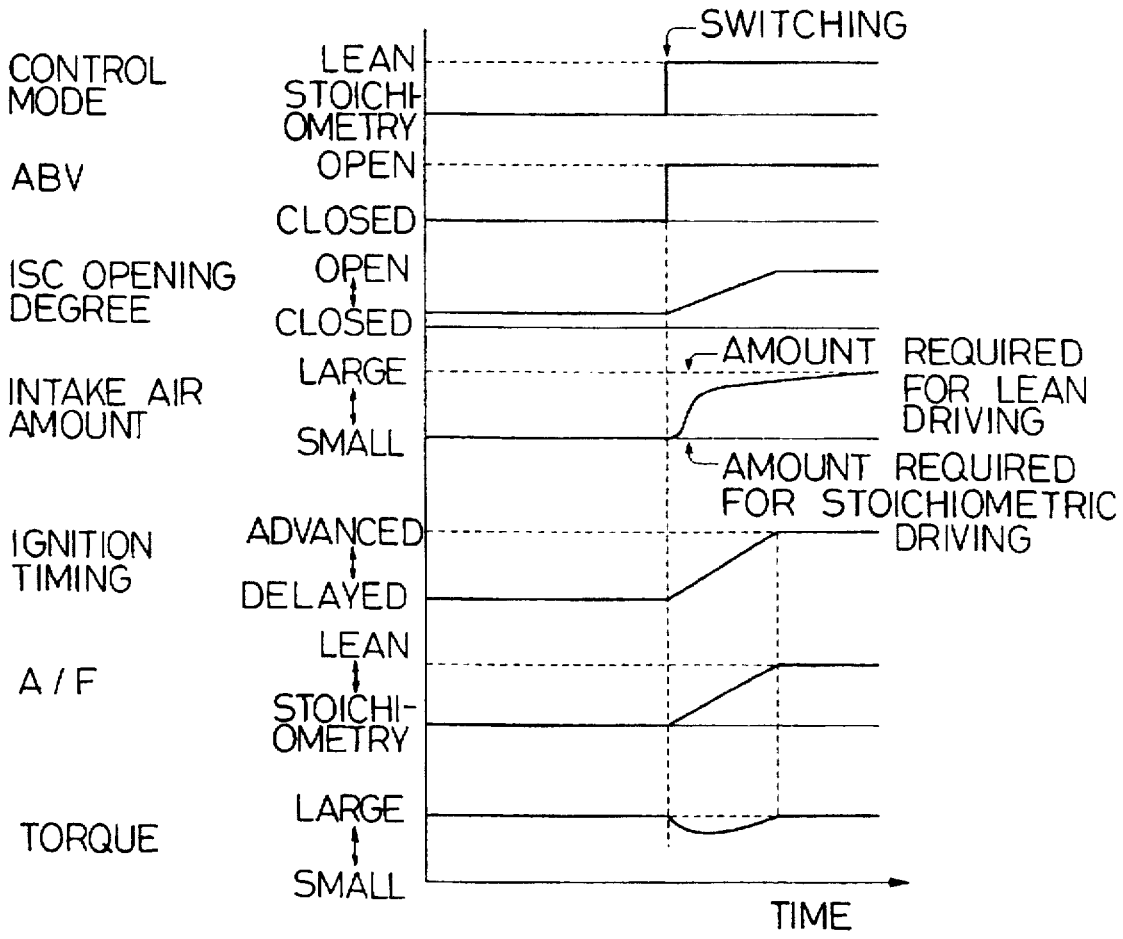
FIG. 2 is a graph showing, by way of example, changes in intake air amount, ignition timing, air-fuel ratio and engine output torque with elapse of time at the time of switching from the stoichiometric driving to the lean driving in a case where an ignition timing control is introduced into a conventional device.

Referring to FIG. 7, in an intake manifold 2*a* connected to the respective cylinders of a lean-burn engine 1, electromagnetic fuel injection valves 3 are disposed for the respective cylinders, and fuel of constant pressure is supplied from a fuel pump (not shown) to each of the electromagnetic fuel injection valves 3 via a fuel pressure regulator (not shown). Further, an intake pipe 2*b* which cooperates with the intake manifold 2*a* to constitute an intake passage 2 is connected to the intake manifold 2*a* via a surge tank 2*c*. An air cleaner 4 is disposed at the outer end of the intake pipe 2*b*, and a throttle valve 5 is disposed in an intermediate portion of the intake pipe 2*b*. An ignition plug (not shown) mounted on each cylinder of the engine 1 is connected to an igniter (not shown) via a distributor (not shown). A high voltage generated in the secondary coil at the time of cut-off of the current supply to the primary coil of the igniter causes the ignition plug to spark and ignite the mixture in the engine cylinder.

The control device of the first embodiment of this invention includes an electronic control unit (ECU) 10 functioning as control means or the like in the bypass air control which will be described later. The control unit 10 has a central processing unit, a memory device including a non-volatile battery backup RAM for storing various control programs and the like, an input/output device and the like (not shown).

The control device further includes an ISC valve 30 disposed as a bypass air valve in a bypass passage 20 which is provided in the intake pipe 2*b* to bypass the throttle valve 5. The ISC valve 30, which cooperates with the control unit 10 to constitute air amount adjusting means and which also functions as an idling speed control valve, includes a valve body 31 for permitting and inhibiting air supply to the engine 1 via the bypass passage 20 by opening and closing the bypass passage, and a stepper motor (pulse motor) 32 for driving the valve body to open and close the same. The pulse motor 32 is connected to the output side of the engine 10 together with the fuel injection valve 3 and igniter.

Further, the control device includes various sensors serving as engine driving parameter detecting means. For example, the sensors include an air flow sensor 41 disposed on the intake passage 2 side, for detecting an intake air amount based on Karman vortex information; a potentiometer-type throttle sensor 42 disposed on the throttle valve 5, for detecting the throttle opening degree; an $O_2$ sensor 43 disposed on the exhaust 9 side of the engine 1, for detecting the oxygen concentration in the exhaust gas; a water temperature sensor 44 for detecting the temperature of engine cooling water; a crank angle sensor 45 disposed on the distributor, for outputting a pulse signal (TDC signal) each time a predetermined crank angle position, for example, top dead center, is detected; a cylinder discriminating sensor 46 for detecting that a particular cylinder, for example, the first cylinder, is at a predetermined crank angle position; and a pressure sensor 47 mounted on the surge tank 2*c*, for detecting the negative pressure in the intake pipe on the downstream side with respect to the throttle valve 5. These sensors are connected to the input side of the electronic control unit 10.

The electronic control unit 10 calculates the engine rotation speed from the stroke period of the engine detected based on the generation interval of the TDC signal delivered from the crank angle sensor 45 for every 180 degrees of crank angle, and determines a cylinder for next ignition/fuel-supply based on an output from the cylinder discriminating sensor 46 and a predetermined ignition/fuel-supply order of the engine cylinders.

Figure 9:
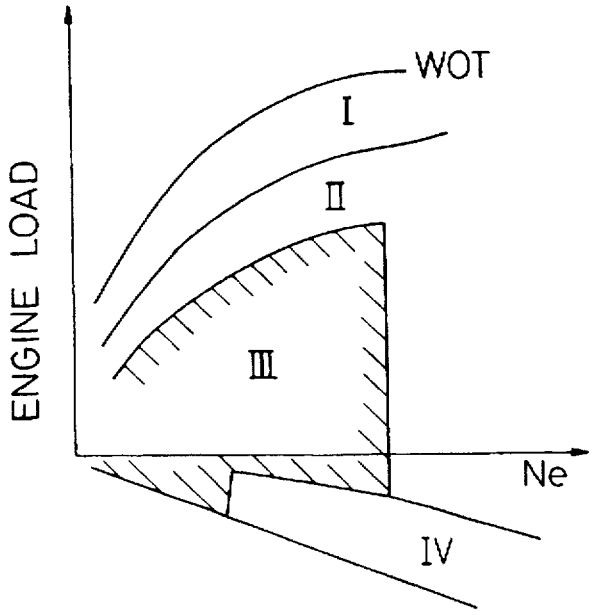
FIG. 9 is a graph showing a rich-feedback-driving region, stoichiometric-feedback-driving region, lean-feedback-driving region and fuel-cut-driving region of the engine as a function of engine load and engine rotation speed.

Further, the electronic control unit 10 determines the engine driving region based on outputs of the various sensors, calculates a fuel injection amount corresponding to the engine driving region, that is, a time period of opening of the fuel injection valve 3, and optimum ignition timing, supplies a driving signal corresponding to the calculated opening time period to each fuel injection valve 3 to thereby supply a desired amount of fuel to each cylinder, and supplies a driving signal corresponding to the calculated ignition timing from the driving circuit to the igniter to thereby ignite the mixture. As shown, by way of example, in FIG. 9, the entire driving region of the engine is divided into a rich-driving region, lean-feedback-driving region III, and fuel-cut-driving region IV according to the engine rotation speed Ne and engine load such as the throttle opening degree. The rich-driving region is further divided into the rich-feedback-driving region I and stoichiometric-feedback-driving region II. In the drawing, symbol WOT indicates the full opening of the throttle valve.

With the above structure, the electronic control unit 10 determines the present engine driving region based on the engine load parameter, for example, an output of the throttle sensor 42, and the engine rotation speed Ne calculated from the generation period of an output of the crank angle sensor 45.

Further, the electronic control unit 10 calculates the valve opening time period Tinj of the fuel injection valve 3 according to the following equation.

$$Tinj=(A/N\div A)\times K1\times K2+T0$$

where A/N is an intake air amount for each intake stroke derived from the engine rotation speed Ne and Karman vortex frequency detected by the air flow sensor 41. A is a target air-fuel ratio and is set to the theoretical air-fuel ratio or the approximate value thereof (for example, air-fuel ratio 14.7) in the stoichiometric-feedback-driving region, to a value on the fuel-rich side with respect to the theoretical air-fuel ratio in the rich-feedback-driving region, and to a value on the fuel-lean side with respect to the theoretical air-fuel ratio in the lean-feedback-driving region. K1 indicates a coefficient for converting the fuel flow rate into the valve opening time period. K2, which is a correction coefficient value set according to various parameters representing the engine driving state, is set according to the engine water temperature TW detected by the engine water temperature sensor 44, the oxygen concentration in the exhaust gas detected by the $O_2$ sensor 43 and the like, for example. T0 is a correction value which is set according to the battery voltage and the like detected by a battery sensor, not shown.

The electronic control unit 10 supplies a driving signal corresponding to the valve opening time period Tinj to the fuel injection valve 3 corresponding to the cylinder to which fuel is to be supplied in the present cycle, to thereby supply the cylinder with an amount of fuel corresponding to the valve opening time period Tinj.

Figure 8:
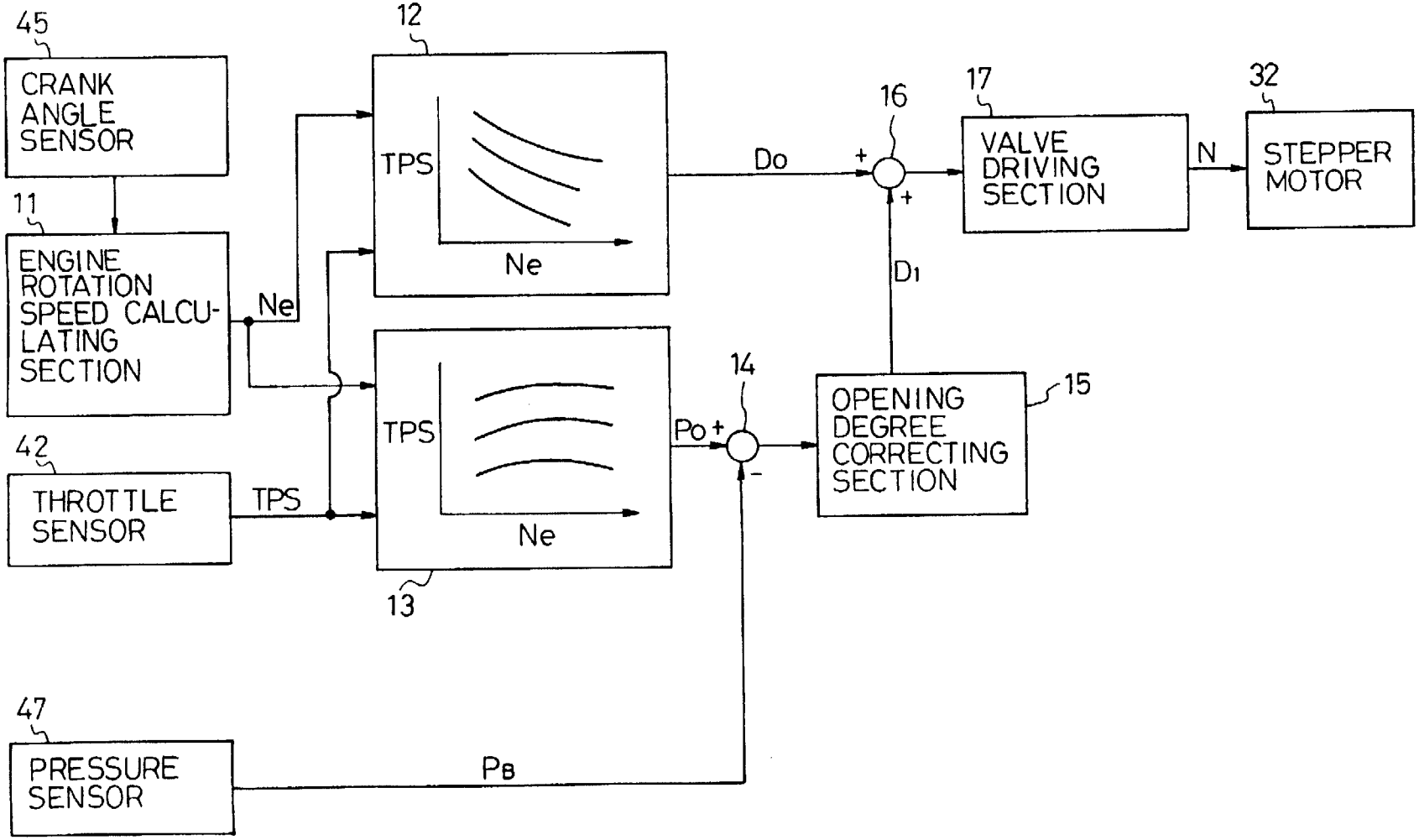
FIG. 8 is a block diagram showing respective functional sections of an electronic control unit (ECU) shown in FIG. 7 relating to the bypass air control.

In relation to the bypass air control, the electronic control unit 10 functionally has various functional sections shown in FIG. 8.

That is, the electronic control unit 10 includes an engine rotation speed calculating section 11 for calculating the engine rotation speed Ne based on an output of the crank angle sensor 45; a basic opening degree setting section 12 for deriving a basic opening degree D0 of the ISC valve 30 based on the output Ne of the calculating section and an output TPS of the throttle sensor 42; and a target intake pressure setting section 13 for deriving a target intake manifold pressure P0 at the time of lean driving according to the output Ne of the engine rotation speed calculating section and the output TPS of the throttle sensor. In a subtracting section 14, the output PB of the pressure sensor 47 is subtracted from the output P0 of the target intake pressure setting section. In an opening correcting section 15, an opening degree correction amount D1 corresponding to the output of the subtracting section 14 is derived. The target intake pressure setting section output D0 and the opening degree correcting section output D1 are added together in an adding section 16, and an adding section output indicating the target ISC valve opening degree is delivered to a valve driving section 17.

The valve driving section 17 determines a driving pulse number N and an ISC valve operating direction based on the target ISC valve opening degree D0+D1 and the present ISC valve opening degree stored in a register (not shown) contained in the electronic control unit 10, for example, and supplies output pulses of a number equal to the driving step number N to respective phase magnetic poles (not shown) of a stepper motor 32 for the ISC valve 30 in a phase order corresponding to the valve operating direction. As a result, the opening degree of the ISC valve 30 is controlled to the target opening degree D0+D1.

Now, the bypass air control operation of the control device shown in FIGS. 7 and 8 is explained.

Figure 10:
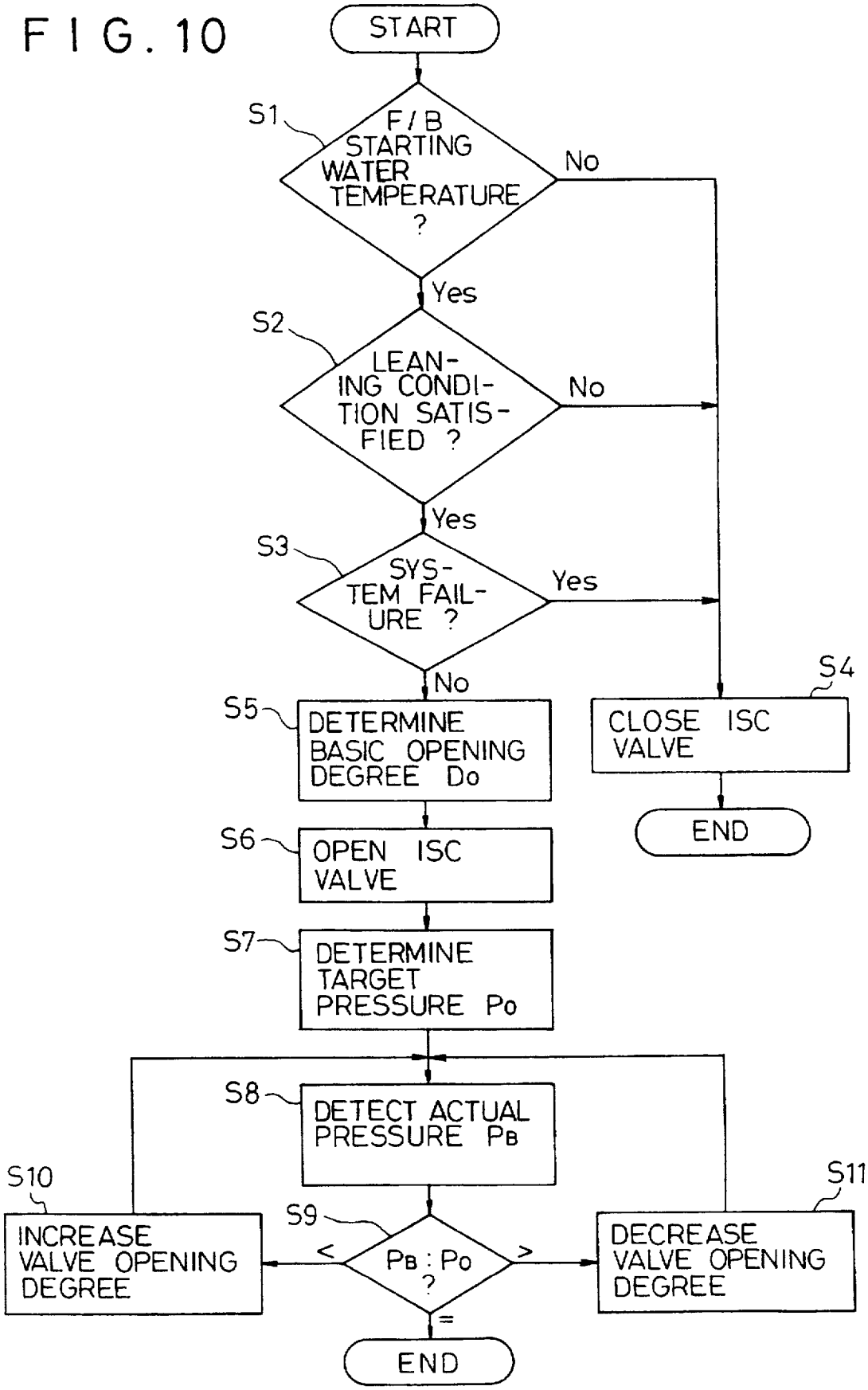
FIG. 10 is a flowchart showing a bypass air control routine executed by the electronic control unit shown in FIGS. 7 and 8.

During the driving of the engine 1, the electronic control unit 10 executes the bypass air control routine shown in FIG. 10 at intervals of a predetermined cycle.

In the control routine, the control unit 10 reads an output from the water temperature sensor 44, and determines whether or not the engine cooling water temperature represented by the sensor output exceeds a predetermined feedback-starting-water-temperature (step S1). If the result of determination is "YES", the control unit 10 reads outputs of the throttle sensor 42 and crank angle sensor 45, and determines whether or not the engine 1 is driven in the lean-feedback-driving region, that is, whether a mixture-leaning condition is satisfied or not based on the throttle sensor output TPS and engine rotation speed Ne calculated from the generation period of the crank angle sensor output (step S2).

If the result of determination in the step S2 is "YES", the control unit 10 determines whether a system failure relating to the control device is detected or not in the failure determining routine, not shown (step S3). If the result of determination is "NO", the bypass control for lean driving is started, as will be described later.

On the other hand, when it is determined in the step S1 that the engine cooling water temperature does not reach the feedback-starting-water-temperature, or it is determined in the step S2 that the mixture-leaning condition is not satisfied, or it is determined in the step S3 that a system failure occurs, the control unit 10 delivers output pulses of a driving step number N corresponding to the present ISC valve opening degree to the stepper motor 32 in a phase order corresponding to the valve closing direction (therefore, if the ISC valve is already closed, no driving pulse is delivered), thus closing the ISC valve 30 (step S4). Whereupon, the execution of the bypass air control routine in the present cycle is finished.

If the results of determinations in the steps S1 and S2 are "YES" and if the result of determination in the step S3 is "NO", i.e., for example, if the mixture leaning condition is satisfied after the feedback-starting-water-temperature is reached in a condition where no system failure occurs so that the engine is driven in the rich-driving region (rich- or stoichiometric-feedback-driving region), then the bypass air control for lean driving is started in this control routine in order to make a shift from the rich driving (rich driving or stoichiometric driving in the narrow sense) to the lean driving. Meanwhile, concurrently, a shift is made from the target air-fuel ratio for the rich driving to the target air-fuel ratio for the lean driving in a control routine relating to the above-described fuel supply control. The air-fuel ratio switching may be made in a multi-stage fashion.

Specifically, at the start of the bypass air control for lean driving, with reference to the TPS·Ne–D0 map shown in the block 12 of FIG. 8, the control unit 10 determines the basic opening degree D0 of the ISC valve 30 based on the engine rotation speed Ne and throttle sensor output TPS detected at the start of switching from the rich driving to the lean driving and used for the determination of fulfillment/unfulfillment of the mixture-leaning condition in the step S2 (step S5). Since the ISC valve 30 is in a closed state at the start of switching to the lean driving, the control unit 10 delivers driving pulses of a driving step number N corresponding to the basic opening degree D0 to the respective phase magnetic poles of the stepper motor 32 in a phase order corresponding to the ISC valve opening direction, to thereby open the ISC valve 30 through the basic opening degree D0. The basic opening degree D0 is stored as the present set valve opening degree (step S6).

Next, referring to the TPS·Ne–P0 map shown in the block 13 of FIG. 8, the control unit 10 determines the target intake manifold pressure P0 for lean driving based on the engine rotation speed Ne and throttle sensor output TPS detected at the start of switching to the lean driving (step S7). The TPS·Ne–P0 map is set in a manner providing that target intake manifold pressure P0 at which the same engine output torque can be generated in the lean driving as that in the rich driving, at the same throttle opening degree TPS.

Next, the control unit 10 reads an output of the pressure sensor 47 representing the actual intake manifold pressure PB (step S8), and then compares the pressure sensor output PB with the target intake manifold pressure P0 (step S9). If the actual intake pressure PB is lower than the target intake manifold pressure P0, the control unit 10 delivers driving pulses of a driving step number N corresponding to the opening degree correction amount D1 which in turn corresponds to the pressure deviation P0–PB to the respective phase magnetic poles of the stepper motor 32 in a phase order corresponding to the ISC valve opening direction, to thereby increase the ISC valve opening degree by the opening degree correction amount D1 (step S10). Whereupon, the control program is returned to the step S8. If the actual intake pressure PB exceeds the target intake manifold pressure P0, driving pulses of a driving step number AN are delivered to the respective phase magnetic poles of the stepper motor 32 in a phase order corresponding to the ISC valve closing direction, to thereby reduce the ISC valve opening degree by the opening degree correction amount D1 (step S11). Then, the control program is returned to the step S8.

After this, the steps S8 to S11 are executed. If it is determined in the step S9 that the actual intake pressure PB becomes equal to the target intake manifold pressure P0, the control routine is ended.

As described above, during the switching from the rich driving to the lean driving, the ISC valve opening degree and the intake air amount are so feedback-controlled as to generate that intake manifold pressure at which the same torque is generated as that in the rich driving. As a result, a change in the engine output torque which would be otherwise caused by the switching of driving states can be suppressed, thereby reducing a shock and improving the drivability.

A control device of a second embodiment of this invention is explained below.

In the control device of the first embodiment, the stepper-motor-driven-type air bypass valve 30 is used to feedback-control the intake manifold pressure during the switching to the lean driving to a target pressure derived based on the engine rotation speed Ne and throttle opening degree TPS detected at the start of the switching to the lean driving. Contrary to this, the device of this embodiment is designed to carry out a duty control of the supply of a control negative pressure to the vacuum-sensitive-type air bypass valve, so as to control the time average opening degree of the valve, to thereby feedback-control the intake manifold pressure That is, as shown in FIG. 11, the control device includes a vacuum-sensitive valve 130 disposed as an air bypass valve on a bypass passage 120 which is disposed in parallel to an intake passage 2 to bypass a throttle valve 5, and a solenoid valve 150 disposed in a vacuum passage 140 for communicating the vacuum chamber of the vacuum-sensitive valve 130 with a surge tank 2*c*, the valve 150 being operable to open and close the passage 140.

The vacuum-sensitive valve 130 includes a valve body 131 for opening/closing the bypass passage 120, a spring 132 biasing the valve body in the valve closing direction, and a diaphragm 133 integrally formed with the valve body 131 to define a vacuum chamber. The valve body 131 is opened by a lift amount corresponding to the pressure in the vacuum chamber.

Figure 11:
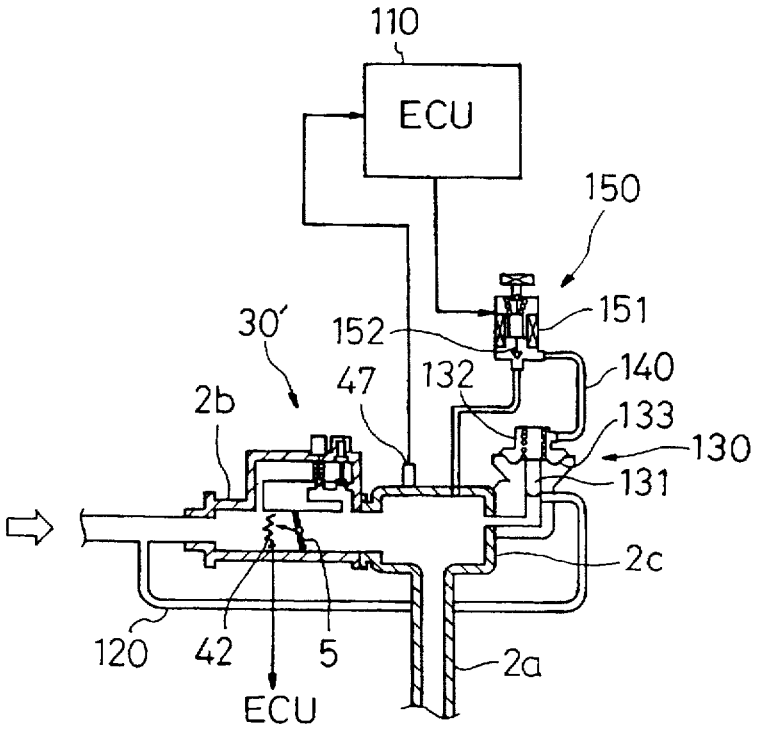
FIG. 11 is a fragmentary schematic view showing a control device according to a second embodiment of this invention together with peripheral elements.

In FIG. 11, reference numeral 301 indicates an ISC valve exclusively used for the control of air supply at the time of idling driving.

Figure 12:
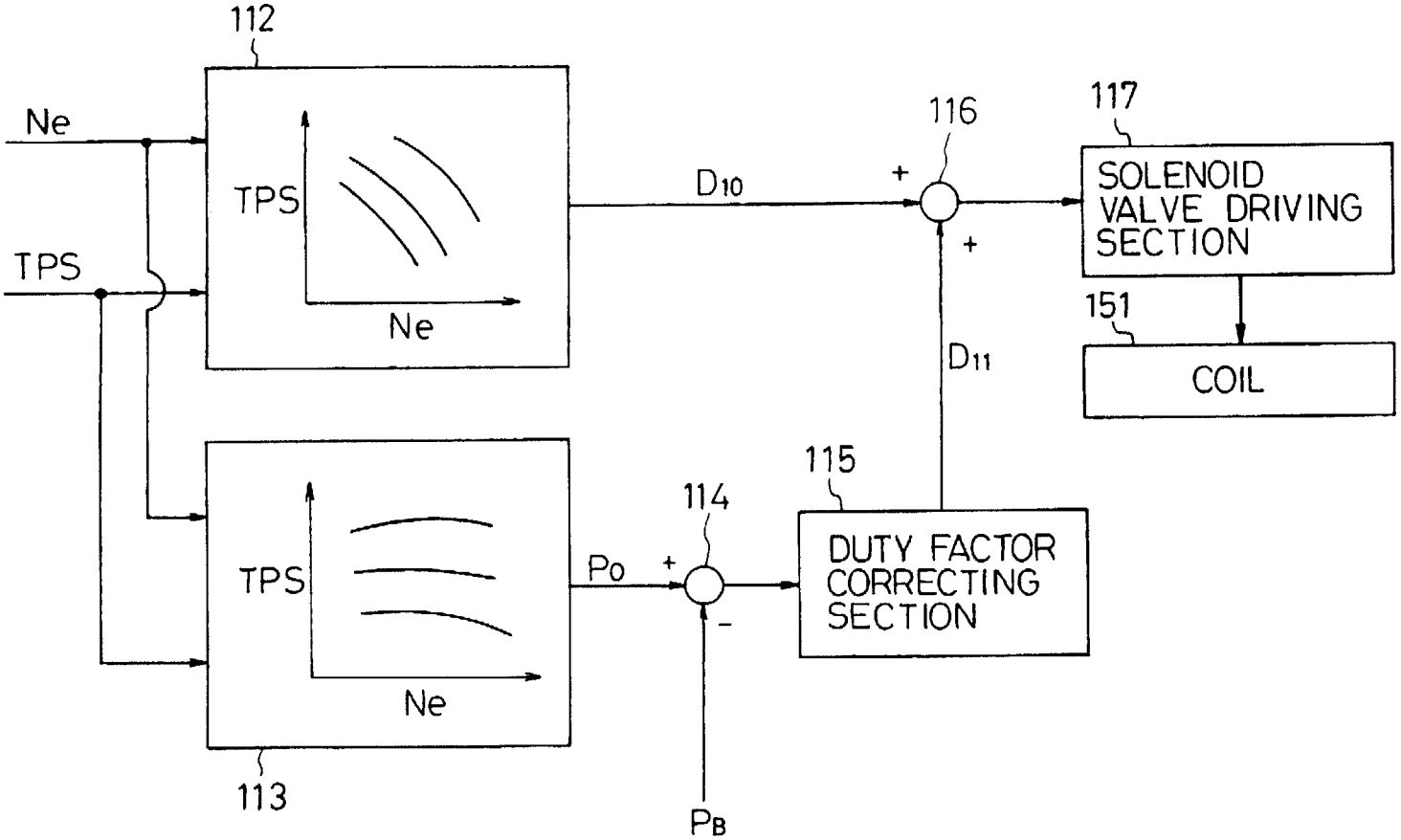
FIG. 12 is a block diagram showing respective functional sections of the electronic control unit (ECU) shown in FIG. 11 relating to the bypass air control.

As shown in FIG. 12, in relation to the air bypass control, an electronic control unit (ECU) 110 includes a basic duty factor setting section 112 for receiving an output Ne of an engine rotation speed calculating section (not shown) and a throttle sensor output TPS, and for deriving a basic duty factor D10 of the solenoid valve 150; a target intake pressure setting section 113; subtracting section 114; and adding section 116. The elements 113, 114 and 116 respectively correspond to the elements 13, 14 and 16 shown in FIG. 8. The control unit 110 includes a duty factor correcting section 115 for deriving a duty factor correction amount D11 based on a subtracting section output P0–PB; and a solenoid valve driving section 117 for controlling the ON/OFF state of the exciting coil 151 of the solenoid valve 150 with the target duty factor D10+D11 supplied from the adding section 116.

The bypass air control operation of the control device shown in FIGS. 11 and 12 is explained below with reference to FIG. 13.

Figure 13:
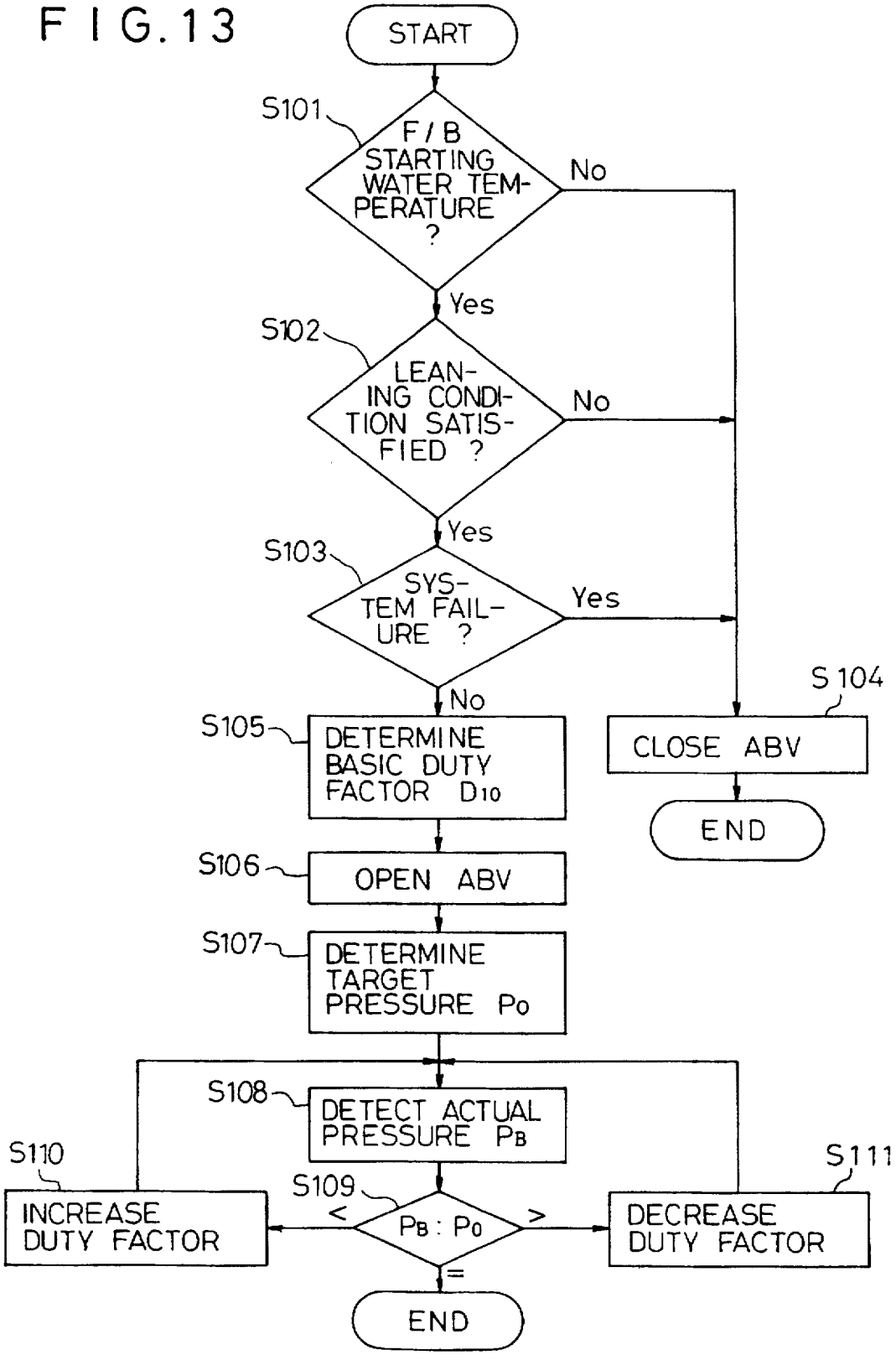
FIG. 13 is a flowchart showing a bypass air control routine executed by the electronic control unit shown in FIGS. 11 and 12.

In the bypass air control routine shown in FIG. 13, if the result of determination in one of the steps S101 and S102 corresponding to the steps S1 and S2 in FIG. 10 is "NO" or if the result of determination in the step S103 corresponding to the step S3 is "YES", the control unit 110 de-energizes the exciting coil 151 of the solenoid valve 150, and stores "0%" as the present set duty factor of the solenoid valve 150 (step S104).

As a result, the supply of negative pressure from the intake passage 2 to the vacuum chamber of the vacuum-sensitive valve 130 via the vacuum passage 140 is interrupted by the valve body 152 of the solenoid valve 150. At the same time, the atmospheric-air-introducing passage of the solenoid valve 150 is opened to permit atmospheric air to be introduced into the vacuum chamber of the vacuum-sensitive valve 130 via the passage, so that the valve body 131 of the vacuum-sensitive valve 130 is biased in the closing direction by the spring force of the spring 132. Therefore, the vacuum-sensitive valve 130 acting as an air bypass valve (ABV) is closed to interrupt the supply of bypass air to the engine 1 via the bypass passage 120.

On the other hand, if the results of determinations in the steps S101 and S102 are "YES" and if the result of determination in the step S103 is "NO", the control unit 110 derives a basic duty factor D10 of the solenoid valve 150 based on the throttle opening degree TPS and engine rotation speed Ne detected at the start of switching to the lean driving by referring to the Ne·TPS–D10 map shown in the block 112 of FIG. 12, stores the same as the present set duty factor (step S105), and ON/OFF-drives the exciting coil 151 of the solenoid valve 150 with the set duty factor D10 (step S106).

As a result, when the exciting coil 150 is energized, the solenoid valve 150 is opened so that negative pressure is introduced from the surge tank 2*c* into the vacuum chamber of the vacuum-sensitive valve 130 via the vacuum passage 140. When the exciting coil 151 is de-energized, the solenoid valve 150 is closed to interrupt the introduction of negative pressure via the vacuum passage 140, whereas the atmospheric air is introduced into the vacuum chamber via the solenoid valve 150. Therefore, the pressure in the vacuum chamber of the vacuum-sensitive valve 130 and hence the valve position or valve opening degree correspond to the set duty factor, respectively. As a result, intake air of an amount corresponding to the set duty factor is supplied to the engine 1 via the bypass passage 120.

Next, referring to the TPS·Ne–P0 map shown in the block 113 of FIG. 12, the control unit 110 determines a target intake manifold pressure P0 at the time of switching to the lean driving based on the engine rotation speed Ne and throttle sensor output TPS detected at the start of the switching to the lean driving (step S107). The TPS·Ne·P0 map is set in a manner providing that target intake manifold pressure P0 at which the same engine output torque is generated in the lean driving as that in the rich driving, at the same throttle opening degree TPS.

Next, the control unit 110 reads an output of the pressure sensor 47 representing the actual intake manifold pressure PB (step S108), and compares the pressure sensor output PB with the target intake manifold pressure P0 (step S109). If the actual intake pressure PB is lower than the target intake pressure P0, the control unit 110 stores, as a new set duty factor, the sum of a correction duty factor D11, corresponding to the pressure deviation P0–PB, and the present set duty factor. Then, the control unit 100 ON/OFF-drives the solenoid valve 150 with this duty factor (step S110), whereby a bypass air supply amount is increased. Whereupon, the process is returned to the step S108. If the actual intake pressure PB exceeds the target intake pressure P0, a new set duty factor obtained by subtracting the correction duty factor D11 from the present set duty factor is stored, and the solenoid valve 150 is driven with this duty factor so that a bypass air supply amount is decreased (step S111). Then, the control program is returned to the step S108.

Thereafter, the steps S108 to S111 are executed. If it is determined in the step S108 that the actual intake pressure PB becomes equal to the target intake pressure P0, the control routine is ended.

A control device of a third embodiment of this invention is explained below.

In the control device of the second embodiment, the opening degree of the vacuum-sensitive-type air bypass valve is controlled to feedback-control the intake manifold pressure to the target pressure, but the control device of this embodiment duty-controls a similar air bypass valve in a similar manner to thereby feedback-control the lift amount of the valve to a target value.

Figure 14:
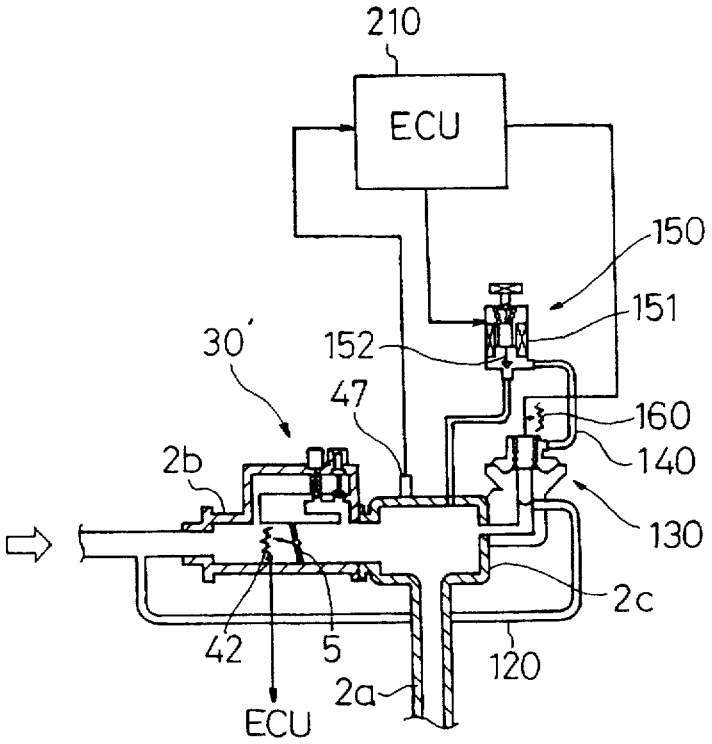
FIG. 14 is a fragmentary schematic view showing a control device according to a third embodiment of this invention together with peripheral elements.

As shown in FIG. 14, the control device is constructed in basically the same manner as the control device shown in FIG. 11. Therefore, the same elements as those of the control device shown in FIG. 11 are shown by the same reference numerals, and the explanation therefor is omitted. Unlike the device shown in FIG. 11, a position sensor 160 for detecting the opening degree of a vacuum-sensitive valve 130 of the control device is attached to the vacuum-sensitive valve 130. The position sensor 160 has a movable portion thereof connected to a valve body 131 via a diaphragm 133 of the vacuum-sensitive valve 130, and is so constructed as to deliver a detection output to an electronic control unit (ECU) 210, the detection output representing the lift amount of the valve body 131 and hence the opening degree of the vacuum-sensitive valve 130.

Figure 15:
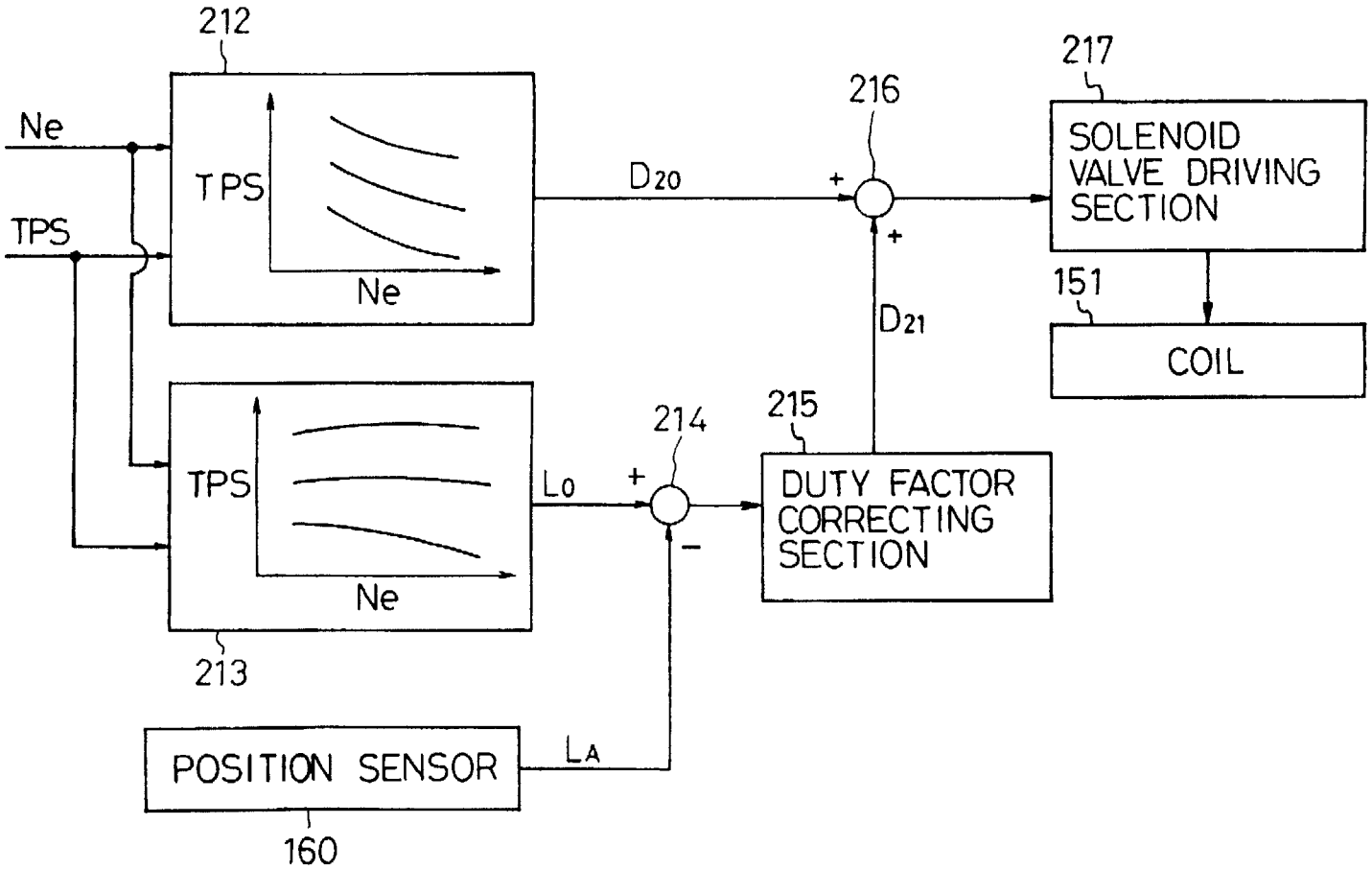
FIG. 15 is a block diagram showing respective functional sections of the electronic control unit (ECU) shown in FIG. 11 relating to the bypass air control.

As shown in FIG. 15, in relation to the air bypass control, the electronic control unit 210 includes a basic duty factor setting section 212, adding section 216, and solenoid valve driving section 217 respectively corresponding to the elements 112, 116 and 117 shown in FIG. 12, and further includes a target opening degree setting section 213 for deriving a target opening degree (target lift amount) L0 of the vacuum-sensitive valve 130 based on a throttle sensor output TPS and an output Ne of an engine rotation speed calculating section (not shown), a subtracting section 214 for subtracting an output of the position sensor 160 representing actual opening degree (lift amount) from the output L0 of the section 213, and a duty factor correcting section 215 for deriving a duty factor correction amount D21 based on a subtracting section output L0–LA. The exciting coil 151 of the solenoid valve 150 is ON/OFF-driven by the solenoid valve driving section 217 with the target duty factor D20+D21 supplied from the adding section 216.

The bypass air control operation of the control device shown in FIGS. 14 and 15 is explained below with reference to FIG. 16.

Figure 16:
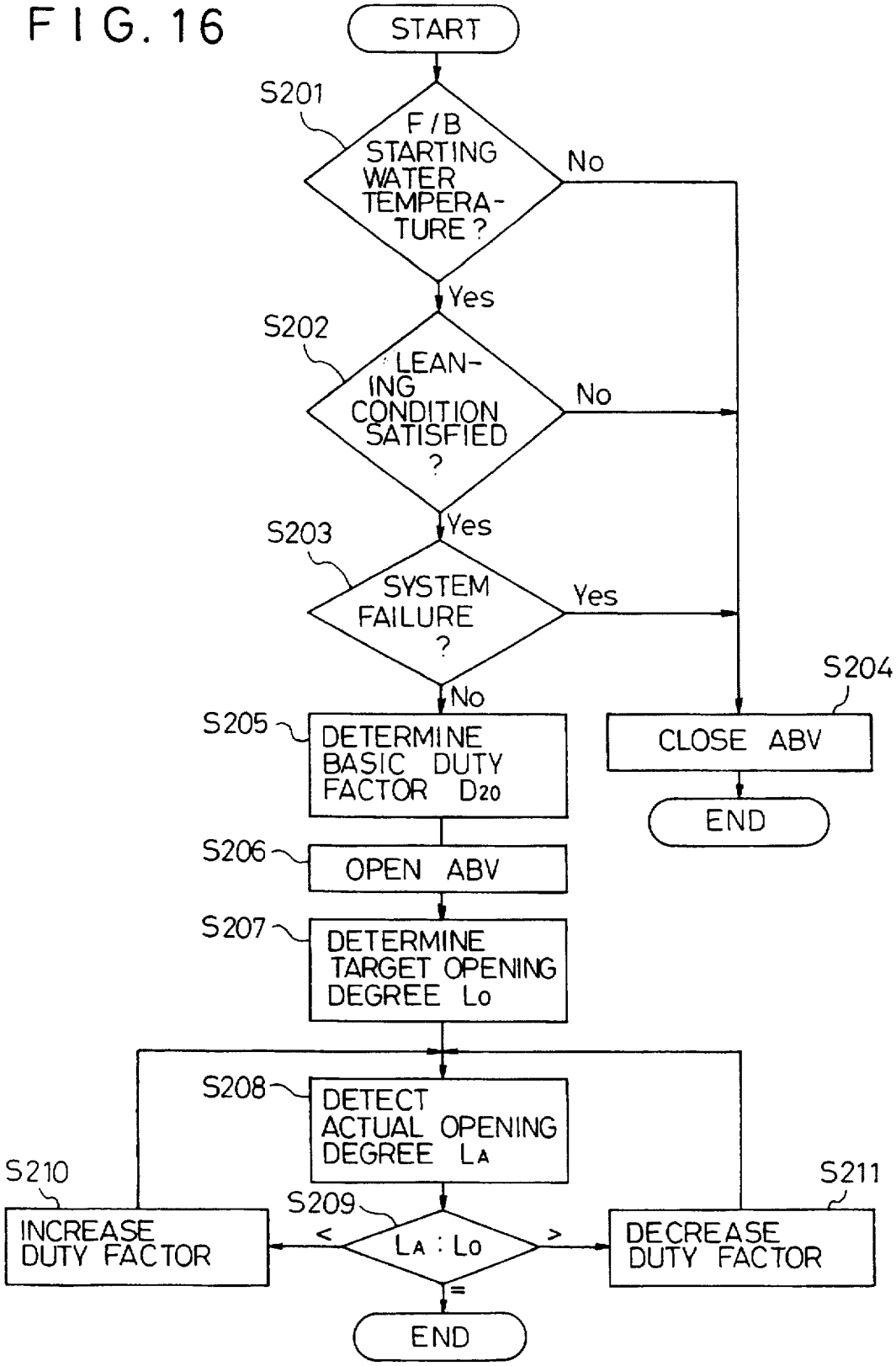
FIG. 16 is a flowchart showing a bypass air control routine executed by the electronic control unit shown in FIGS. 13 and 14.

In the bypass air control routine shown in FIG. 16, if the result of determination in one of the steps S201 and S202 corresponding to the steps S101 and S102 in FIG. 13 is "NO" or if the result of determination in the step S203 corresponding to the step S103 is "YES", the control unit 210 de-energizes the exciting coil 151 of the solenoid valve 150, and stores "0%" as the present set duty factor of the solenoid valve 150 (step S204). As a result, the vacuum-sensitive valve 130 is closed, so that the supply of bypass air to the engine 1 via the bypass passage 120 is interrupted.

On the other hand, if the results of determinations in the steps S201 and S202 are "YES" and if the result of determination in the step S203 is "NO", referring to the Ne·TPS–D20 map shown in the block 212 of FIG. 15, the control unit 210 derives a basic duty factor D20 of the solenoid valve 150 based on the throttle opening degree TPS and the engine rotation speed Ne detected at the start of switching to the lean driving, stores the same as the present set duty factor (step S205), and ON/OFF-drives the exciting coil 151 of the solenoid valve 150 with the thus set duty factor D20 (step S206). As a result, the intake air of an amount corresponding to the set duty factor is supplied to the engine 1.

Next, referring to the TPS·Ne–L0 map shown in the block 213 of FIG. 15, the control unit 210 determines a target opening degree L0 of the vacuum-sensitive valve 130 during the switching to the lean driving based on the engine rotation speed Ne and the throttle sensor output TPS detected at the start of the switching to the lean driving (step S207). The TPS Ne-L0 map is set in a manner providing a target opening degree L0 at which the same engine output torque is generated in the lean driving as that in the rich driving, at the same throttle opening degree TPS.

Next, the control unit 210 reads an output of the position sensor 160 representing the actual opening degree LA of the vacuum-sensitive valve 130 (step S208), and compares the position sensor output LA with the target opening degree L0 (step S209). Then, if the actual opening LA is smaller than the target opening degree L0, the control stores the sum of a correction duty factor D21 corresponding to the opening degree deviation L0–LA and the present set duty factor, as a new set duty factor, and ON/OFF-drives the solenoid valve 150 with this duty factor (step S210). As a result, the bypass air supply amount is increased. Whereupon, the process is returned to the step S208. If the actual opening degree LA exceeds the target opening degree L0, a new set duty factor obtained by subtracting the correction duty factor D21 from the present set duty factor is stored, and the solenoid valve 150 is driven with this duty factor so that the bypass air supply amount is decreased (step S211). Then, the control program is returned to the step S208.

After this, the steps S208 to S211 are executed. If it is determined in the step S208 that the actual opening degree LA becomes equal to the target opening degree L0, the control routine is ended.

A control device of a fourth embodiment of this invention is explained below with reference to FIG. 18.

The control device for embodying the control method is constructed in basically the same manner as the control device of the first embodiment shown in FIG. 7. Therefore, in FIG. 18, the same reference numerals are attached to elements which are the same as or similar to those shown in FIG. 7, and the explanation for these elements is omitted. In FIG. 18, reference numerals 6, 7 and 8 respectively denote an ignition plug, distributor, and igniter.

An electronic control unit (ECU) 10 of the control device which attains the functions of driving region determining means, driving control means and the like in the air-fuel ratio/ignition timing control, which will be described later, is constructed in the same manner as the ECU shown in FIG. 7. As in the case of FIG. 7, various sensors 41 to 46 used as engine driving state detecting means are connected to the control unit 10. Reference numeral 47' denotes a boost sensor used for embodying the control method of the fifth embodiment of this invention. The sensor 47' is mounted to the surge tank 2c to detect the negative pressure in the intake pipe on the downstream side of the throttle valve 5.

Like the electronic control unit shown in FIG. 7, the electronic control unit 10 calculates the engine rotation speed from the stroke period of the engine, and determines a cylinder for next ignition/fuel-supply based on an output from the cylinder discriminating sensor and a predetermined ignition/fuel-supply order of the engine cylinders. Further, the electronic control unit 10 detects various engine driving states such as the idling-driving state, heavy-load-driving state, light-load-driving state, deceleration-fuel-cut-driving state, and $O_2$-feedback-control-driving state based on various sensor outputs. The control unit 10 supplies fuel to the respective cylinders and ignites the mixture according to the detected engine driving state.

The operation of the control device with the above construction is explained below.

Figure 19:
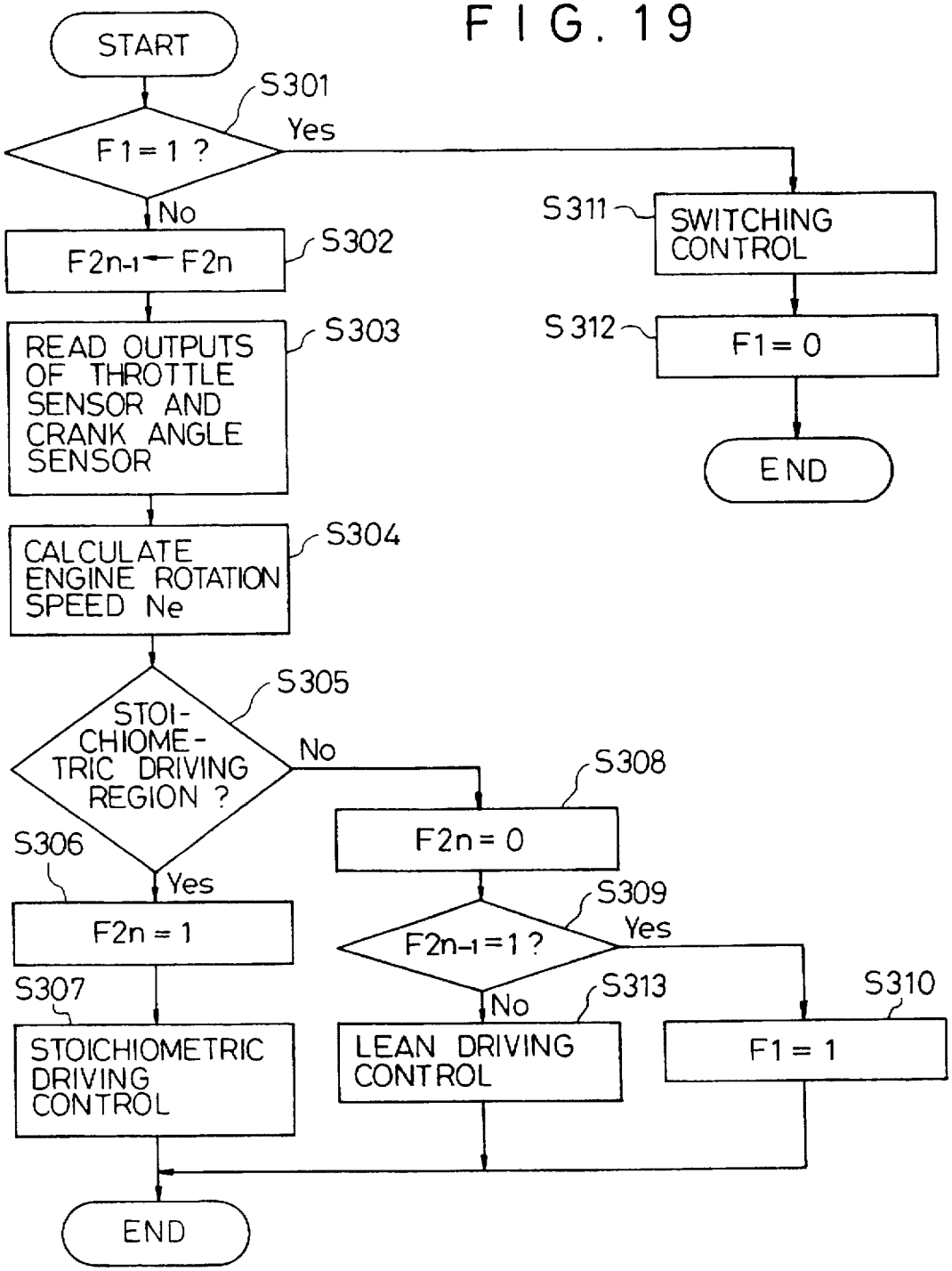
FIG. 19 is a flowchart showing an engine driving control routine in the control method executed by the electronic control unit shown in FIG. 18.

The electronic control unit 10 executes the engine driving control routine shown in FIG. 19 at intervals of a predetermined cycle during driving of the engine 1.

In the control routine, the control unit 10 first determines whether or not a flag F1 is set at a value "1" which indicates that the control operation for switching from the stoichiometric driving to the lean driving is being effected (step S301). If the result of determination is "NO", the unit 10 stores a flag value F2n, which has been set in the preceding cycle of the control routine as will be described later and which is stored in a present-cycle flag value storing area (not shown) of the memory device of the control unit 10, as a preceding-cycle flag value F2n−1 into a preceding-cycle flag value storing area (not shown) (step S302). The flag F2 represents the engine driving state, and the initial value thereof is set at "1", for example.

Next, the control unit 10 reads outputs from the throttle sensor 42 and crank angle sensor 45 (step S303), detects the generation period of the crank angle sensor output, and calculates the engine rotation speed Ne based on the detected generation period (step S304). Further, the control unit 10 determines whether or not the engine 1 is driven in the stoichiometric-driving region based on the throttle sensor output, i.e., throttle opening degree α, read in the step S302 and the engine rotation speed Ne calculated in the step S304 (step S305). The stoichiometric-driving region is predetermined set according to the engine driving state parameters such as the throttle opening degree α and the engine rotation speed Ne, so as to cope with the sudden-starting driving state, rapid-acceleration-driving state and the like of the engine 1.

If the result of determination in the step S305 is "YES", the control unit 10 sets the present-cycle flag value F2n to a value "1" which indicates the stoichiometric-driving state, stores the same into the present-cycle flag value storing area (step S306), and carries out the stoichiometric-driving control (step S307).

In the stoichiometric-driving control, the electronic control unit 10 controls the opening degree of the ISC valve 30 to a basic opening degree PBAS corresponding to a basic supplementary air amount according to the engine driving state parameters such as the throttle opening degree α and engine rotation speed Ne, so as to supply basic supplementary air of an amount suitable for the driving state to the engine 1 via the bypass passage 20, thereby preventing the engine stall due to a rapid reduction in the engine rotation speed caused by a rapid closing operation of the throttle valve 5.

Further, the electronic control unit 10 calculates the valve opening time period Tinj of the fuel injection valve 3 according to the following equation.

$$Tinj=(A/Nm+\lambda S)\times K1\times K2+T0$$

where A/Nm is an air amount for each intake stroke introduced into the associated cylinder and derived from the engine rotation speed Ne calculated in the step S304 and Karman vortex frequency detected by the air flow sensor 41. λS is a target air-fuel ratio (first basic air-fuel ratio) and is set to the theoretical air-fuel ratio or the approximate value thereof of (for example, air-fuel ratio 14.7). K1 indicates a coefficient for converting the fuel flow rate into the valve opening time period. K2 is a correction coefficient value set according to various parameters representing the engine driving state. For example, K2 is set according to the engine water temperature TW detected by the engine water temperature sensor 44, the oxygen concentration in the exhaust gas detected by the $O_2$ sensor 43, and the like. T0 is a correction value set according to the battery voltage detected by a battery sensor which is not shown, and the like.

The electronic control unit 10 supplies a driving signal corresponding to the valve opening time period Tinj calculated as described above to the fuel injection valve 3, and supplies fuel of an amount corresponding to the valve opening time period Tinj to a cylinder to which fuel is to be supplied in the present cycle, thereby carrying out the stoichiometric driving of the engine 1.

During the stoichiometric driving, the electronic control unit 10 supplies a driving signal to the igniter 8 based on a first basic ignition timing θIG1 predeterminedly set as a function of the engine rotation speed Ne and the like, to thereby control the ignition timing so as to effect the ignition at the crank angle position corresponding to the ignition timing θIG1.

Referring to FIG. 19 again, the control routine is further explained.

If the result of determination in the step S305 is "NO", that is, if it is determined that the engine 1 is not driven in the stoichiometric-driving region, the control unit 10 sets the present-cycle flag value F2n to "0" indicating the lean driving region, stores the same into the present-cycle flag value storing area (step S308), and determines whether or not the preceding-cycle flag value F2n−1, stored at the step S302 into the preceding-cycle flag value storing area, is equal to a value of "1" indicating the stoichiometric-driving region (step S309). If the result of determination is "YES", the control unit 10 sets the flag F1 to the value "1" in the step S310, and terminates execution of the control routine in the present cycle.

Since it is determined in the step S301 of the next cycle that the value of the flag F1 is "1", the control unit 10 effects the switching control shown in detail in FIGS. 20 to 23 for switching from the stoichiometric driving to the lean driving (step S311).

In the switching control, the control unit 10 derives a response delay time T1 of intake air amount in response to the ISC valve opening operation from a α·Ne–T1 map, not shown, based on the throttle opening degree α detected in the step S303 and the engine rotation speed Ne calculated in the step S304, derives a lag control time T2 from a α·Ne–T2 map, not shown, and derives an advance control time T3 from a α·Ne–T3 map, not shown (step S321).

Next, the control unit 10 calculates an ISC valve opening amount ΔPISC in a period from the time of starting of the switching from the stoichiometric driving to the lean driving to the time of completion of the switching based on the throttle opening degree α and the engine rotation speed Ne (step S322).

In the calculation of the ISC valve opening amount ΔPISC, a target intake air amount A/NL at the time of lean driving is read out from a α·Ne–A/NL map (not shown) previously stored in the memory device of the control unit 10 based on the throttle opening degree α and the engine rotation speed Ne. Preferably, the map is set in a manner providing air of an amount necessary to generate substantially the same engine torque in the lean driving as that in the stoichiometric driving. In other words, the map is set in a manner making the switching from the stoichiometric driving to the lean driving by increasing only the air amount while keeping the amount of fuel supplied to the engine 1 substantially constant, to thereby prevent an occurrence of a shock.

It is also possible to set the target intake air amount A/NL at the time of lean driving according to the engine driving state. In this case, the target intake air amount A/NL is calculated according to the following equation based on the intake air amount A/NS at the time of stoichiometric driving read out from a α·Ne–A/NS map (not shown) based on the throttle opening degree α and the engine rotation speed Ne, the target air-fuel ratio λL at the time of lean driving, and the target air-fuel ratio (second basic air-fuel ratio) λS at the time of stoichiometric driving. Meanwhile, the target air-fuel ratio λL is set to a predetermined value (for example, air-fuel ratio 22) which lies on the fuel-lean side with respect to the theoretical air-fuel ratio.

$$A/NL=(A/NS+\lambda S)\times\lambda L$$

After the target intake air amount A/NL is derived as described above, the control unit 10 derives a deviation ΔA/N between the target intake air amount A/NL and the actual intake air amount A/Nm, and then calculates the ISC valve opening amount ΔPISC corresponding to the deviation ΔA/N in accordance with the following equation, for example.

$$\Delta PISC=KP\cdot\Delta A/N$$

where KP is a feedback proportional term gain. It is possible to variably set the gain KP as a function of the engine rotation speed Ne, for example.

After the ISC valve opening operation amount ΔPISC is determined in the step S322, the control unit 10 calculates a target ISC valve opening degree PISC at the time of completion of the switching control according to the following equation, in the step S323.

$$PISC=PBAS+\Delta PISC$$

Next, an ISC valve opening degree change amount ΔDISC for each control operation period ΔT is calculated based on the ISC valve opening operation amount ΔPISC, the response delay time T1, lag control time T2 and advance control time T3 derived in the step S321, and a predetermined control operation period ΔT (step S323).

In the step S324, a lag amount in the lag control time T2 is calculated based on the lag control time T2 and a predetermined lag control amount ΔθL for one control operation period ΔT (or a lag control amount ΔθL for one control operation period ΔT is calculated based on a predetermined lag amount and the lag control time T2). Next, an advance control amount ΔθA for one control operation period ΔT is calculated based on the lag amount, a target ignition timing (second basic ignition timing) θIG2 at the time of lean driving, and the advance control time T3.

In the step S325, an air-fuel ratio control amount Δλ for one control operation period ΔT is calculated based on the target air-fuel ratio (first basic air-fuel ratio) λS at the time of stoichiometric driving, the target air-fuel ratio (second basic air-fuel ratio) λL at the time of lean driving, and the advance control time (air-fuel-ratio-leaning control time) T3.

Next, the control unit 10 sets a value T1', obtained by rounding a value obtained by dividing the response delay time T1 derived in the step S321 by the control operation period ΔT, in a timer (not shown) (step S326), and determines whether the stored value T1' of the timer is "0" or not (step S327). Since the result of determination in the step S325 becomes "NO" immediately after the response delay time T1 is set, the control unit 10 waits the elapse of the control operation period ΔT, subtracts "1" from the stored value T1' of the timer (steps S328, S329), sets the sum of the present set ISC valve opening degree DISC (the initial value thereof corresponds to the basic opening degree PBAS) and the ISC valve opening change amount ΔDISC, as a new set ISC valve opening degree DISC (step S330), and supplies a driving signal corresponding to the ISC valve opening change amount ΔDISC to the pulse motor 32, to thereby increase the opening degree of the ISC valve 30 (step S331). As a result, the valve opening operation of the ISC valve 30 in the switching control is started from the switching control starting time (time point of t0 in FIG. 24).

Figure 24:
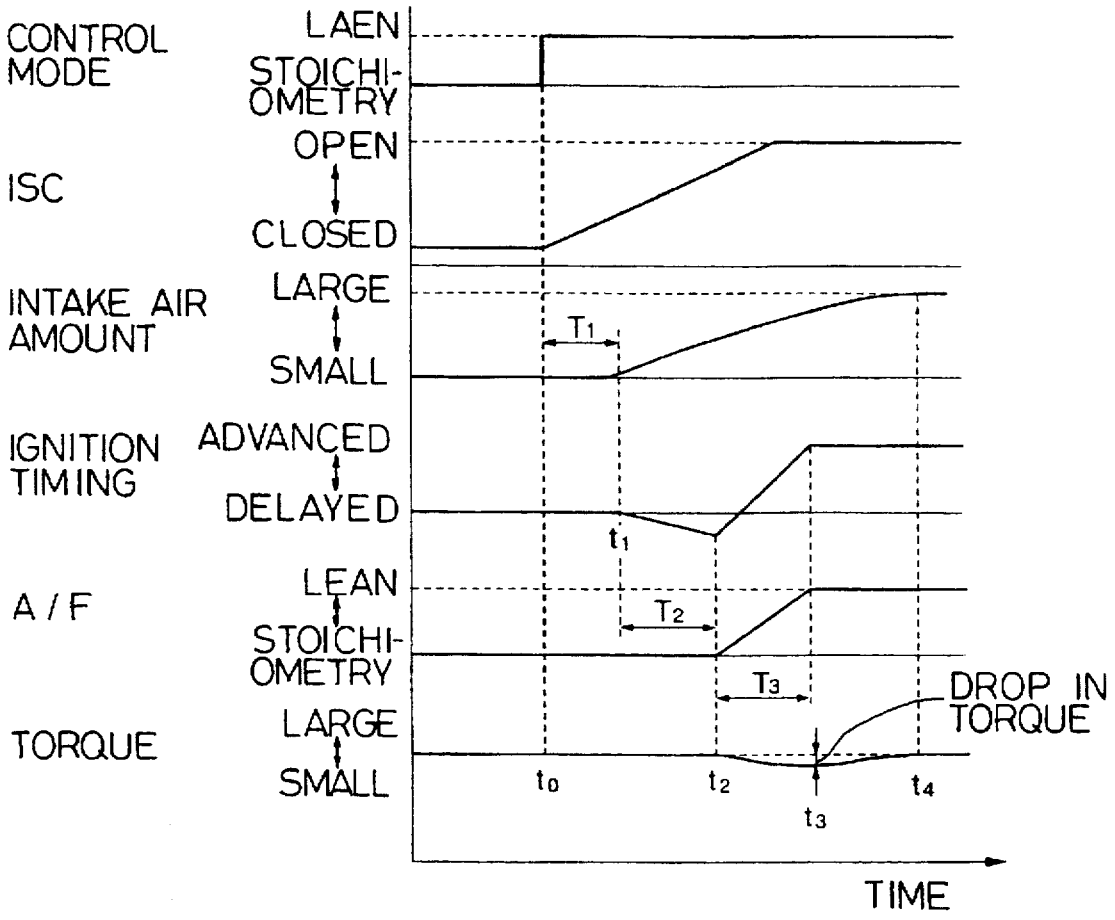
FIG. 24 is a graph showing, by way of example, changes in opening degree of the ISC valve, intake air amount, ignition timing, air-fuel ratio and engine output torque with elapse of time before and after the switching control in a control method according to the fourth embodiment.

After this, the steps S327 to S331 are repeatedly effected, and the ISC valve opening degree is open-loop-controlled such that the ISC valve opening degree will gradually increase with the elapse of time, as shown in FIG. 24.

If it is determined in the step S327 that the stored value T1' of the timer becomes "0", a value T2' corresponding to the lag control time T2 is set in the timer (step S332), and a determination is made as to whether the stored value T2' of the timer is "0" or not (step S333). Since the result of determination in the step S333 becomes "NO" immediately after the lag control time T2 is set, the control unit 10 waits the elapse of the control operation period ΔT, subtracts "1" from the stored value T2' of the timer (steps S334, S335), sets a value, obtained by subtracting the predetermined lag control amount ΔθL for one predetermined control operation time ΔT from the present set ignition timing θIG (its initial value is the same as the first basic ignition timing θIG1), as a new set ignition timing θIG, and sets the sum of the present set ISC valve opening degree DISC and the ISC valve opening change amount ΔDISC, as a new set ISC valve opening degree DISC (step S336). Further, the control unit 10 supplies a driving signal corresponding to the set ignition timing θIG to the igniter 8, to thereby delay the ignition timing, and supplies a driving signal corresponding to the ISC valve opening change amount ΔDISC to the pulse motor 32, to thereby increase the ISC valve opening degree (step S337). When the response delay time T1 of intake air amount for ISC valve opening change has elapsed from the switching control starting time t0 so that the intake air amount starts to increase (at a time point of t1), the lag control is started to suppress an increase in the torque caused by an increase in the intake air amount, while continuously increasing the intake air amount.

After this, the steps S333 to S337 are repeatedly effected, so that the ignition timing is controlled towards the lag side with respect to the first ignition timing θIG1 with the elapse of time, as shown in FIG. 24, to thereby prevent an increase in the torque which would be otherwise caused by an increase in the intake air amount.

If it is determined in the step S333 that the stored value T2' of the timer becomes "0", a value T3' corresponding to the advance control time T3 is set in the timer (step S338), and a determination is made as to whether the stored value T3' of the timer is "0" or not (step S339). Since the result of determination in the step S339 becomes "No" immediately after the advance control time T3 is set, the control unit 10 waits the elapse of the control operation period ΔT, subtracts "1" from the stored value T3' of the timer (steps S340, S341), and sets the sum of the present set ignition timing θIG (its initial value is equal to θIG1−ΔθL−(T2/ΔT)) and the lag control amount ΔθA for one control operation period ΔT calculated in the step S324, as a new set ignition timing θIG (step S342). Next, the control unit 10 sets the sum of the present target air-fuel ratio λIG (its initial value is equal to the target air-fuel ratio (first basic air-fuel ratio) λS at the time of stoichiometric driving) and the air-fuel ratio control amount Δλ for one control operation period ΔT calculated in the step S325, as a new target air-fuel ratio λT (step S343). Then, the control unit 10 determines whether or not the set ISC valve opening degree DISC has reached the target ISC valve opening degree PISC (step S344). If the result of determination is "NO", the control unit 10 continuously effects the updating of the set ISC valve opening degree DISC and the supply of a driving signal corresponding to the ISC valve opening change amount ΔDISC (step S345). If the result of the determination is "YES", the control unit 10 terminates the updating of the set ISC valve opening degree and the supply of the driving signal. Until the target ISC valve opening degree PISC is reached, the control unit 10 supplies a driving signal corresponding to the set ignition timing θIG to the igniter 8, while increasing the ISC valve opening degree, to thereby advance the ignition timing, and supplies a driving signal, corresponding to the valve opening time period which permits the air-fuel ratio to reach the target air-fuel ratio λ, to the fuel injection valve 3, to thereby make the air-fuel ratio lean (step S346).

Figure 3:
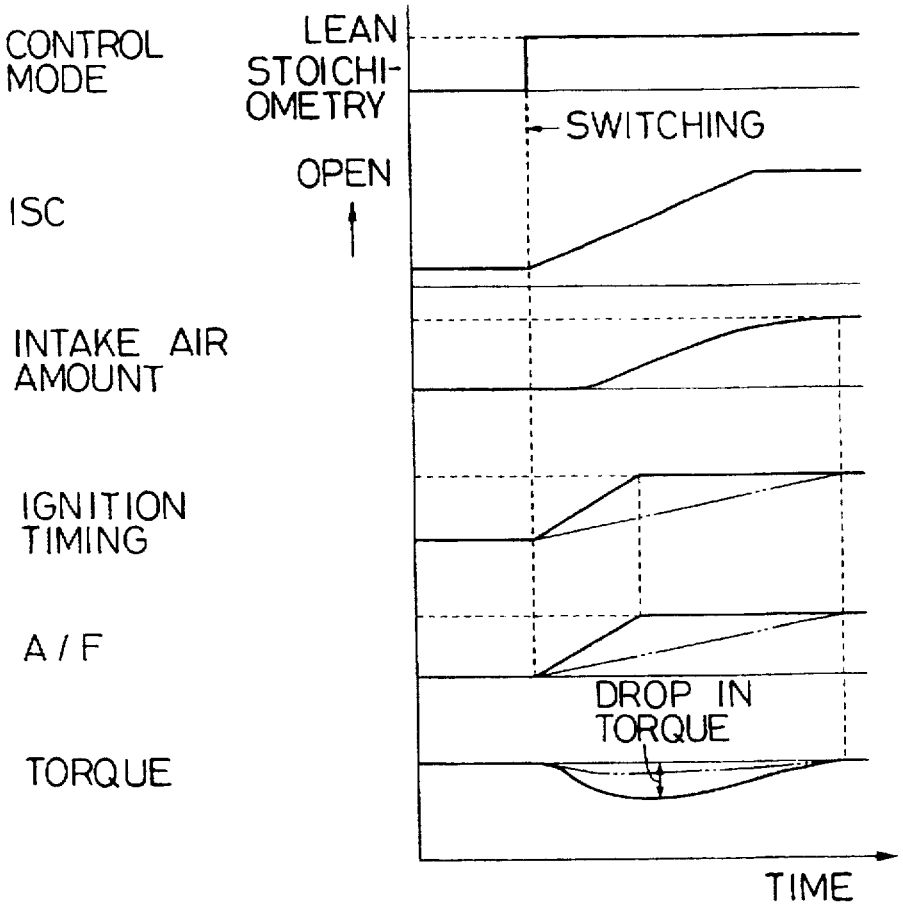
FIG. 3 is a graph, similar to the graph shown in FIG. 2, showing, by way of example, changes in intake air amount and others with elapse of time in a case where bypass air is supplied only by use of the ISC valve in the conventional device relating to FIG. 2.
Figure 4A:
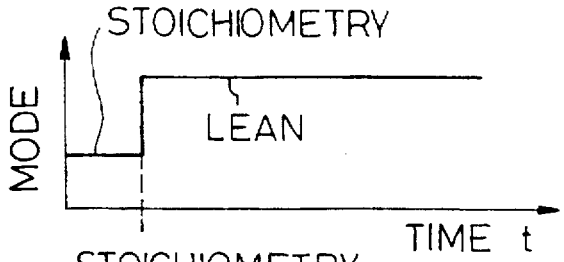
FIG. 4A showing a switching from the stoichiometric mode to the lean mode and FIG. 4B showing a change in target air-fuel ratio.
Figure 4B:
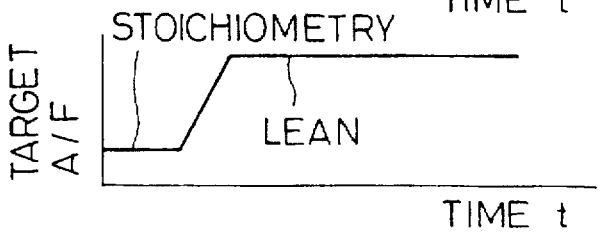
Figure 5:
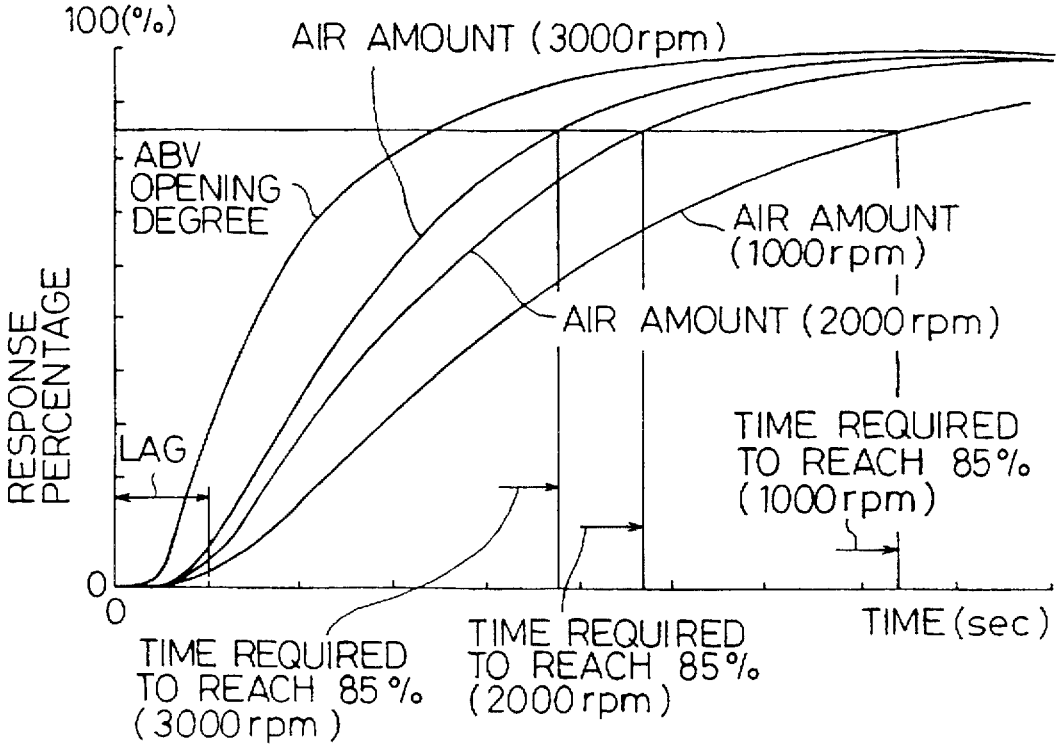
FIG. 5 is a graph for illustrating an air-fuel ratio control characteristic.
Figure 6A:
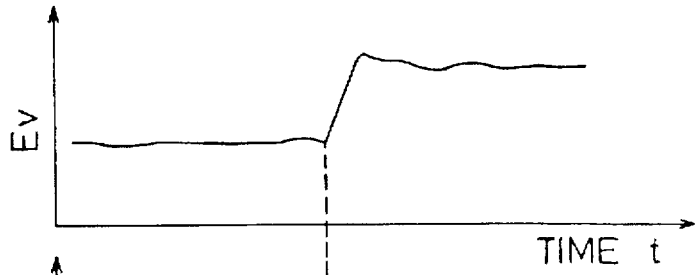
FIG. 6A showing a change in volumetric efficiency with elapse of time, FIG. 6B showing a change in lean coefficient used for calculation of fuel injection amount with elapse of time, and FIG. 6C showing a change in the load cell output with elapse of time.
Figure 6B:
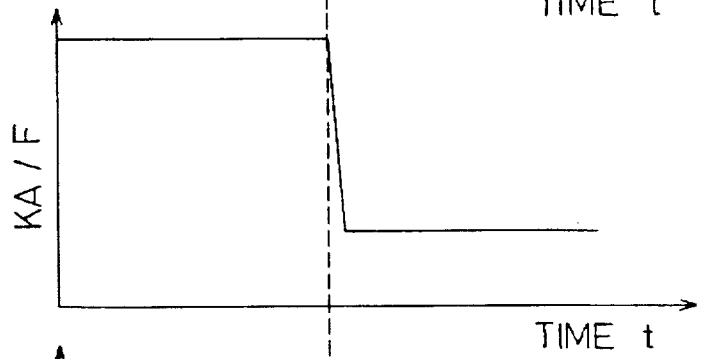
Figure 6C:
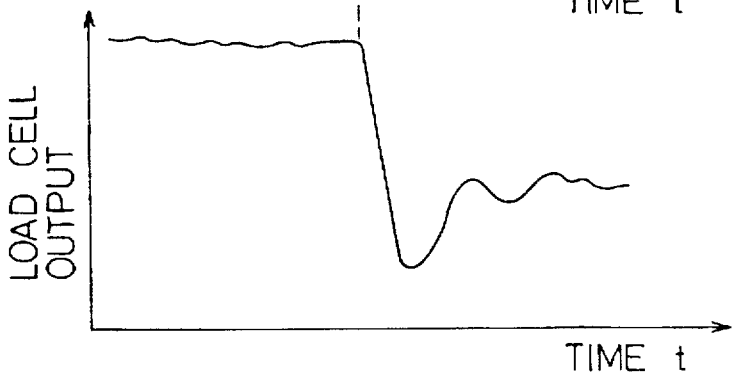

In this manner, the operation of making the air-fuel ratio lean is started at a time point of t2 at which the time T2 has elapsed from the time point of t1 at which the intake air amount starts to increase. In other words, the leaning of the air-fuel ratio is started in a condition where the intake air amount is increased to a relatively large extent. Further, as the leaning operation proceeds, the ignition timing is advanced. Therefore, unlike a case where the leaning operation is started upon start of the opening of the ISC valve as indicated by the solid line in FIG. 3, a large drop in the torque will not occur. That is, as shown in FIG. 24, a drop in the torque is small so that an occurrence of a shock can be prevented. Further, in comparison with a case indicated by broken lines in FIG. 3, a time period required for the air-fuel ratio switching and hence the engine driving time period in the air-fuel ratio region where an amount of nitrogen oxide is increased are shortened, thereby suppressing the discharge amount of nitrogen oxide.

Thereafter, the steps S339 to S344 are repeatedly effected. As shown in FIG. 24, the ignition timing is controlled to advance from a value on the lag side with respect to the first basic ignition timing θIG1 suitable for the stoichiometric driving towards the second basic ignition timing θIG2 suitable for the lean driving, and the air-fuel ratio A/F is controlled to be leaned from the first basic air-fuel ratio suitable for the stoichiometric driving towards the second basic air-fuel ratio suitable for the lean driving.

If it is determined in the step S339 that T3'=0, the process is returned from the switching control routine shown in FIGS. 20 to 23 to the control routine shown in FIG. 19. The control unit 10 sets the flag F1 at a value "1" indicating completion of the switching control (step S312 of FIG. 19). At the time of completion of the switching control (a time point of t3 in FIG. 24), an intake amount does not completely reach the target intake air amount A/NL for lean driving, so that the engine output torque will drop, as shown in FIG. 24. However, a relatively long time period has elapsed from the time point t0 at which the valve opening action of the ISC valve 30 was started, so that a relatively large amount of intake air has been supplied to the engine 1. Therefore, a drop in the torque is small, and no shock will occur.

After completion of the switching control, the control routine shown in FIG. 19 is effected again. Since the value of the flag F1 is set to "0" at the completion of the switching control, the result of determination in the step S301 of the control routine execution cycle immediately after the completion of the switching control becomes "NO". In the step S302, the F2 flag value "0" at the start of the switching control is stored as F2n−1, and it is determined in the step S305 that the engine is not driven in the stoichiometric-driving region, so that the flag value F2n is set to "0" in the step S308. Thus, the result of determination in the step S309 becomes "NO". Therefore, the lean-driving control (step S313) is effected immediately after completion of the switching control.

In the lean-driving control, the electronic control unit 10 controls the opening degree of the ISC valve 30 such that the intake air amount will reach the target intake air amount A/N at the time of lean driving, controls the valve opening time period of the fuel injection valve 3, i.e., the amount of fuel supplied to the engine 1, such that the air-fuel ratio will reach the target air-fuel ratio λL at the time of lean driving, and controls the ignition timing to the target ignition timing θIG at the time of lean driving.

The control method of the lean-burn engine according to a fifth embodiment of this invention is explained below.

Figure 18:
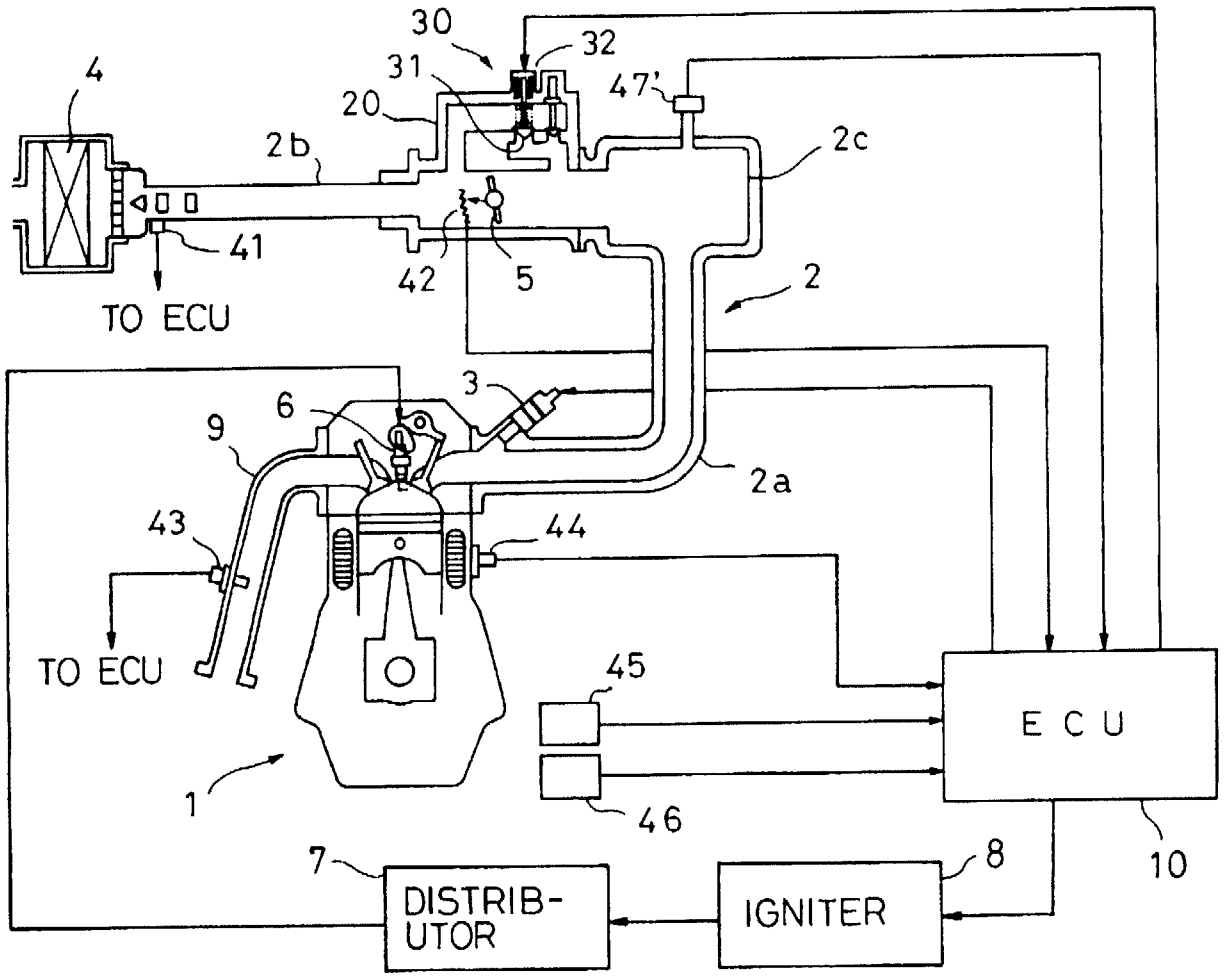
FIG. 18 is a fragmentary schematic view showing a control device for embodying a control method according to a fourth embodiment of this invention together with peripheral elements.

The control method of this embodiment can be embodied by use of a control device obtained by adding a boost sensor 47' (FIG. 18) to the control device shown in FIG. 18, and therefore, the explanation for the device construction is omitted.

The method of this embodiment is basically the same as that of the fourth embodiment, and carries out the control procedure shown in FIG. 19, whereas the switching control (part of which is shown in detail in FIGS. 25 to 27) executed in the step S311 of FIG. 19 is partly different from that shown in FIGS. 20 to 23.

Figure 20:
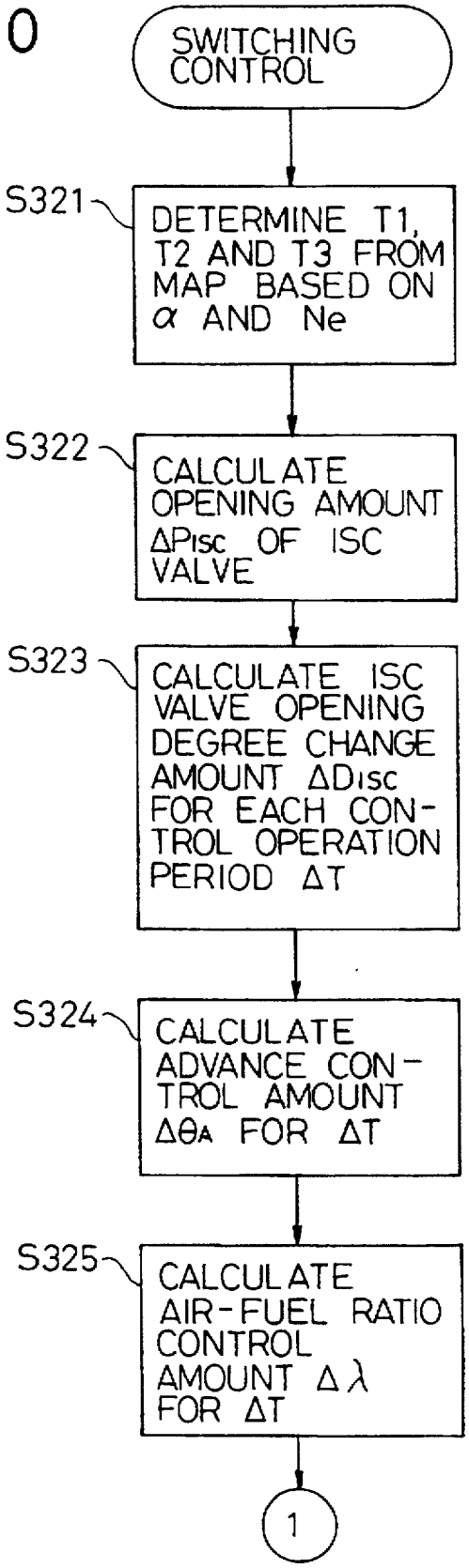
FIG. 20 is a flowchart showing part of the control procedure in a switching control in the engine driving control routine shown in FIG. 19.
Figure 21:
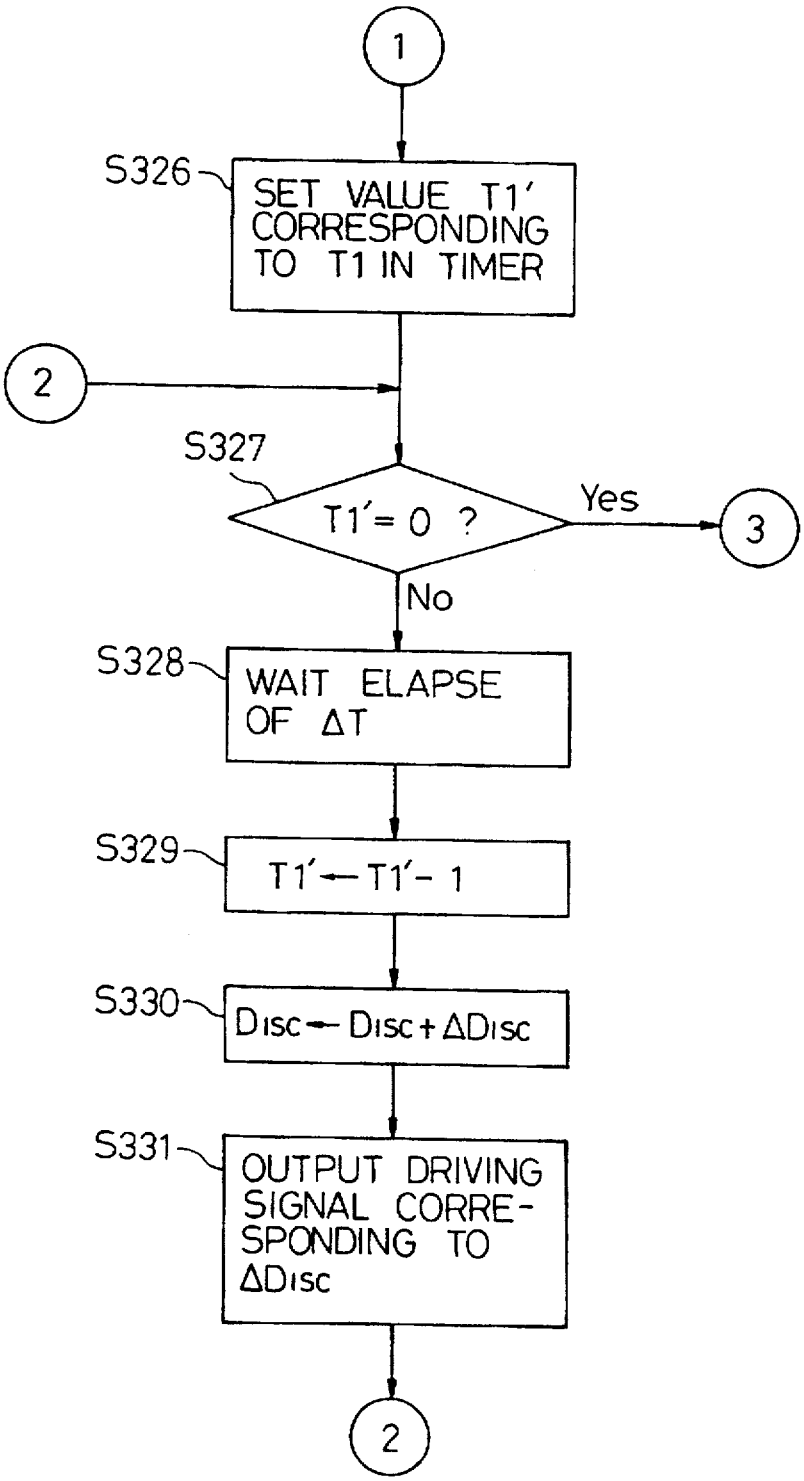
FIG. 21 is a flowchart showing the control procedure in the switching control following the control procedure shown in FIG. 20.
Figure 22:
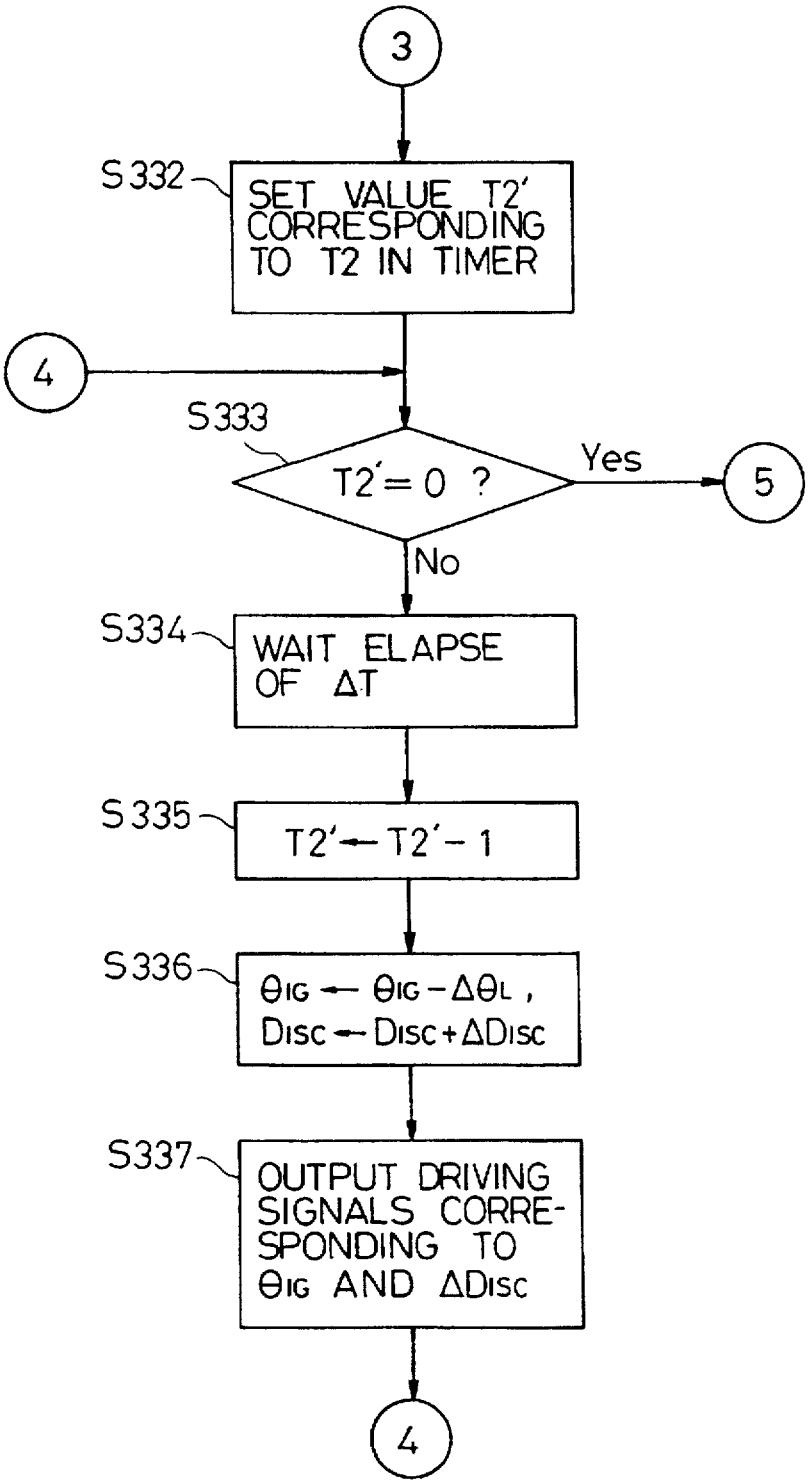
FIG. 22 is a flowchart showing the control procedure in the switching control following the control procedure shown in FIG. 21.
Figure 23:
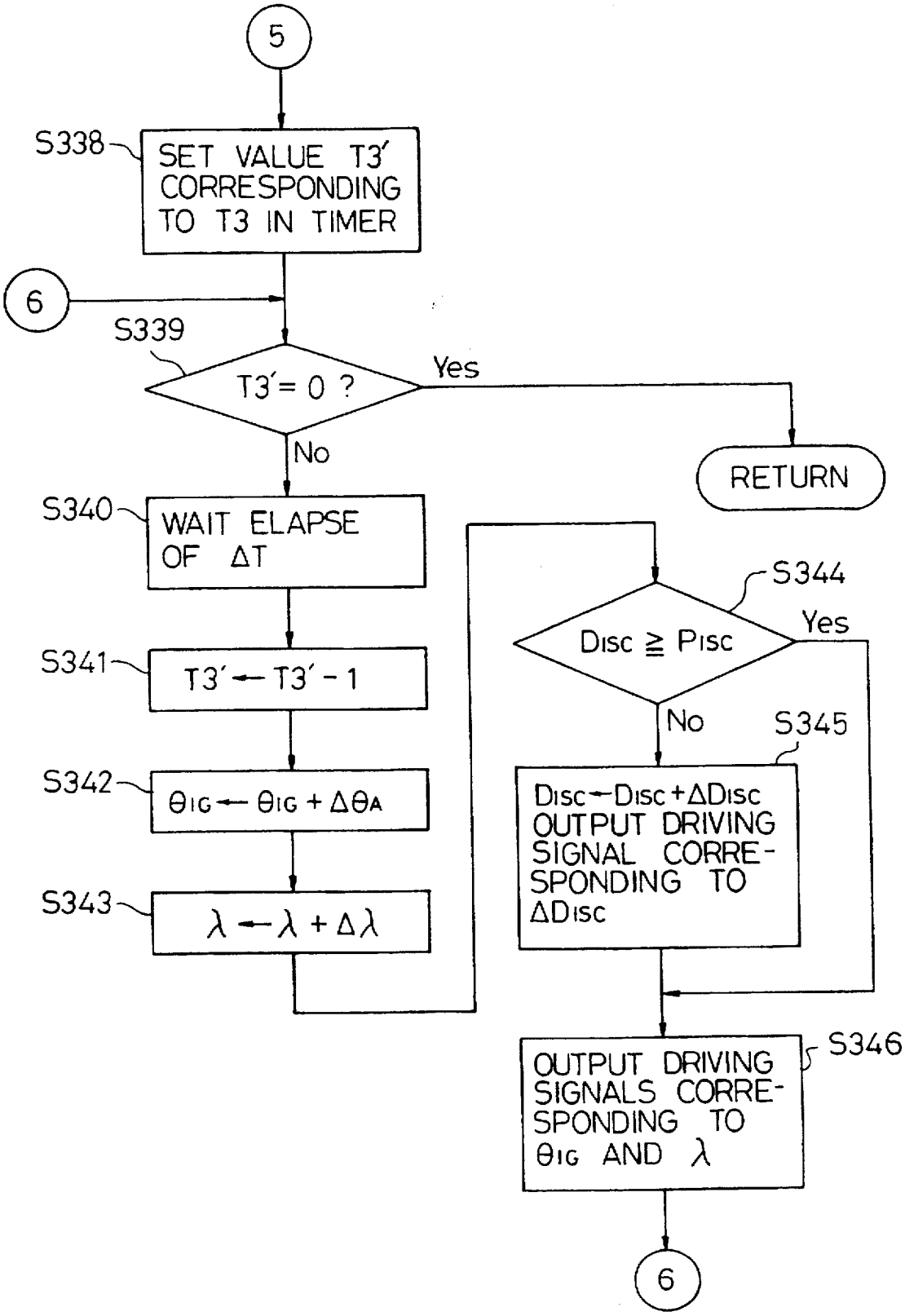
FIG. 23 is a flowchart showing the control procedure in the switching control following the control procedure shown in FIG. 22.
Figure 25:
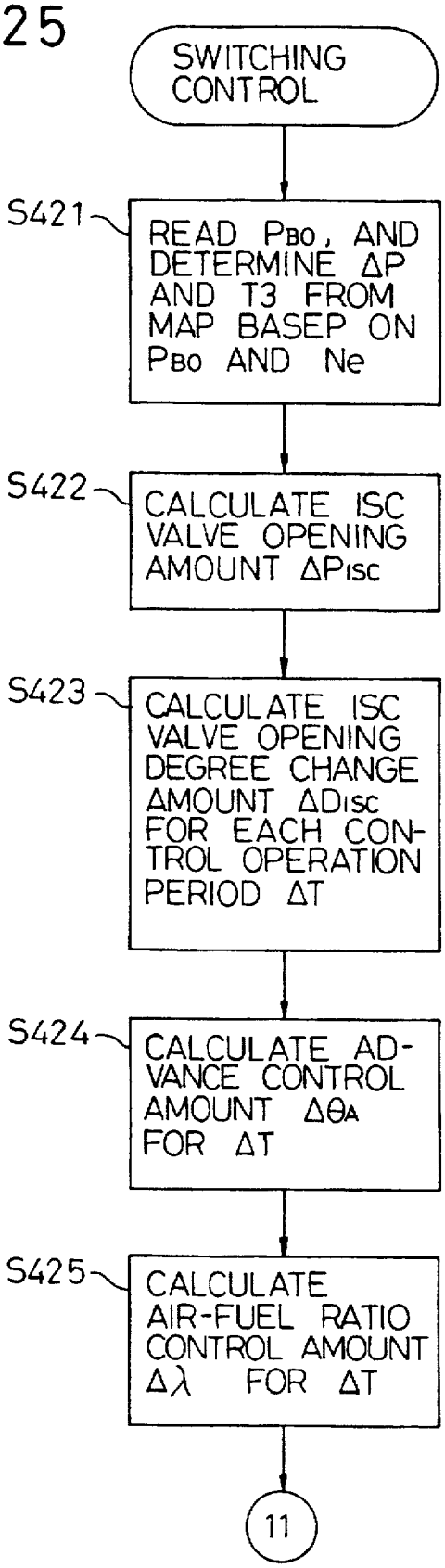
FIG. 25 is a flowchart showing part of the control procedure in the switching control in a control method according to a fifth embodiment of this invention.
Figure 26:
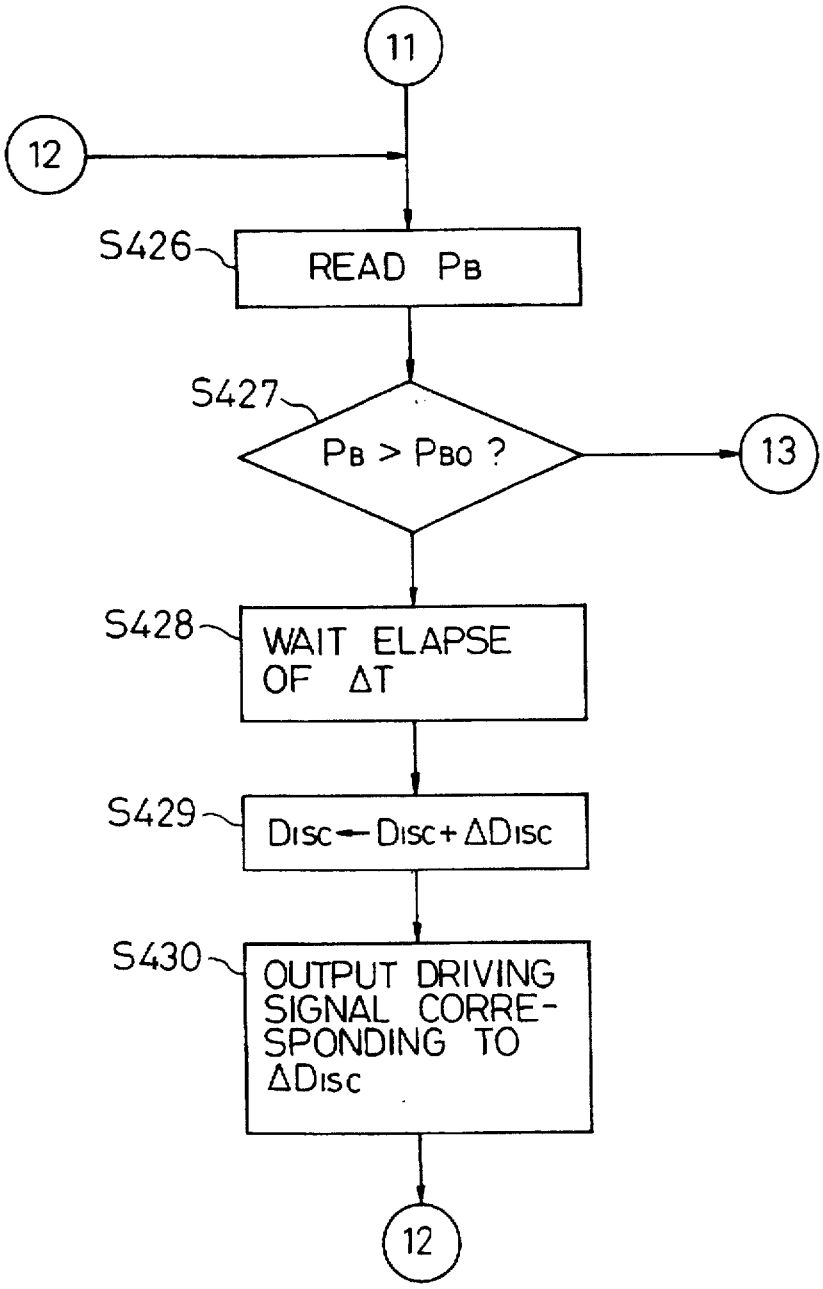
FIG. 26 is a flowchart showing the control procedure in the switching control following the control procedure shown in FIG. 25.
Figure 27:
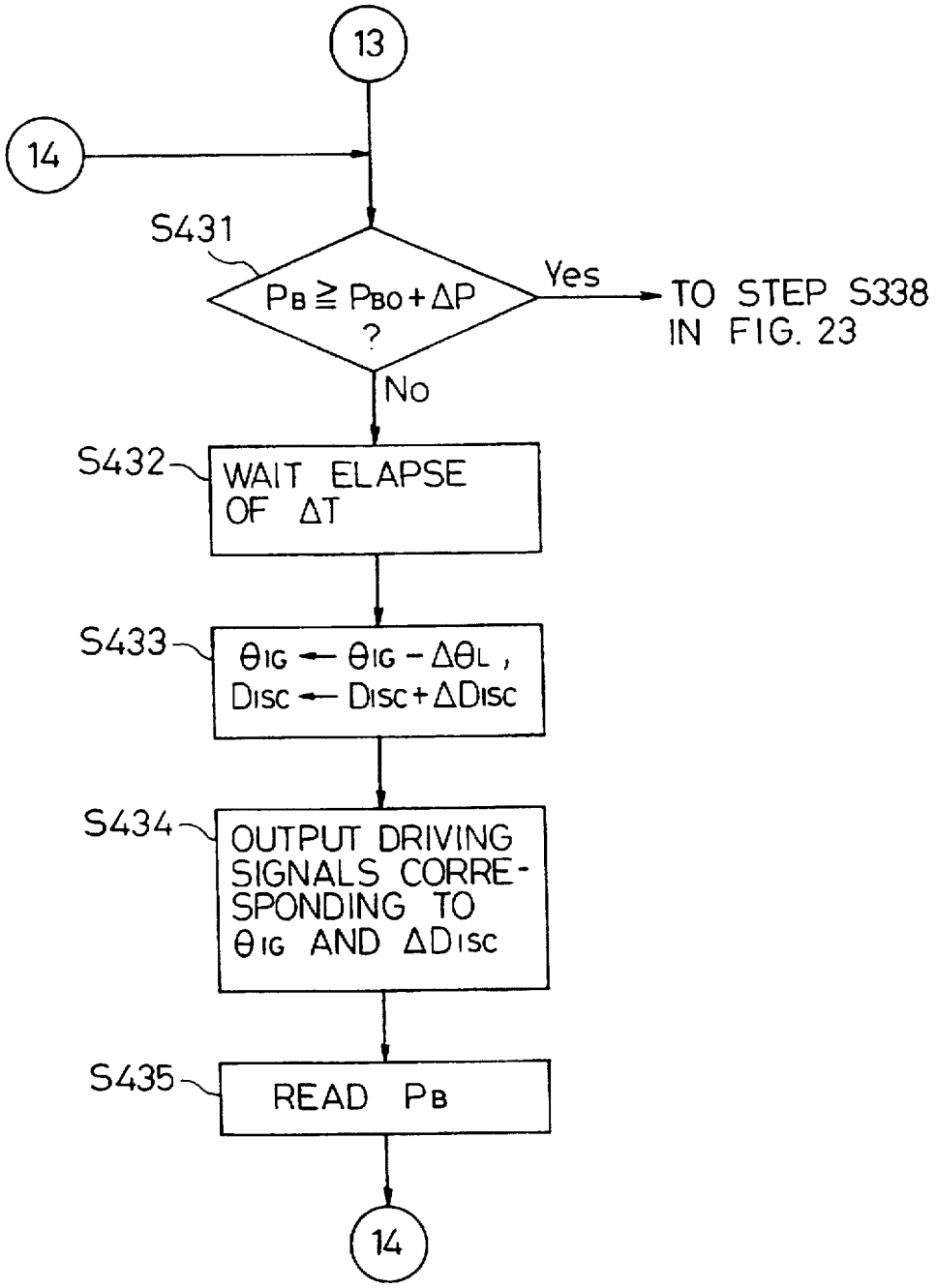
FIG. 27 is a flowchart showing the control procedure in the switching control following the control procedure shown in FIG. 26.

Referring to FIGS. 25 to 27, in the step S421 of the switching control corresponding to the step S321 of FIG. 20, the electronic control unit 10 reads and stores an output from the boost sensor 47' representative of the negative pressure PB0 in the intake pipe at the moment when the switching control starts. Next, based on this pressure data PB0, and the engine rotation speed Ne calculated in the step S304 of FIG. 19, the control unit 10 derives a set value ΔLP of an amount of negative pressure rise in the intake pipe in a period from the time point t0 at which the switching control starts to the time point t2 at which the air-fuel-ratio leaning control starts, from a PB0 Ne-ΔLP map, not shown, and derives an advance control time T3 from a PB0·Ne–ΔLP map, not shown.

Next, the steps S422 to S425 respectively corresponding to the steps S322 to S325 of FIG. 20 are sequentially executed, to thereby derive an ISC valve opening amount ΔLPISC in a period from the start time point t0 to the completion time point t3 of the switching control, along with an ISC valve opening change amount ΔLDISC for one control operation period ΔLT, an advance control amount ΔLθLA, and an air-fuel ratio control amount ΔLλL.

Next, the electronic control unit 10 reads a boost sensor output PB (step S426), and determines whether or not this pressure data PB exceeds the pressure data PB0 stored in the step S421 (step S427). Since the result of this determination becomes "NO" immediately after the start of the switching control, the control unit 10 sequentially carries out the steps S428 to S430 respectively corresponding to the steps S328, S330 and S331, to thereby start the valve opening operation of the ISC valve 30 in the switching control.

After this, the steps S426 to 430 are repeatedly effected, so that the ISC valve opening degree gradually increases with elapse of time. The intake air amount and the negative pressure PB in the intake pipe start to increase at or near the time point of t1 shown in FIG. 24, so that the result of determination in the step S427 becomes "YES". In this case, the control unit 10 determines whether or not the pressure data PB read in the step S426 has reached the sum of the pressure data PB0 at the switching control starting timing t0 and the pressure rise amount ΔP derived in the step S421 (step S431).

At or near the time point t1 at which the intake air amount starts to increase, a rise in the pressure in the intake pipe caused by the increased intake air amount is not so large, and therefore, the result of determination in the step S431 becomes "NO". Thus, the control unit 10 sequentially carries out the steps S432 to S434, respectively corresponding to the steps S334, S336 and S337 of FIG. 22, so as to start the ignition timing delaying control in the switching control while increasing the ISC valve opening degree. Next, the control unit 10 reads the boost sensor output PB (step S435). These steps S431 to S435 are repeatedly executed.

If it is determined in the step S431 that the pressure data PB has reached the sum of the pressure data PB0 and the pressure rise amount ΔP, and hence if it is determined that the air-fuel-ratio leaning must be started, the control unit 10 sequentially executes the steps S338 to S346, to thereby carry out the air-fuel-ratio leaning control, while effecting the ISC valve opening degree control and the ignition timing advancing control.

A control device according to a sixth embodiment of this invention is explained below.

Figure 29:
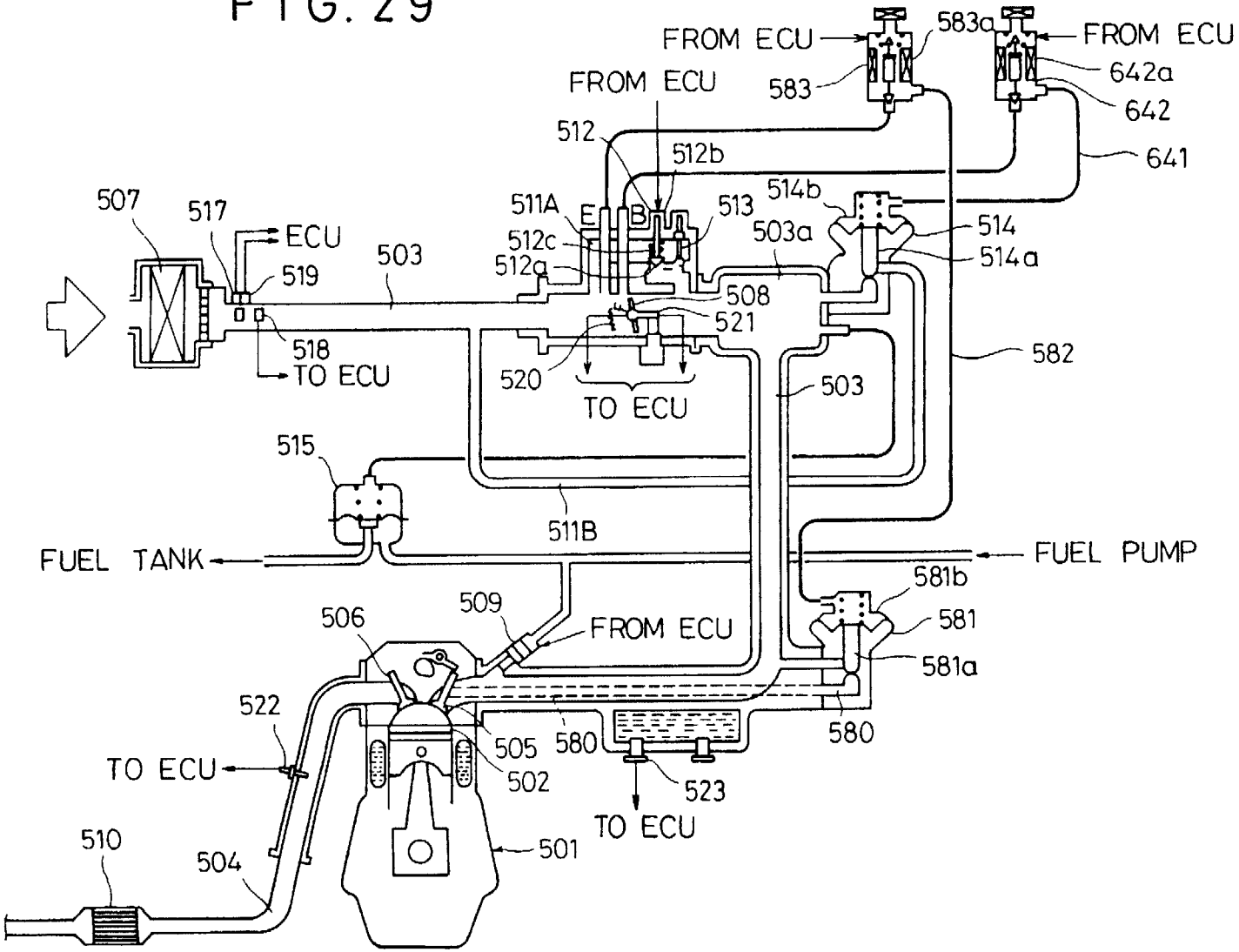
FIG. 29 is a view showing the whole construction of an engine system having the control device shown in FIG. 28 mounted thereon.

Referring to FIG. 29, a vehicular engine system on which the control device is mounted includes an engine 501 constructed as a lean-burn engine which is adapted to effect the lean-burn driving with an air-fuel ratio set on the fuel-lean side with respect to the theoretical air-fuel ratio, in a predetermined driving condition. The engine 501 has an intake passage 503 and an exhaust passage 504 respectively communicating with combustion chambers 502 of the engine. The intake passage 503 and a respective combustion chamber 502 are communicated with or separated from each other by an associated intake valve 505, and the exhaust passage 504 and a respective combustion chamber 502 are communicated with or separated from each other by an associated exhaust valve 506.

In the intake passage 503, an air cleaner 507, a throttle valve 508, and electromagnetic fuel injection valves (injectors) 509 are disposed in this order from the upstream side of the intake passage. The throttle valve 508 is connected to an accelerator pedal, not shown, via a wire cable (not shown), so that the throttle valve opening degree is adjusted according to the step-on degree of the accelerator pedal. The injectors 509 are each provided in an associated one of cylinders of the engine 501. Further, a surge tank **503*a* is provided in the intake passage 503. The exhaust passage 504 is provided with a three-way catalyst 510** for adequately purifying carbon monoxide, hydrocarbon and nitrogen oxide in the stoichiometric driving state, and a muffler (not shown) in this order from the upstream side of the exhaust passage.

Further, in the intake passage 503, a first bypass passage 511A is disposed to bypass the throttle valve 508. In the first bypass passage 511A, a stepper motor valve (hereinafter referred to as an STM valve) 512 functioning as an ISC valve is provided, and a wax-type fast idle air valve 513 whose opening degree is adjusted according to the engine water temperature is attached to the STM valve 512.

The STM valve 512 has a valve body **512*a* disposed for abutment against a valve seat portion formed in the first bypass passage 511A, a stepper motor (ISC actuator) 512*b* for adjusting the valve body position, and a spring 512*c* biasing the valve body 512*a* in a direction to press the same on the valve seat portion (in a direction to close the first bypass passage 511A). The valve body position relative to the valve seat portion can be adjusted in a multi-stage fashion by the stepper motor 512*b*. By the adjustment of the valve body position, the opening between the valve seat portion and the valve body 412*a*, that is, the opening degree of the STM valve 512 is adjusted. Instead of the stepper motor 512*b***, a DC motor may be used .

The control of the drive of the stepper motor **512*b* is attained by an electronic control unit (ECU) 525, and the supply of intake air to the engine 501 via the first bypass passage 51A is effected by the stepper motor driving. Therefore, the intake air supply via the bypass passage 511A can be attained irrespective of the operation of the accelerator pedal by the driver. In addition, by changing the opening degree of the STM valve 512, the intake air supply amount (throttle bypass intake air amount) via the bypass 511A** can be variably adjusted.

Further, the intake passage 503 is provided with a second bypass passage 511B to bypass the throttle valve 508, and an air bypass valve 514 is provided in the passage 511B. The bypass valve 514 has a valve body **514*a* disposed for abutment against a valve seat portion formed in the second bypass passage 511B, and a diaphragm-type actuator 514*b* for adjusting the valve body position. The actuator 514*b* has a diaphragm chamber thereof provided with a pilot passage 641 communicating with the intake passage on the downstream side of the throttle valve, and an electromagnetic valve 642 for air bypass valve control is provided in the passage 641**.

As in the case of the stepper motor 512*b*, the control of drive of the electromagnetic valve 642 is performed by the ECU 525. Therefore, the intake air supply to the engine 501 via the second bypass passage 511B can be attained irrespective of the operation of the accelerator pedal by the driver, and the intake air supply amount via the bypass 511B can be variably adjusted by changing the opening degree of the electromagnetic valve 642. Basically, the electromagnetic valve 642 is set in an open state at the time of lean-burn driving, and is set in a closed state during driving other than the lean-burn driving.

An exhaust-gas-recirculation passage (EGR passage) 580 for returning the exhaust gas to the intake system is interposed between the exhaust passage 504 and the intake passage 503, and an EGR valve 581 is disposed in the passage 580. The EGR valve 581 has a valve body 581*a* disposed for abutment against a valve seat portion formed in the EGR passage 580, and a diaphragm-type actuator 581*b* for adjusting the valve body position. The actuator 581*b* has a diaphragm chamber thereof provided with a pilot passage 582 communicating with the intake passage on the downstream side of the throttle valve, and an electromagnetic valve 583 for EGR valve control is disposed in the passage 582.

As in the case of the stepper motor 512*b*, the control of the drive of the electromagnetic valve 583 is effected by the ECU 525, and the exhaust gas can be returned to the intake system via the EGR passage 580 by the driving control of the electromagnetic valve 583.

In FIG. 29, reference numeral 515 denotes a fuel pressure adjuster operated in response to negative pressure in the intake passage 503. The fuel pressure adjuster 515 adjusts the pressure of fuel injected from the injectors 509 by adjusting an amount of fuel returned from a fuel pump (not shown) to a fuel tank (not shown).

For control of the engine system, various sensors are provided. First, as shown in FIG. 29, in that portion of the intake passage 503 into which intake air passing through the air cleaner 507 flows, an air flow sensor (intake air amount sensor) 517 for detecting an intake air amount from Karman vortex information, an intake temperature sensor 518, and an atmospheric pressure sensor 519 are disposed. Further, in that portion of the intake passage 503 in which the throttle valve 508 is disposed, a potentiometer-type position sensor 520 for detecting the opening degree of the throttle valve 508, and an idle switch 521 are disposed. Further, on the exhaust passage 504 side, a linear oxygen concentration sensor (hereinafter referred to as a linear $O_2$ sensor) 522 for linearly detecting the oxygen concentration in the exhaust gas on the air-fuel ratio lean side, a water temperature sensor 523 for detecting the temperature of cooling water for the engine 501, a crank angle sensor 524 for detecting the crank angle shown in FIG. 30, a vehicle speed sensor 530, and the like are disposed. The crank angle sensor 524 also has a function as a rotation speed sensor for detecting the engine rotation speed Ne. Further, detection signals from these sensors and switches are input to the ECU 525.

Figure 30:
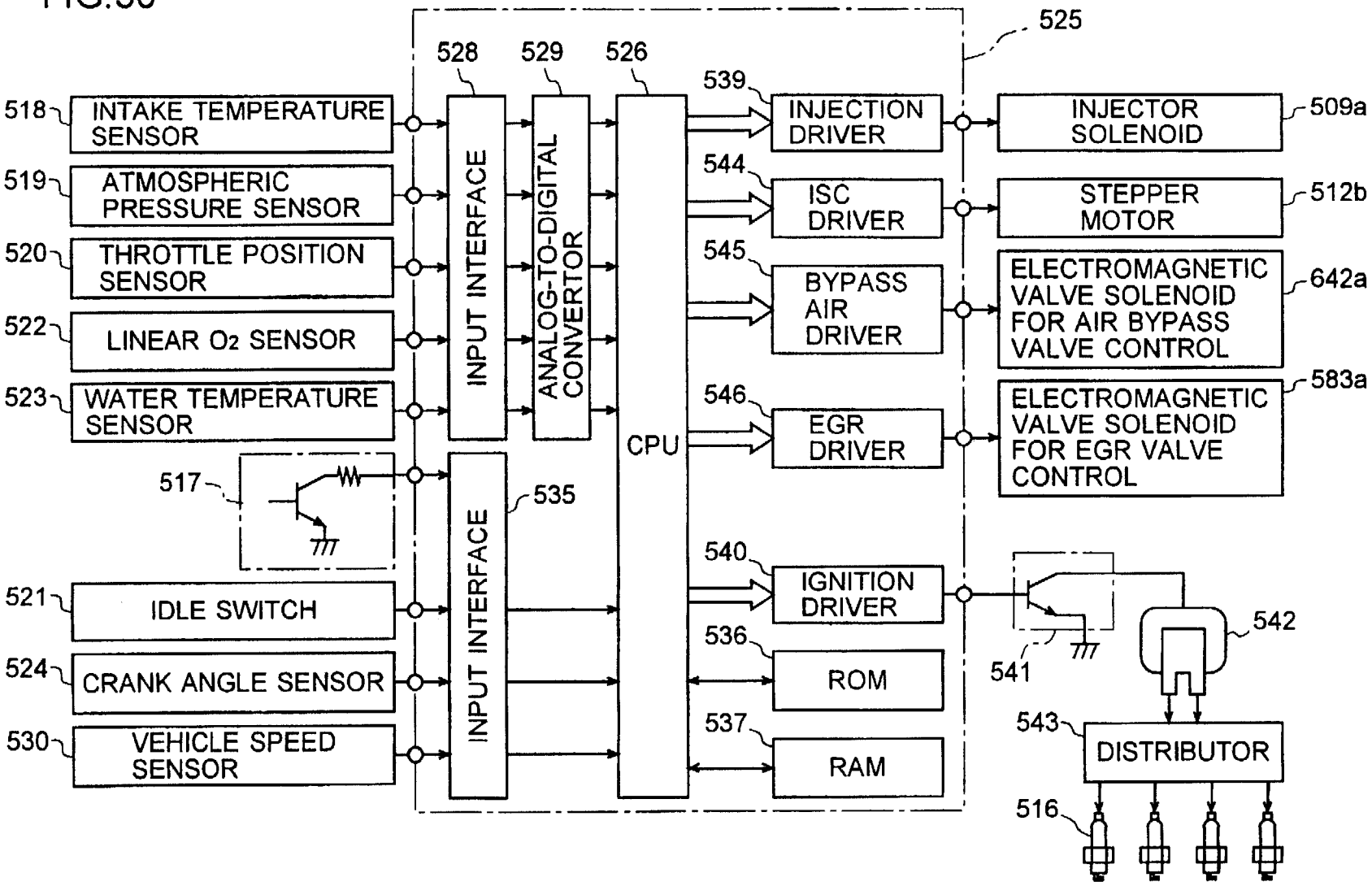
FIG. 30 is a block diagram showing a control system of the engine system shown in FIG. 29.

As shown in FIG. 30, the ECU 525 has its main part constructed as a computer having a CPU (arithmetic operation device) 526. The CPU 526 is supplied with detection signals from the intake temperature sensor 518, atmospheric pressure sensor 519, throttle position sensor 520, linear $O_2$ sensor 522, water temperature sensor 523 and the like via an input interface 528 and analog/digital converter 529, and is directly supplied with detection signals from the air-flow sensor 517, idle switch 521, crank angle sensor 524, vehicle speed sensor 535 and the like via an input interface 535.

Further, the CPU 526 transfers data between itself and a ROM 536 for storing program data, fixed value data and various data, and between itself and a RAM 537 for rewritably storing various data.

In accordance with results of various calculations by the CPU 526, the ECU 525 outputs various control signals for controlling the driving state of the engine 501, such as, for example, fuel injection control signal, ignition timing control signal, ISC control signal, bypass control signal, and EGR control signal.

The fuel injection control (air-fuel ratio control) signal from the CPU 526 is output to an injector solenoid 509*a* (more specifically, a transistor for the injector solenoid 509*a*) for driving the associated injector 509 via an injection driver 539. Further, the ignition timing control signal is output from the CPU 526 to a power transistor 541 via an ignition driver 540. An output of the transistor 541 is supplied to ignition plugs 516 via an ignition coil 542 and distributor 543 and the ignition plugs 516 are sequentially spark.

Further, the ISC control signal is output from the CPU 526 to a stepper motor 512*b* via an ISC driver 544. The bypass air control signal from the CPU 526 is output to a solenoid 642*a* of an electromagnetic valve 5142 for air bypass valve control via a bypass air driver 545. The EGR control signal from the CPU 526 is output to a solenoid 583*a* of an electromagnetic valve 583 for EGR valve control via an EGR driver 546.

Figure 28:
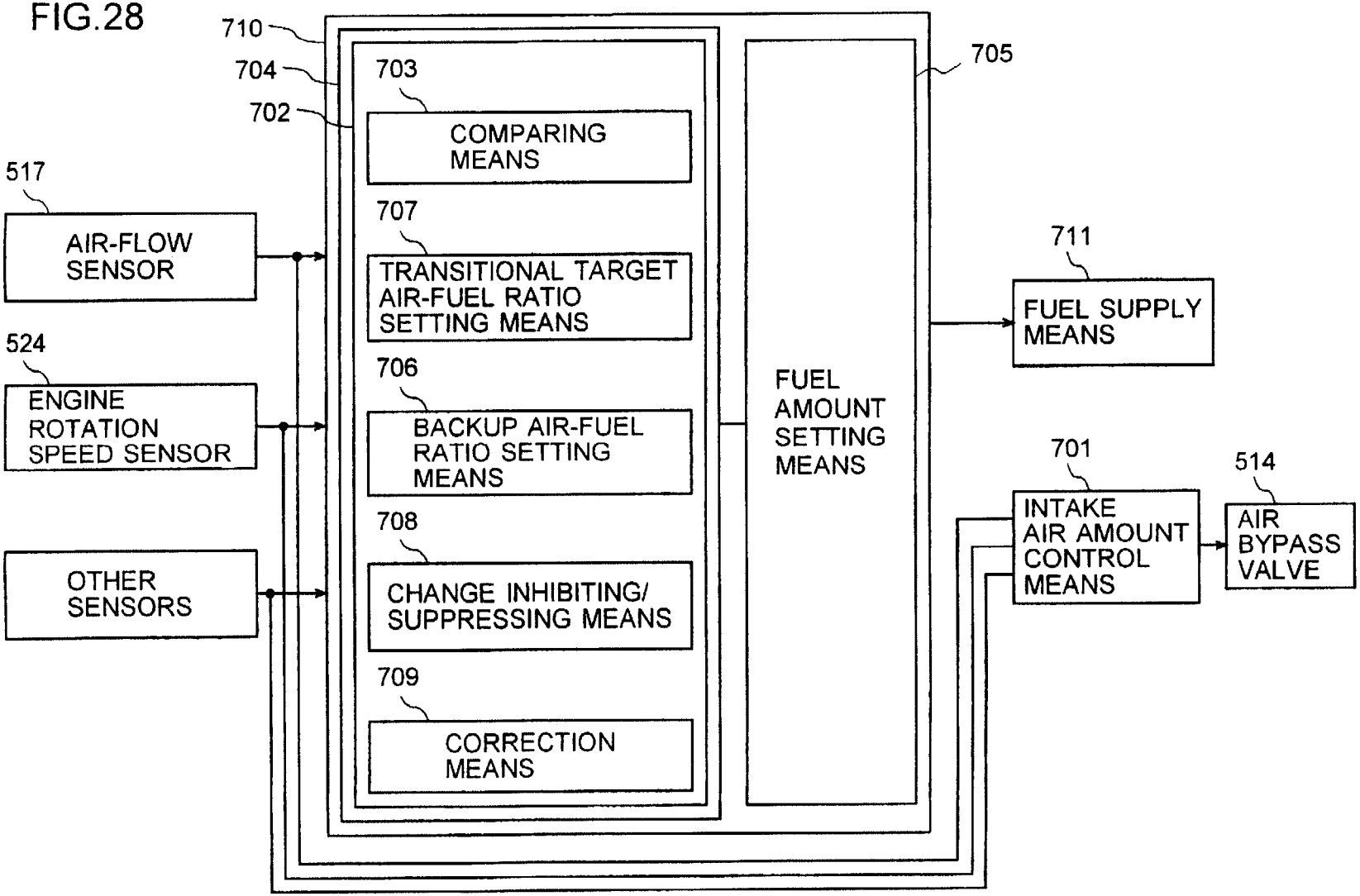
FIG. 28 is a functional block diagram of an air-fuel ratio control device according to a sixth embodiment of this invention.

In relation to the air-fuel ratio control, the ECU 525 functionally has intake air amount control means 701, air-fuel ratio control means 710, and fuel supply means 711, as shown in FIG. 28. The intake air amount control means 701 sets the air bypass valve 514 to a closed state at the time of switching to the lean-burn driving, to thereby increase the intake air amount supplied to the combustion chamber 502 of the engine. In order to control the air-fuel ratio according to the driving state of the engine 501, the air-fuel ratio control means 710 includes target air-fuel ratio setting means 704 for setting a target air-fuel ratio according to the engine driving state, and fuel amount setting means 705 for setting a fuel amount to realize the thus set target air-fuel ratio. Further, the fuel supply means 711 supplies fuel to the engine 501 according to the thus set fuel amount. The fuel supply means 711 corresponds to the injector 509.

The target air-fuel ratio setting means 704 has a function of follow-up changing means 702 for continuously changing the air-fuel ratio to follow a change in the actual intake air amount at the time of switching (hereinafter referred to as "S→L switching") from the engine driving with the air-fuel ratio on the fuel-rich side (including the driving with the theoretical air-fuel ratio) to the driving with the air-fuel ratio on the fuel-lean side. The follow-up changing means 702 functionally has comparing means 703, transitional target air-fuel ratio setting means 707, backup air-fuel ratio setting means 706, change inhibiting/suppressing means 708, and correction means 709.

The comparing means 703 compares the intake air amount just prior to the start of the S→L switching with the intake air amount during the transitional switching driving. The backup air-fuel ratio setting means 706 sets the backup air-fuel ratio which gradually changes from the air-fuel ratio just prior to the start of the S→L switching to the final target air-fuel ratio after the switching. The fuel amount setting means 705 may be a means for setting the fuel amount according to a larger one of the transitional target air-fuel ratio set by the setting means 707 and the backup air-fuel ratio. Further, the change inhibiting/suppressing means 708 inhibits or suppresses a change in the transitional target air-fuel ratio set immediately after the S→L switching.

The transitional target air-fuel ratio setting means 707 sets the transitional target air-fuel ratio (target air-fuel ratio in the transitional switching driving) based on the result of comparison in the comparing means 703. Instead of this, the setting means 707 may be a means for setting the transitional target air-fuel ratio over a predetermined period based on the result of comparison in the comparing means 703, and for setting the transitional target air-fuel ratio after the elapse of predetermined time period which ratio gradually varies from the transitional target air-fuel ratio at the moment when the predetermined time period elapses to the final target air-fuel ratio. Alternatively, the setting means 707 may be a means for setting the transitional target air-fuel ratio which gradually varies from the transitional target air-fuel ratio just prior to the start of the S→L switching to the final target air-fuel ratio. In this case, the changing speed of the transitional target air-fuel ratio thus set is set to be higher as the engine rotation speed is higher. Instead of this, it is also possible to set the changing speed of the transitional target air-fuel ratio to change from that corresponding to the high-rotation-speed-driving state of the engine to that corresponding to the low-rotation-speed-driving state.

The correction means 709 corrects the intake air amount during the transitional switching driving which is to be compared by the comparing means 703 according to a change in the throttle valve caused by an artificial operation, and sets a correction amount based on intake air amount change information of the engine 501. Further, the correction means 709 derives the intake air amount having no relation to the S→L switching from a map, with the throttle opening degree and engine rotation speed used as parameters, in order to correct the set transitional target air-fuel ratio according to a change in the throttle opening degree caused by the artificial operation.

In order to attain the air-fuel ratio determined as described above, the engine system adjusts the fuel injection pulse width Tinj according to the control signal from the fuel amount setting means 705 based on the following equation (1).

$$Tinj(j)=TB\cdot K\cdot KAFL+Td$$

or $$Tinj(j)=TB\cdot K+Td \quad (1)$$

where TB indicates a basic driving time of the injector 509. The basic driving time TB is determined based on the intake air amount A/N for each revolution of the engine which amount is derived from the intake air amount A information from the air flow sensor 517 and the engine rotation speed N information from the crank angle sensor (engine rotation speed sensor) 524. Further, KAFL indicates a leaning correction coefficient. K is a correction coefficient K which is set according to the engine cooling water temperature, intake temperature, atmospheric pressure and the like, and Td indicates a dead time which is set according to the battery voltage.

The engine system effects the lean-burn driving when lean driving condition determining means determines that a predetermined condition is satisfied.

Further, the engine system determines the target air-fuel ratio according to one of first to sixth control modes described below.

First Control Mode

In the first control mode, the comparing means 703, transitional target air-fuel ratio setting means 707, and backup air-fuel ratio setting means 706, among the various elements of the follow-up changing means 702 shown in FIG. 28, are used, and the setting of the fuel amount in the fuel amount setting means 705 is made according to a larger one of the transitional target air-fuel ratio and the backup air-fuel ratio.

Figure 31:
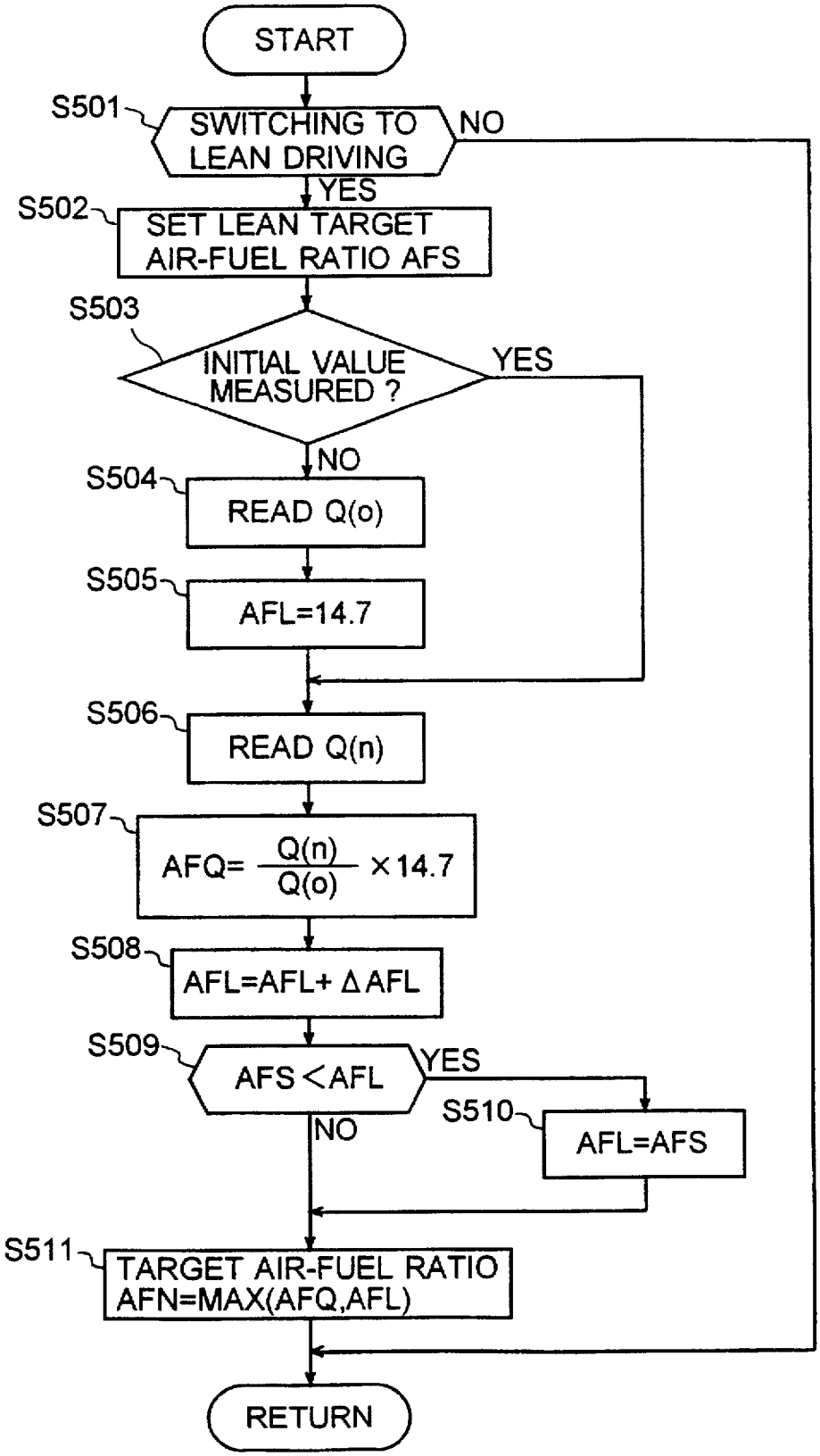
FIG. 31 is a flowchart showing the control procedure executed in the first control mode by the control device shown in FIG. 28.

Further, in the control mode, the flow (target air-fuel ratio AFN setting routine) shown in FIG. 31 is repeatedly executed at intervals of a predetermined cycle.

In the setting routine, at first, a determination is made as to whether or not the state of switching to the lean-burn driving is reached (step S501). If it is determined in the step S501 that the state of switching to the lean-burn driving is not reached, execution of the routine in the present control cycle is completed, and the flow shown in FIG. 31 is started from the step S501 in the next control cycle again.

On the other hand, if it is determined in the step S501 that the state of switching to the lean-burn driving is reached, the lean target air-fuel ratio AFS which is an air-fuel ratio to be finally attained in the lean-burn driving state is set in a conventional manner (step S502). In the next step S503, a determination is made as to whether an initial actual intake air amount Q(0) of the engine 501 has been already measured or not.

If it is determined in the step S503 that the measurement of actual intake air amount is not completed, the flow proceeds to the step S504. In the step S504, a detection signal of the air-flow sensor 517 is read, and this signal is set as an initial actual intake air amount Q(0) supplied to the engine 501 immediately after the switching to the lean-burn driving. In the next step S505, the backup air-fuel ratio AFL is set to its initial value (theoretical air-fuel ratio 14.7).

On the other hand, if it is determined in the step S503 that the measurement of actual intake air amount Q(0) is completed, and hence the switching to the lean-burn driving is being effected (transitional state), the flow proceeds to the step S506. In the step S506, a detection signal of the air-flow sensor 517 is read, and this signal is set as an actual intake air amount Q(n) in the transitional state at the time of reading of the sensor output. The actual intake air amount Q(n) generally varies from time to time. In the next step S507, a target air-fuel ratio AFQ (corresponding to the characteristic curve AFQ shown in FIG. 32) determined by taking the actual intake air amount Q(n) into consideration is set according to the following equation (2).

$$AFQ=(Q(n)/Q(0))\times 14.7 \quad (2)$$

More specifically, in the follow-up changing means 702, the intake air amount Q(0) just prior to the switching of the driving states and the intake air amount Q(n) during the transitional switching driving are compared by the comparing means 703, and a target air-fuel ratio AFQ is set by the target air amount setting means 704 according to the result of comparison (Q(n)/Q(0)).

In the next step S508, the backup air-fuel ratio AFL is set according to the following equation (3-1).

$$AFL=AFL+\Delta AFL \quad (3\text{-}1)$$

where ΔAFL is an increment for increasing the backup air-fuel ratio AFL (corresponding to the characteristic curve AFL shown in FIG. 32) from the theoretical air-fuel ratio 14.7 to the air-fuel ratio in the lean-burn driving. A predetermined fixed value is used for the increment.

More specifically, in the follow-up changing means 702, the backup air-fuel ratio AFL which gradually varies from the initial backup air-fuel ratio AFL (=14.7) just prior to the start of switching of the driving states to the final target air-fuel ratio AFS at the time of completion of the switching is set by the backup air-fuel ratio setting means 706.

In the next step S509, a determination is made as to whether the backup air-fuel ratio AFL is larger than the final target air-fuel ratio AFS or not. If the result of determination in the step S509 is "YES", the flow proceeds to the step S511 after the backup air-fuel ratio AFL is set to the final target air-fuel ratio AFS in the step S510. If the result of determination in the step S509 is "NO", the flow proceeds from the step S509 to the step S511. That is, in the steps S509 and S510, the upper limit of the backup air-fuel ratio AFL is checked.

In the next step S511, in order to set a transitional target air-fuel ratio AFN to be actually used, the target air-fuel ratio AFQ derived in the step S507 and the backup air-fuel ratio AFL derived in the step S508 are compared, and a larger one of the air-fuel ratios is set as the transitional target air-fuel ratio AFN.

As a result, in the fuel amount setting means 705, the fuel amount is set according to a larger one of the target air-fuel ratio AFQ corresponding to the actual intake air amount Q(n) and the backup air-fuel ratio AFL set to increase from the initial air-fuel ratio to the final target air-fuel ratio AFS in the lean-burn driving with elapse of time.

Figure 32:
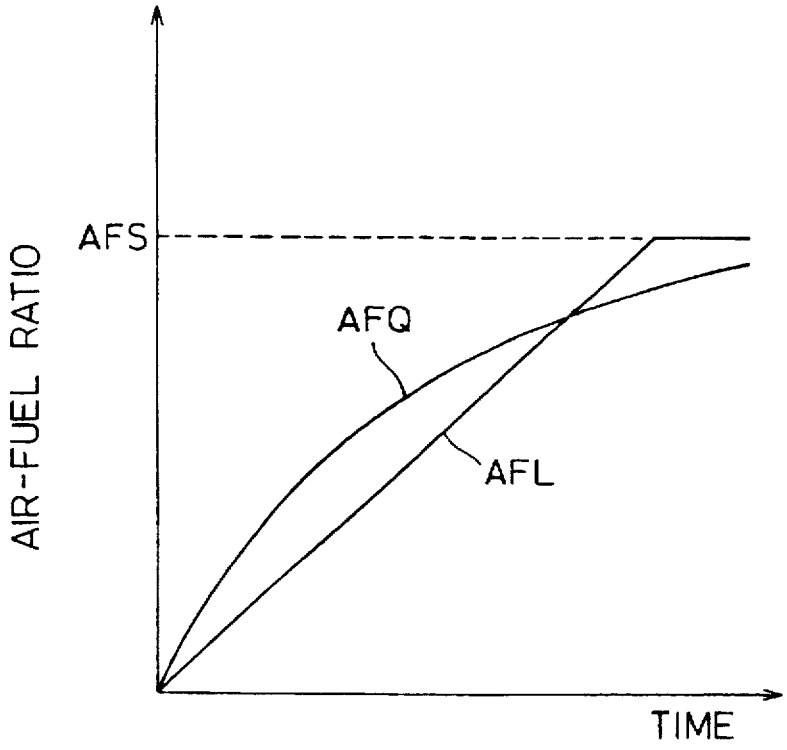
FIG. 32 is a graph for illustrating a first control mode.

According to the first control mode, as shown in FIG. 32, the target air-fuel ratio AFQ which is larger than the backup air-fuel ratio AFL is used as the transitional target air-fuel ratio AFN at the time of S→L switching, so that the engine driving is carried out according to the actual intake air amount Q(n) which varies from time to time in the transitional state.

In the transitional state, an amount of increasing change in the actual intake air amount Q(n) per unit time decreases with elapse of time. Therefore, the actual intake air amount Q(n) will not so significantly increasingly change after a certain time period has elapsed from the moment when the transitional state was entered. As shown in FIG. 32, the target air-fuel ratio AFQ in the transitional state varies in the same manner as in the case of the actual intake air amount Q(n). Therefore, if the target air-fuel ratio AFQ is used as the transitional target air-fuel ratio AFN, the transitional target air-fuel ratio AFN will not reach the final target air-fuel ratio AFS even if a relatively long time period has elapsed from the moment when the transitional state was entered.

On the other hand, if the backup air-fuel ratio AFL is used as the transitional target air-fuel ratio AFN after the time at which the target air-fuel ratio characteristic curve AFQ shown in FIG. 32 intersects the backup air-fuel ratio characteristic curve AFL shown in FIG. 32, the transitional target air-fuel ratio AFN will be smoothly changed to the final target air-fuel ratio AFS. After the time at which the two characteristic curves intersect each other, a sufficiently long time period has elapsed from the moment when the switching to the lean-burn driving was started, and therefore, the intake air amount is also sufficiently increased. For this reason, even when the air-fuel ratio is controlled not to the target air-fuel ratio AFQ corresponding to the actual intake air amount Q(n) but to the backup air-fuel ratio AFL, a deceleration feeling will not occur.

Thereafter, if the transitional target air-fuel ratio AFN has reached the final target air-fuel ratio AFS, the transitional switching state is terminated. After the transitional switching state is terminated, the air-fuel ratio is feedback-controlled to the final target air-fuel ratio AFS in the same manner as in the conventional case.

According to the first control mode, during the switching to the lean-burn driving, the air-fuel ratio control is effected such that the air-fuel ratio will follow a change in the actual intake air amount. As a result, a lag in the air amount control with respect to the fuel injection amount control can be prevented, so that an occurrence of a deceleration feeling can be positively prevented. Further, in the first control mode, since the air-fuel ratio is changed towards the lean side to the increase in the actual air amount, the output of the engine 501 is kept substantially constant, so that a shock will not occur during the switching of the driving modes. Further, even if an artificial accelerator operation is made, the engine 501 can be driven with the target air-fuel ratio. Furthermore, according to the first control mode, it is not necessary to additionally provide a special sensor, the control algorithm is simplified, and the engine driving control can be effected with high reliability.

Second Control Mode

Like the first control mode, in the second control mode, the comparing means 703, transitional target air-fuel ratio setting means 707, and backup air-fuel ratio setting means 706, among the elements of the follow-up changing means 702 shown in FIG. 28, are mainly used, and the setting of the fuel amount in the fuel amount setting means 705 is effected according to a larger one of the transitional target air-fuel ratio and the backup air-fuel ratio. The feature of the second control mode is that the changing rate of the backup air-fuel ratio is made higher as the rotation speed of the engine 501 becomes higher.

Figure 33:
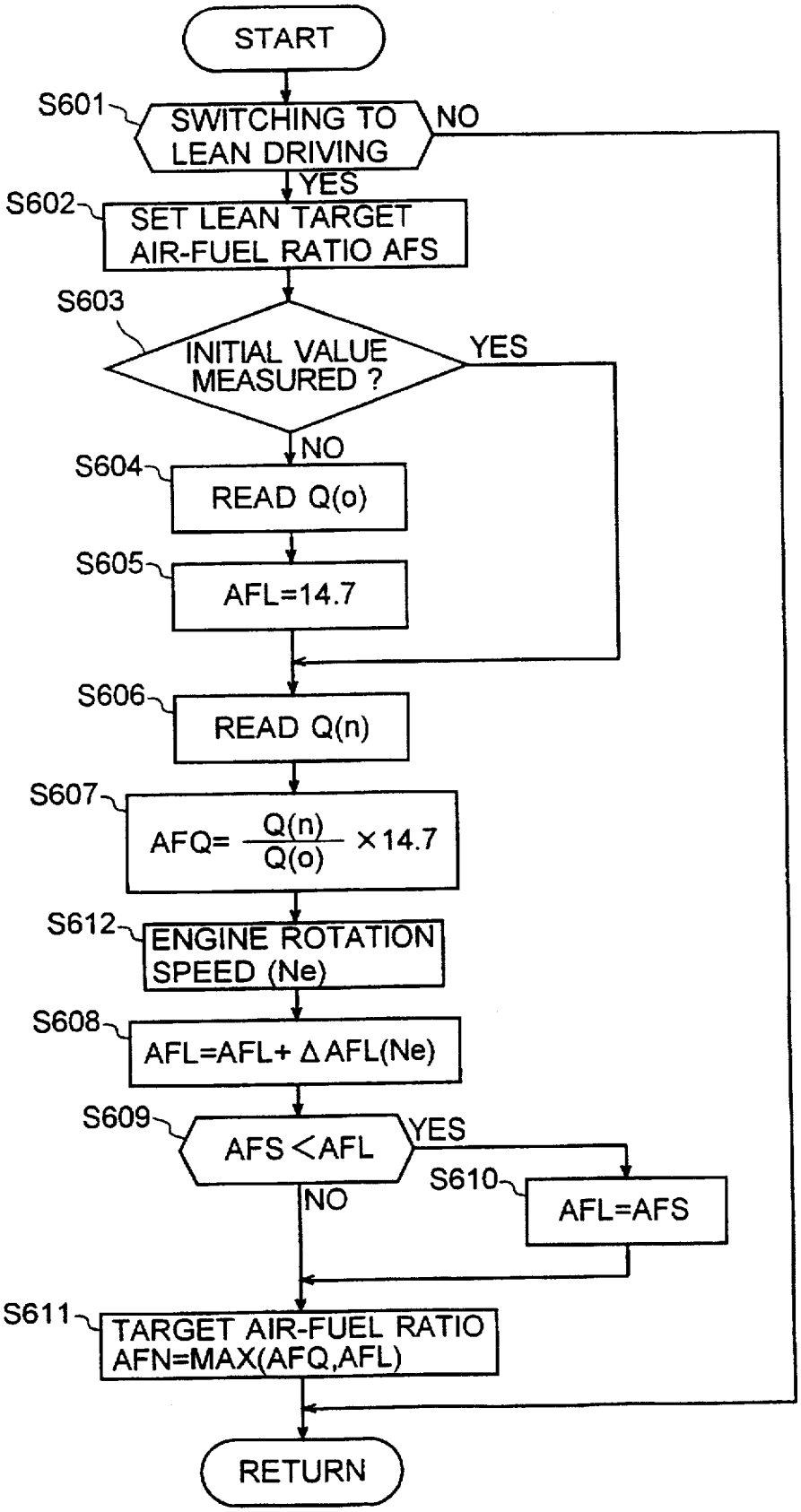
FIG. 33 is a flowchart showing the control procedure executed in a second control mode by the control device.

In the second control mode, the flow (target air-fuel ratio AFN setting routine) shown in FIG. 33 is executed by the ECU 525 at intervals of a predetermined cycle. The flow shown in FIG. 33 is basically the same as the flow shown in FIG. 31 relating to the first control mode. That is, in the flow shown in FIG. 33, the steps S601 to 611 respectively corresponding to the steps S501 to S511 of FIG. 31 and the step S612 which is not provided in the routine of FIG. 31 are effected.

Simply speaking, in the flow shown in FIG. 33, a determination is first made in the step S601 as to whether the switching state to the lean-burn driving is reached or not. If the result of determination is "NO", execution of the routine in the present cycle is terminated. If the result of determination is "YES", a lean target air-fuel ratio AFS is set (step S602).

Next, if it is determined in the step S603 that a measurement of an initial actual intake air amount Q(0) is not yet completed, an air-flow sensor output is set as the initial actual intake air amount Q(0) (step S604), and the backup air-fuel ratio AFL is set to its initial value (theoretical air-fuel ratio 14.7) (step S605). On the other hand, if it is determined in the step S603 that the measurement of the initial actual intake air amount Q(0) is completed, an airflow sensor output is set as the actual intake air amount Q(n) in the transitional state (step S606). In the next step S607, the target air-fuel ratio AFQ (corresponding to the characteristic curve AFQ shown in FIG. 34) is set according to the above-described equation (2) which is indicated below again.

$$AFQ=(Q(n)/Q(0))\times 14.7 \quad (2)$$

In the next step S612, the engine rotation speed Ne is read from the crank angle sensor 24 serving as the engine rotation speed sensor, and in the step S608, the backup air-fuel ratio AFL is set based on the engine rotation speed Ne according to the following equation (3-2).

$$AFL=AFL+\Delta AFL(Ne) \quad (3\text{-}2)$$

where ΔAFL(Ne) indicates an increment for increasing the backup air-fuel ratio AFL (corresponding to the characteristic curves AFL1 and AFL2 shown in FIG. 7) from the theoretical air-fuel ratio 14.7 towards the air-fuel ratio in the lean-burn driving. The increment is set according to the engine rotation speed Ne. For this purpose, the increment ΔAFL corresponding to the engine rotation speed Ne is read out from a ΔAFL·Ne map previously stored in the ECU 525, for example. Alternatively, the increment ΔAFL corresponding to the engine rotation speed Ne is calculated according to a calculation equation containing the engine rotation speed Ne as a variable.

Figure 34:
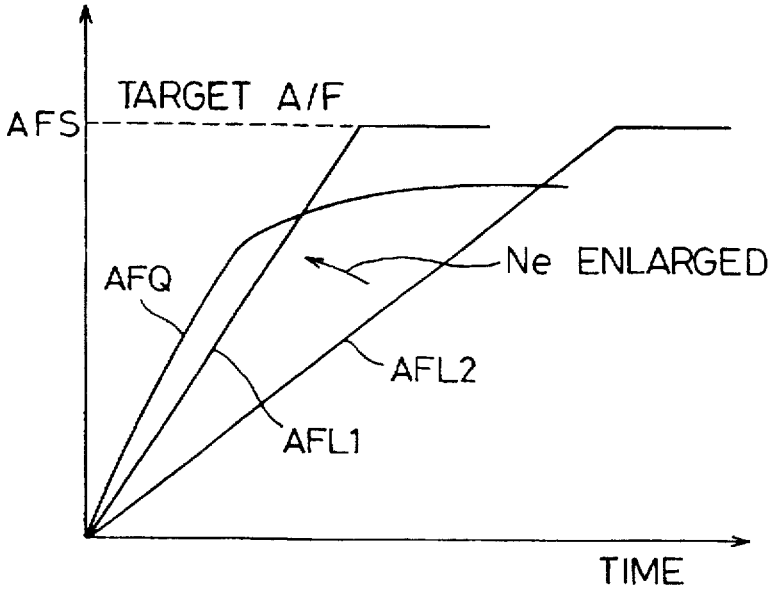
FIG. 34 is a graph for illustrating the second control mode.

As a result, the backup air-fuel ratio AFL takes a value on the characteristic curve AFL1 side shown in FIG. 34 in the high engine rotation speed range, and takes a value on the characteristic curve AFL2 side shown in FIG. 34 in the low engine rotation speed range.

In the next steps S609 and S610, the upper limit of the backup air-fuel ratio AFL is checked, and in the step S611, a larger one of the target air-fuel ratio AFQ and the backup air-fuel ratio AFL is set as the transitional target air-fuel ratio AFN.

According to the second control mode, the air-fuel ratio control which is basically the same as in the case of the first control mode is effected, whereby the same advantages as those explained in relation to the first control mode can be attained.

Third Control Mode

In the third control mode, only the transitional target air-fuel ratio setting means 707 among the various elements of the follow-up changing means 702 is used to set the transitional target air-fuel ratio AFN, and in setting the transitional target air-fuel ratio AFN, an increment ΔAFN (Ne) of the air-fuel ratio is set by taking the actual intake air amount into consideration.

Figure 35:
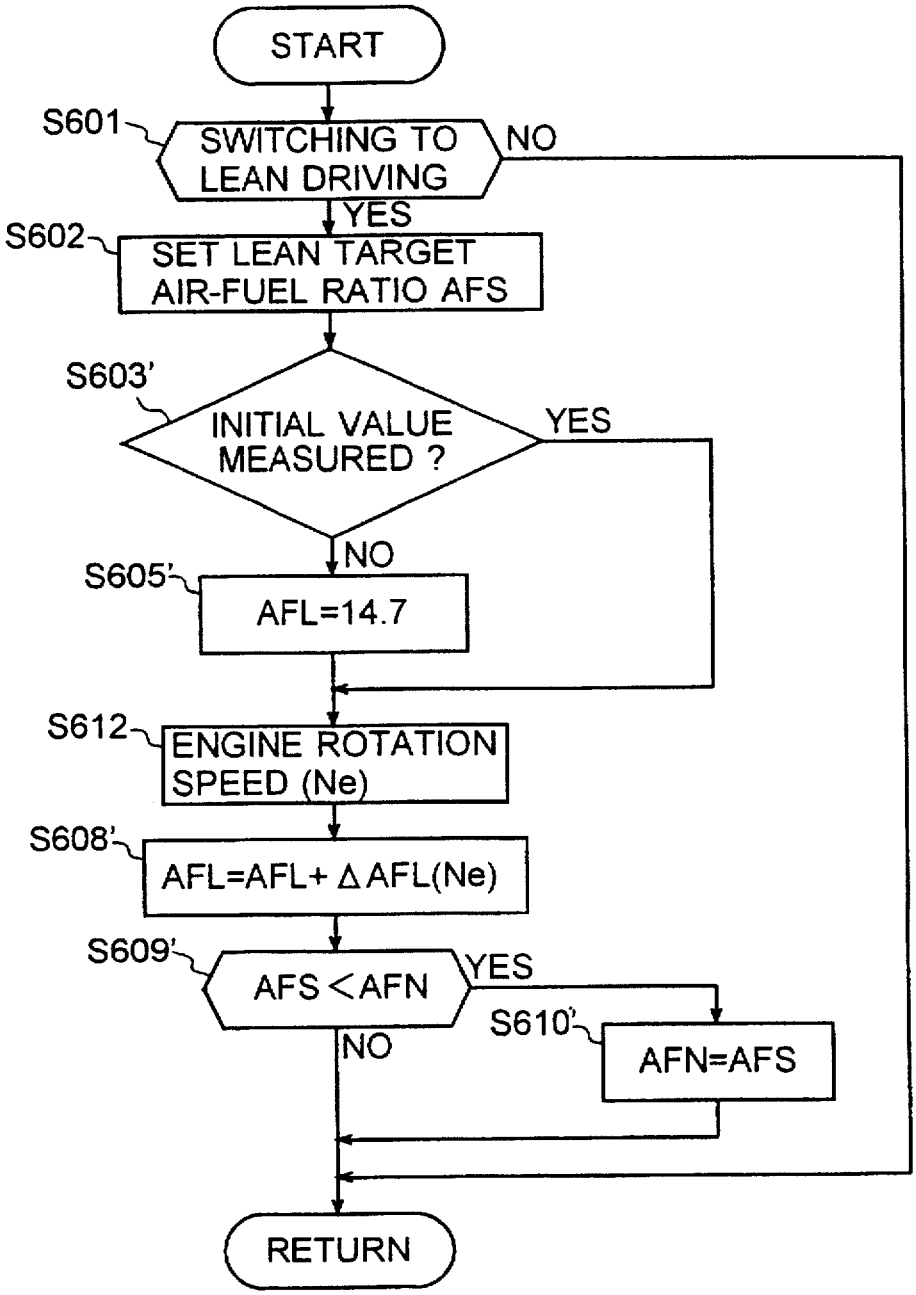
FIG. 35 is a flowchart showing the control procedure executed in a third control mode by the control device.

In the third control mode, the flow (target air-fuel ratio AFN setting routine) shown in FIG. 35 is executed by the ECU 525 at intervals of a predetermined cycle. In the flow shown in FIG. 35, the steps S601, S602, S603', S605', S612, and S608' to S610' respectively corresponding to the steps S601 to S603, S605, S612, and S608 to S610 shown in FIG. 33 are effected.

In the flow shown in FIG. 35, whether the state of switching to the lean-burn driving is reached or not is first determined in the step S601. If the result of determination is "NO", execution of the routine in the present cycle is terminated, and if the result of determination is "YES", the lean target air-fuel ratio AFS is set (step S602).

Next, if it is determined in the step S603' that a measurement of the initial actual intake air amount Q(O) is not yet completed, the backup air-fuel ratio AFL is set to its initial value (theoretical air-fuel ratio 14.7) (step S605'). The flow proceeds to the step S612 where the engine rotation speed Ne is read from the crank angle sensor 524 serving as the engine rotation speed sensor. On the other hand, if it is determined in the step S603' that the measurement of the initial actual intake air amount Q(0) is completed, the flow proceeds from the step S603' to the step S612.

In the next step S608', the transitional target air-fuel ratio AFN is set based on the engine rotation speed Ne according to the following equation (3-3).

$$AFN=AFN+\Delta AFN(Ne) \quad (3\text{-}3)$$

where ΔAFN(Ne) indicates an increment for increasing the backup air-fuel ratio AFL (corresponding to the characteristic curves AFL1 and AFL2 shown in FIG. 34) from the theoretical air-fuel ratio 14.7 towards the air-fuel ratio (final target air-fuel ratio AFS) in the lean-burn driving. The increment is set according to the engine rotation speed Ne. For this purpose, the increment ΔAFN(Ne) corresponding to the engine rotation speed Ne is read out from a ΔAFN·Ne map previously stored in the ECU 525, for example. Alternatively, the increment ΔAFN(Ne) corresponding to the engine rotation speed Ne is calculated according to a calculation equation containing the engine rotation speed Ne as a variable.

As a result, the transitional target air-fuel ratio AFN takes a value on the characteristic curve AFL1 side shown in FIG. 34 in the high engine rotation speed range, and takes a value on the characteristic curve AFL2 side shown in FIG. 34 in the low engine rotation speed range.

More specifically, in the follow-up changing means 702, the transitional target air-fuel ratio AFN which gradually changes from the initial target air-fuel ratio AFN (=14.7) just prior to the start of switching of the driving states to the final target air-fuel ratio AFS at the completion of the switching is set by the transitional target air-fuel ratio setting means 707.

In the next steps S609' and S610', the upper limit of the transitional target air-fuel ratio AFN is checked.

According to the third control mode, the same advantages as those explained in relation to the second control mode can be attained. Since the calculation of the target air-fuel ratio AFQ is not necessary, a desired engine control can be more simplified.

Fourth Control Mode

In the fourth control mode, the transitional target air-fuel ratio setting means 702 and change inhibition/suppression means 708 among the various elements of the follow-up changing means 702 shown in FIG. 28 are used, and the changing rate of the transitional target air-fuel ratio is changed from a rate corresponding to the high engine rotation speed to a rate corresponding to the low engine rotation speed.

Figure 36:
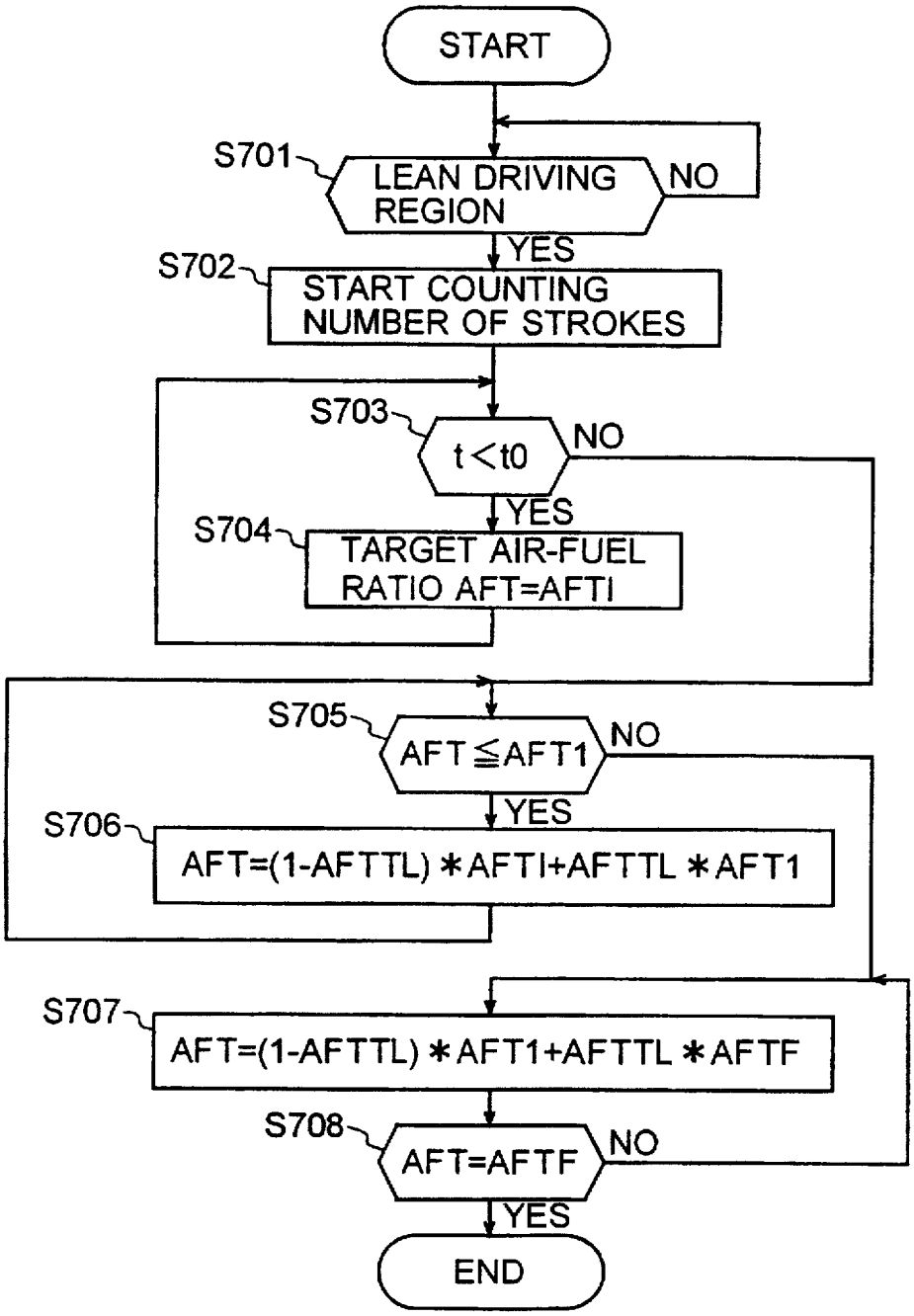
FIG. 36 is a flowchart showing the control procedure executed in a fourth control mode by the control device.

In the fourth control mode, the flow (transitional target air-fuel ratio AFT setting routine) shown in FIG. 36 is executed by the ECU 525. In the flow, whether the engine 501 is driven in the lean-burn driving region or not is first determined in the step S701. If the result of determination is "NO", execution of the routine in the present cycle is terminated. If the result of determination is "YES", that is, if the entry into the lean-burn driving region (the start of switching to the lean-burn driving) is determined in the step S701, the operation of counting the number of strokes effected in the combustion chambers of the engine from the moment when the switching of the driving modes starts is started.

In the next step S703, a predetermined time period to corresponding to the engine rotation speed Ne just prior to the switching of the driving modes is derived with reference to a t0 Ne map previously stored in the ECU 525. In the map, predetermined time periods to respectively corresponding to the engine rotation speeds Ne listed below are stored. The predetermined time period t0 takes a smaller value as the engine rotation speed Ne becomes higher. Next, whether a time period t corresponding to the counted number of strokes is shorter than the predetermined time period t0 or not is determined.

Ne (rpm)=750, 1000, 1250, 1500, 2000, 2500, 3000, 3500

If it is determined in the step S703 that the time period t corresponding to the number of strokes is shorter than the predetermined time period t0, the flow proceeds to the step S704. In the step S704, the target air-fuel ratio AFTI just prior to the switching of the driving modes is set as the transitional target air-fuel ratio AFT. Thus, a change in the transitional target air-fuel ratio AFT from the target air-fuel ratio AFTI just prior to the switching to the lean-burn driving is suppressed by the function of the change inhibiting/suppressing means 708 until the predetermined time period t0 has elapsed from the moment when the switching to the lean-burn driving was started (see, FIG. 37). The reason for doing this is that since the actual intake air amount starts to increase after a dead time has passed from the moment when the switching to the lean-burn driving was started, a deceleration feeling occurs if the target air-fuel ratio is increased immediately after the start of the switching. By suppressing the increase in the target air-fuel ratio as described above, an occurrence of a deceleration feeling can be prevented.

Thereafter, if it is determined in the step S703 that the time period t is longer than the predetermined time period t0, the flow proceeds to the step S705. In the step S705, a determination is made whether or not the transitional target air-fuel ratio AFT is equal to or smaller than a predetermined air-fuel ratio AFT1, which is larger than the target air-fuel ratio AFTI just prior to the switching to the lean-burn driving and smaller than the final target air-fuel ratio AFTF.

When the step S705 is executed for the first time, the transitional target air-fuel ratio AFT is equal to the value AFTI, and is hence smaller than the predetermined value AFT1. Thus, the flow proceeds to the step S706. In the step S706, the transitional target air-fuel ratio AFT is calculated according to the following equation (4-1).

$$AFT=(1-AFTTL)\times AFTI+AFTTL\times AFTI \quad (4\text{-}1)$$

where the coefficient AFTTL is a transitional target air-fuel ratio calculation coefficient. The coefficient AFTTL takes an initial value "0" until the predetermined time period t0 has elapsed from the moment when the switching of the driving states was started. After the elapse of the predetermined time period t0, the coefficient AFTTL is increased by an increment AFTTL1 each time one stroke is completed in the combustion chamber concerned of the engine (each time the number of strokes is counted up), and it takes a final value "1" when the transitional target air-fuel ratio AFT has reached the predetermined air-fuel ratio AFT1. An explanation with regard to the setting of the increment AFTTL1 will be given later.

After completion of the calculation of the transitional target air-fuel ratio AFT in the step S706, the flow returns to the step S705. The steps S705 and S706 are repeatedly executed in this manner, and thus, after the predetermined time period t0 has elapsed from the moment when the switching of the driving states was started, the transitional target air-fuel ratio AFT linearly increasingly changes from the target air-fuel ratio AFTI to the predetermined air-fuel ratio AFT1 with elapse of time (see, FIG. 37).

The predetermined air-fuel ratio AFT1 is set to a value corresponding to the limit on the lean side of the air-fuel ratio region in which the possibility of generation of nitrogen oxide (NOx) is strong. Therefore, it is possible to shorten the engine driving time period in the air-fuel ratio region where nitrogen oxide tends to generate, by increasing the changing rate of the transitional target air-fuel ratio AFT during when the transitional target air-fuel ratio AFT has a value falling within a range varying from the target air-fuel ratio AFTI just prior to the switching of the driving states to the predetermined air-fuel ratio AFT1.

Thereafter, if it is determined in the step S705 that the transitional target air-fuel ratio AFT is not equal to or smaller than the predetermined air-fuel ratio AFT1, the flow proceeds to the step S707. In the step S707, the transitional target air-fuel ratio AFT is calculated according to the following equation (4-2).

$$AFT=(1-AFTTL)\times AFT1+AFTTL\times AFTF \quad (4\text{-}2)$$

where AFTTL is a transitional target air-fuel ratio calculation coefficient. The coefficient AFTTL takes an initial value "0" when the transitional target air-fuel ratio AFT has reached the predetermined air-fuel ratio AFT1, and thereafter, it is increased by an increment AFTTL2 each time one stroke is effected in the combustion chamber concerned of the engine. The coefficient AFTTL takes a final value "1" when the transitional target air-fuel ratio AFT has reached the final target air-fuel ratio AFTF at the time of completion of the driving switching.

The increments AFTTL1 and AFTTL2 of the transitional target air-fuel ratio calculation coefficient AFTTL are set according to the engine rotation speed Ne and the volumetric efficiency Ev just prior to the switching to the lean-burn driving. In the setting of the increments, for example, a AFTTL1·Ev·Ne map and AFTTL2·Ev·Ne map previously stored in the ECU 525 are referred to. In each of the maps, increments AFTTL1 or AFTTL2 corresponding to combinations of the volumetric efficiencies Ev and the engine rotation speeds listed below are stored.

Ne (rpm)=750, 1000, 1250, 1500, 2000, 2500, 3000, 3500

Ev (%)=20, 30, 40, 50, 60, 70

Following the calculation of the transitional target air-fuel ratio AFT in the step S707, the flow proceeds to the step S708 to determine whether or not the transitional target air-fuel ratio AFT is equal to the final target air-fuel ratio AFTF. If the result of determination is "NO", the flow returns to the step S707. Thus, the steps S707 and S708 are repeatedly effected. After the transitional target air-fuel ratio AFT reaches the predetermined air-fuel ratio AFT1, therefore, the transitional target air-fuel ratio AFT linearly increasingly changes from the predetermined air-fuel ratio AFT1 to the final target air-fuel ratio AFTF with elapse of time (see, FIG. 37).

Thereafter, if it is determined in the step S708 that the transitional target air-fuel ratio AFT is equal to the final target air-fuel ratio AFTF, the transitional target air-fuel ratio setting routine (switching operation) shown in FIG. 36 is terminated, and the air-fuel ratio feedback control to the final target air-fuel ratio AFTF is started.

Figure 37:
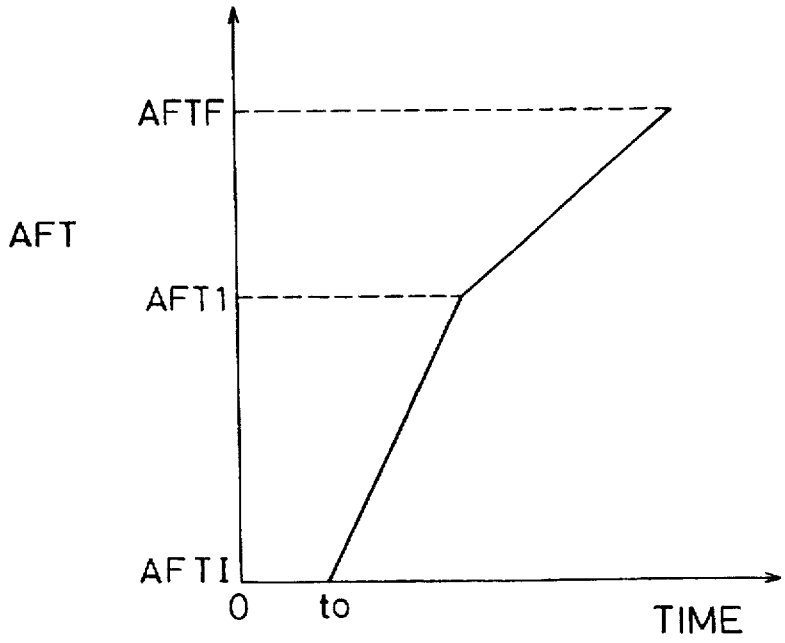
FIG. 37 is a graph for illustrating the fourth control mode.
Figure 42:
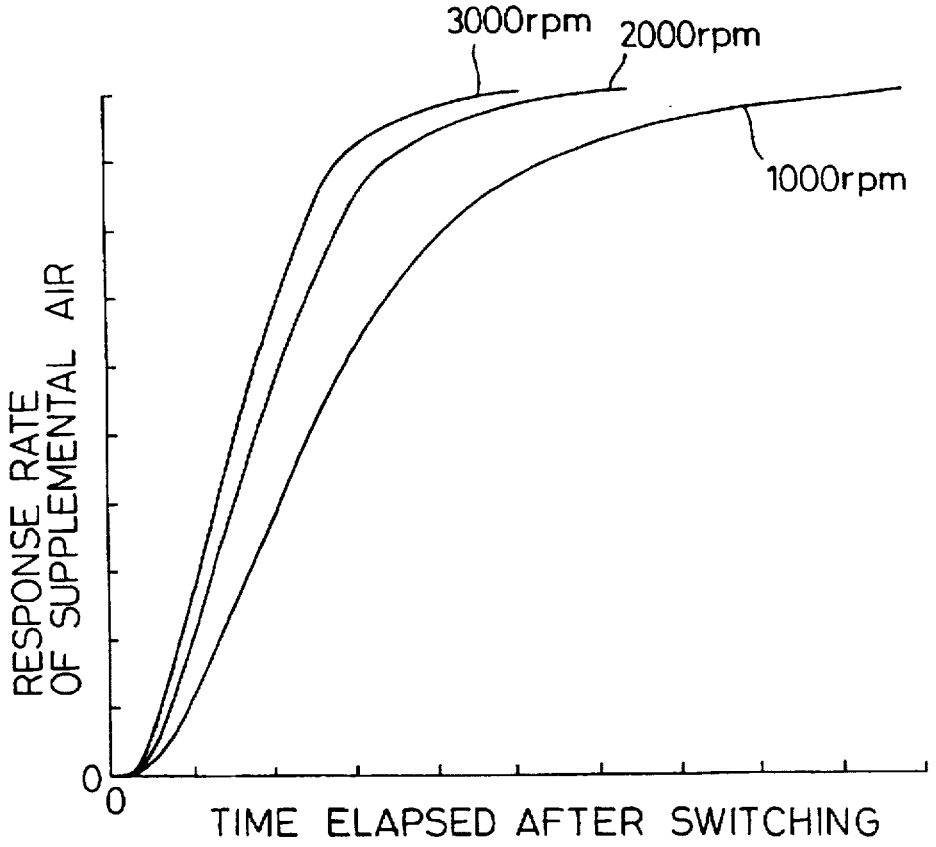
FIG. 42 is a graph for illustrating an air-fuel ratio control characteristic.

According to the fourth control mode, the transitional target air-fuel ratio AFT varies as shown in FIG. 37 during the switching operation from the start of switching to the lean-burn driving to the attainment of the final target air-fuel ratio AFTF. This change is, as a whole similar, to the change (refer to FIG. 42) in the actual intake air amount. As a result, it is possible to prevent an occurrence of a deceleration feeling caused by the fact that the intake air amount changes accompanying the dead time and the first-order lag.

Further, as described above, since the changing rate of the transitional target air-fuel ratio AFT is high in a time period during which the transitional target air-fuel ratio AFT changes from the target air-fuel ratio AFTI just prior to the switching of the driving states to the predetermined air-fuel ratio AFT1, the air-fuel ratio region where nitrogen oxide tends to generate can be rapidly passed through.

Since the transitional target air-fuel ratio AFT is set according to the engine rotation speed Ne, a proper air-fuel ratio control can be made.

Further, according to the fourth control mode, the same advantages as those obtained by the first control mode can be attained. That is,, since the air-fuel ratio control is effected such that the air-fuel ratio will follow a change in the actual intake air amount during the switching to the lean-burn driving, a lag of the air amount control with respect to the fuel injection amount control can be prevented, and hence an occurrence of a deceleration feeling can be prevented. Since the air-fuel ratio is changed towards the lean side according to an increase in the actual air amount, the output of the engine 501 is kept substantially constant, so that an occurrence of a shock caused by switching of the driving modes can be prevented. Further, even if an artificial accelerator operation is made, the engine 501 can be driven with the target air-fuel ratio. Furthermore, no additional special sensor is required, and the control algorithm is simplified, so that a positive engine driving control can be made.

Fifth Control Mode

In the fifth control mode, the transitional target air-fuel ratio setting means 707 and correction means 709 among the various elements of the follow-up changing means 702 shown in FIG. 28 are mainly used. When correcting the intake air amount according to a change in the throttle opening degree caused by an artificial operation during the transitional switching driving, the correction means 709 sets a correction amount of the intake air amount based on intake air amount change information.

Figure 38:
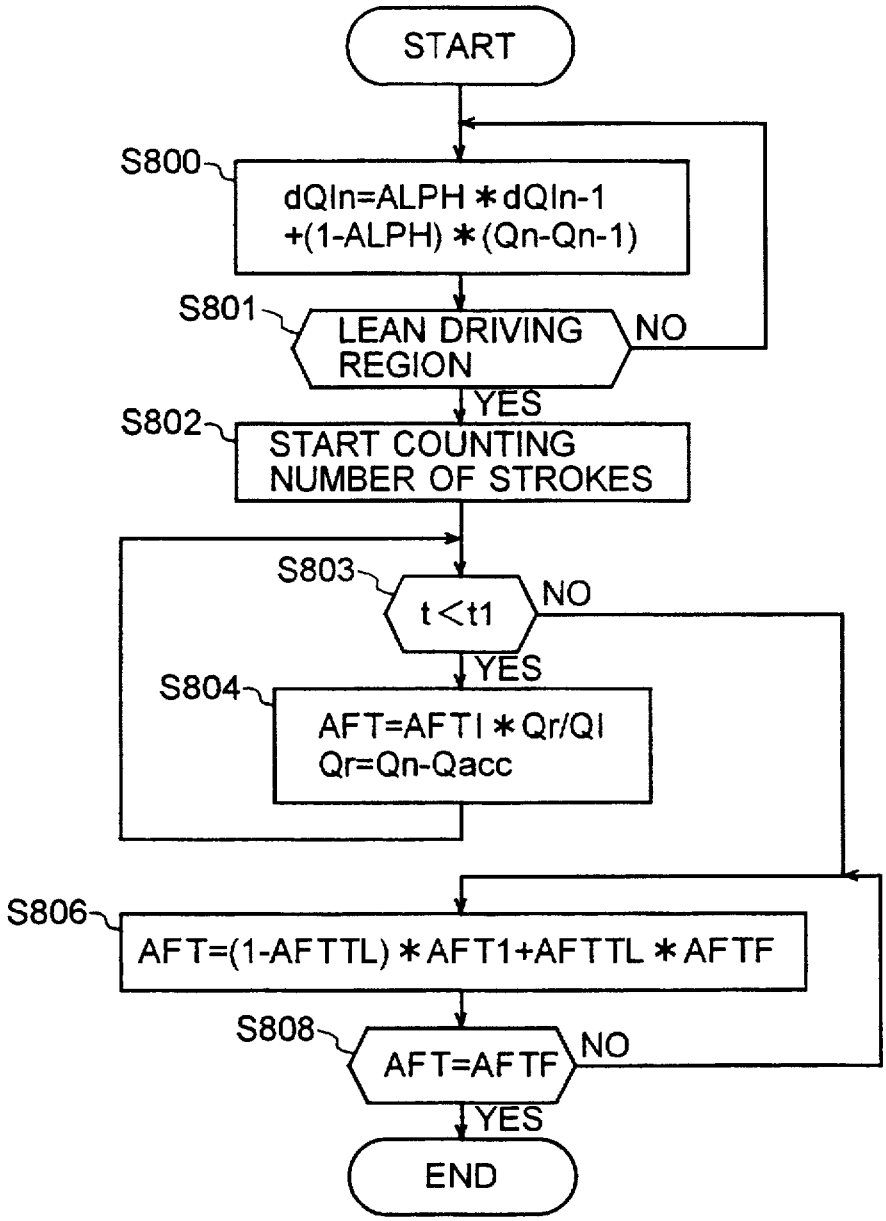
FIG. 38 is a flowchart showing the control procedure executed in a fifth control mode by the control device.

In the fifth mode, the flow (transitional target air-fuel ratio AFT setting routine) shown in FIG. 38 is executed by the ECU 525. In the flow, the intake air amount changing rate dQIn is calculated according to the following equation (5) (step S800).

$$dQIn=ALPH\times dQIn-1+(1-ALPH)\times(Qn-Qn-1) \quad (5)$$

where dQIn−1 is the intake air amount changing rate calculated in the preceding cycle, and, Qn and Qn−1 indicate intake air amounts measured in the present and preceding cycles, respectively.

In the calculation of the intake air amount changing rate dQIn, a primary smoothing process for the intake air amount changing rates dQIn−1 and dQIn in the preceding and present cycles is carried out by use of a weighting coefficient ALPH. As a result, influences by instantaneous noise components are eliminated, so that the intake air amount changing rate dQIn can be stably calculated.

Following the calculation of the intake air amount changing rate in the step S800, a determination is made as to whether the engine 501 is driven in the lean-driving region or not (step S801). If the result of determination is "NO", the flow returns to the step S800. Therefore, the calculation of the intake air amount changing rate in the step S800 is repeatedly effected at intervals of a predetermined cycle until the lean-burn-driving region is entered.

Thereafter, if the entry into the lean-burn-driving region is determined in the step S801, the switching to the lean driving state is started. That is, in the step S802, the operation of counting the number of strokes effected in the combustion chambers of the engine after the start of switching of the driving modes is started. In the next step S803, a predetermined time period t1 corresponding to the engine rotation speed Ne just prior to the switching of the driving modes is derived with reference to a t1·Ne map previously stored in the ECU 525. In the map, the predetermined time periods t1 respectively corresponding to the engine rotation speeds Ne listed below are stored. Next, a determination is made as to whether or not a time period t corresponding to the counted number of strokes is shorter than the predetermined time period t1.

Ne (rpm)=750, 1000, 1250, 1500, 2000, 2500, 3000, 3500

If it is determined in the step S803 that the time period t corresponding to the number of strokes is shorter than the predetermined time period t1, the flow proceeds to the step S804. In the step S804, the transitional target air-fuel ratio AFT is calculated according to the following equation (6).

$$AFT=AFTI\times Qr/QI \quad (6)$$

where AFTI indicates the target air-fuel ratio AFTI just prior to the switching of the driving states, QI indicates the intake air amount just prior to the switching of the driving states, and Qr indicates an intake air amount used for the calculation of the transitional target air-fuel ratio.

The parameter Qr is derived from the following equation (7).

$$Qr=Qn-Qacc \quad (7)$$

where Qn indicates an intake air amount measured immediately before the calculation of the parameter Qr, and Qacc indicates an intake air amount correction value.

The correction value Qacc, the initial value of which is "0", takes a value which is increased by the intake air amount changing rate dQIn just prior to the switching of the driving states each time one stroke is effected in the combustion chamber concerned of the engine. That is, the correction value Qacc indicates an amount of change in the intake air amount from the intake air amount QI at the time of switching of the driving states to the intake air amount derived on the assumption that the intake air amount changes at the intake air amount changing rate dQIn determined just prior to the switching of the driving states (refer to FIG. 39) (Generally, the amount of change indicates an amount of increase in the intake air amount from the time of switching of the driving states).

The intake air amount changing rate dQIn corresponds to a change (indicated by oblique broken lines in FIG. 39) in the throttle opening degree by an artificial operation made immediately before the switching of the driving states. In general, such an artificial operation is successively performed even after the start of switching to the lean-burn driving. In order to eliminate the influence of the amount of change in the intake air amount caused by a change in the throttle opening degree by the artificial operation on the calculation for the transitional target air-fuel ratio, an actual intake air amount Qr relating to the switching to the lean-burn driving is derived by subtracting the amount Qacc of change in the intake air amount caused by the artificial operation from the actual intake air amount Qn, as shown in the equation (7), and the actual intake air amount Qr is used in the calculation for the transitional target air amount AFT.

At the time of switching to the lean-burn driving, the air bypass valve 514 is opened, as described before with reference to FIG. 29, and the opening action of the air bypass valve 514 permits the actual intake air amount Q to be supplied. A transitional characteristic of the actual intake air amount Qr corresponds to a transitional target air-fuel ratio characteristic curve AFT shown in FIG. 40.

Repeatedly speaking, during the transitional switching control to the lean-burn driving, the intake air amount Qn during the transitional switching driving is corrected in the correction means 709 by using the correction amount Qacc derived according to the intake air amount change information dQIn of the engine 501 indicative of a change in the throttle opening degree caused by an artificial operation. The thus corrected intake air amount Qn (intake air amount Qr relating to the switching driving) is supplied for comparison, in the comparing means 703, with the intake air amount QI just prior to the switching driving, and is supplied for calculation for the transitional target air-fuel ratio AFT in the transitional target air-fuel ratio setting means 707.

Figure 40:
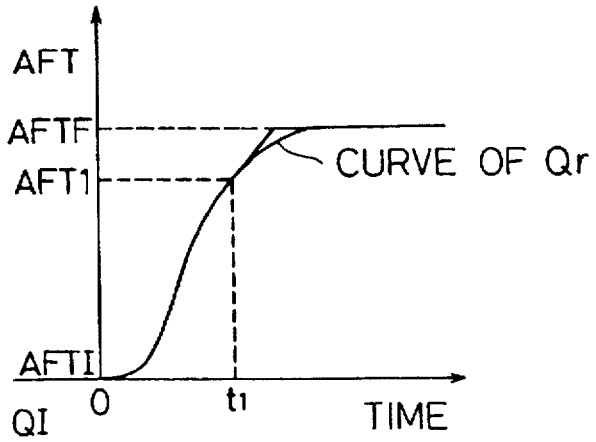
FIG. 40 is a graph for illustrating the fifth control mode.

In this manner, the transitional target air-fuel ratio AFT is set based on the intake air amount Qr relating to the switching to the lean-burn driving according to the equation (6). As a result, as shown in FIG. 40, the transitional target air-fuel ratio AFT increasingly changes from the target air-fuel ratio AFTI just prior to the switching with elapse of time.

Thereafter, if it is determined in the step S803 that a time period corresponding to the counted number of strokes is not shorter than the predetermined time period t1, the flow proceeds to the step S806. That is, when the predetermined time period t1 has elapsed from the moment when the switching to the lean-burn driving was started, so that the transitional target air-fuel ratio AFT has reached the predetermined air-fuel ratio AFTI corresponding to the upper limit on the lean side of the air-fuel ratio region in which nitrogen oxide tends to generate (refer to FIG. 40), the calculation, in the step S804, of the transitional target air-fuel ratio AFT based on the intake air amount Qr relating to the switching to the lean-burn driving is completed.

In the step S806, the transitional target air-fuel ratio AFT is calculated according to the following equation (7a).

$$AFT=(1-AFTTL)\times AFT1+AFTTL\times AFTF \quad (7a)$$

where AFTTL is a transitional target air-fuel ratio calculation coefficient. The coefficient AFTTL takes an initial value "0" in a time period from the moment when the switching of the driving states is started to the moment the predetermined time period t1 elapses. After the elapse of the predetermined time period t1, the coefficient AFTTL increases by an increment AFTTL1 each time one stroke is completed in the combustion chamber concerned of the engine, and takes a final value "1" when the transitional target air-fuel ratio AFT has reached the final target air-fuel ratio AFTF. As in the case of the increments AFTTL1 and AFTTL2 explained in the fourth control mode, the increment AFTTL1 of the transitional target air-fuel ratio calculation coefficient AFTTL is set according to the engine rotation speed Ne and the volumetric efficiency Ev just prior to the switching to the lean-burn driving.

When the calculation for the transitional target air-fuel ratio AFT in the step S806 is completed, the flow proceeds to the step S808. In the step S808, whether or not the transitional target air-fuel ratio AFT is equal to the final target air-fuel ratio AFTF is determined. If the result of determination is "NO", the flow returns to the step S806.

After the transitional target air-fuel ratio AFT exceeds the predetermined air-fuel ratio AFT1, the transitional target air-fuel ratio AFT is calculated according to the equation (7a), as explained above. In other words, the transitional target air-fuel ratio AFT is set by linear interpolation. As a result, the transitional target air-fuel ratio AFT can be properly increased towards the final target air-fuel ratio AFTF, without causing a lag which may be caused when the transitional target air-fuel ratio AFT is set according to the intake air amount Qr which gradually increasingly changes after the predetermined air-fuel ratio AFT1 has been reached. Thus, the final target air-fuel ratio AFTF can be attained at adequate time.

Afterwards, when the transitional target air-fuel ratio AFT has reached the final target air-fuel ratio AFTF, the result of determination in the step S808 becomes "YES", and the transitional switching driving is terminated. After this, the air-fuel ratio is feedback-controlled to the final target air-fuel ratio AFTF.

According to the fifth control mode, the same operation and effects as those of the fourth control mode can be attained. Simply speaking, during the switching operation from the start of switching to the lean-burn driving to the attainment of the final target air-fuel ratio AFTF, a change in the transitional target air-fuel ratio AFT becomes similar to a change in the actual intake air amount. Further, the air-fuel ratio control is carried out such that the air-fuel ratio follows a change in the actual intake air amount, while compensating for an artificial operation. Thus, it is possible to prevent an occurrence of a deceleration feeling. Furthermore, the transitional target air-fuel ratio AFT is set according to the engine rotation speed Ne, and the transitional target air-fuel ratio AFT linearly increases in a latter stage of the switching control, whereby the switching control can be made properly and can be completed at an appropriate timing. Since the air-fuel ratio is changed towards the lean side with an increase in the actual intake air amount, an occurrence of a shock caused by the switching of the driving modes can be prevented. Further, a special sensor is unnecessary, and the engine driving control can be positively carried out by use of simple control algorithm.

Sixth Control Mode

In the sixth control mode, the transitional target air-fuel ratio setting means 707 and correction means 709 among the various elements of the follow-up changing means 702 shown in FIG. 28 are mainly used. The correction means 709 calculates an intake air amount, which corresponds to a change in the throttle opening degree by an artificial operation and which does not relate to the switching to the lean-burn driving, according to the throttle opening degree and the engine rotation speed. Based on the result of the calculation, the correction means 709 corrects the intake air amount and hence the transitional target air-fuel ratio.

Figure 41:
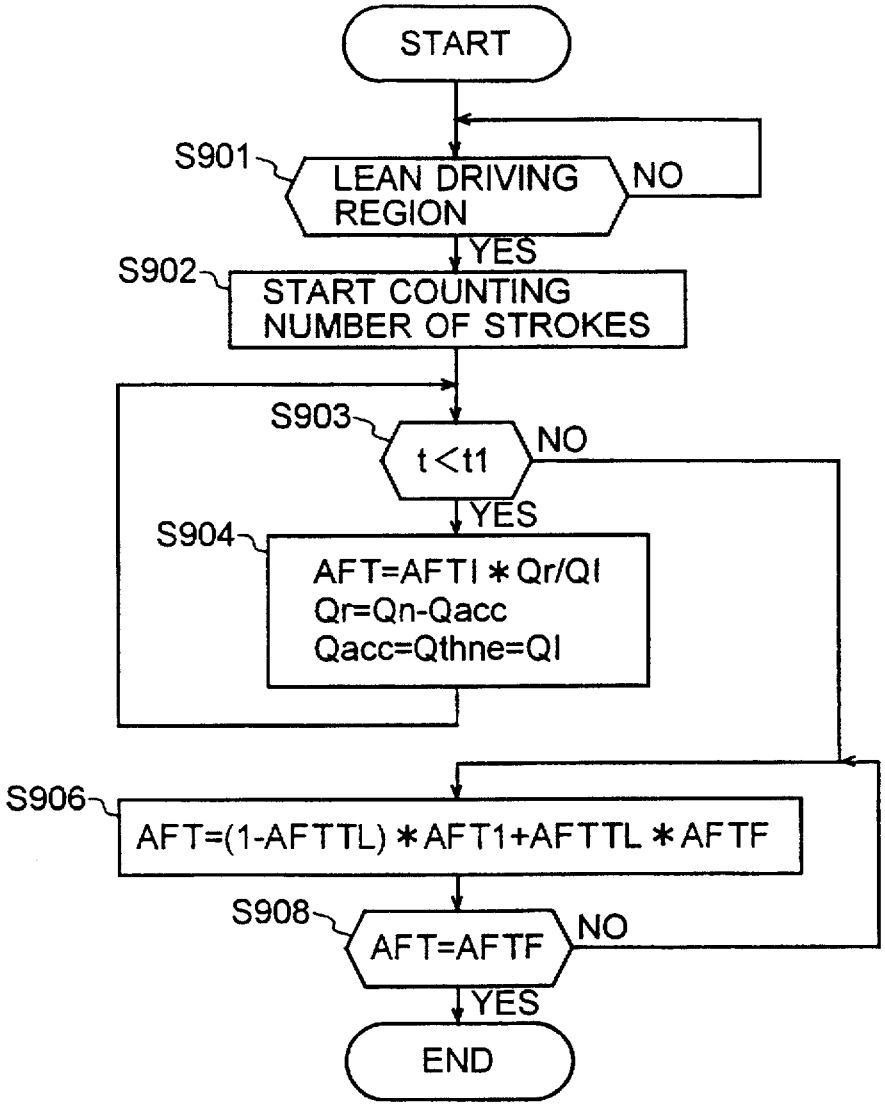
FIG. 41 is a flowchart showing the control procedure executed in a sixth control mode by the control device.

In the sixth mode, the flow (transitional target air-fuel ratio AFT setting routine) shown in FIG. 41 is executed by the ECU 525. In the flow, whether the engine 501 is driven in the lean-burn driving region or not is determined (step S901). If the result of determination is "NO", the step S901 is executed again.

After this, if entry into the lean-burn driving region is determined in the step S901, switching to the lean driving state is started. That is, in the step S902, the operation of counting the number of strokes, completed in the combustion chambers of the engine after the start of switching to the lean driving state, is started. In the next step S903, a predetermined time period t1, corresponding to the engine rotation speed Ne just prior to the switching of the driving states, is derived with reference to a map which is similar to the t1-Ne map explained in the fifth control mode, and a determination is made as to whether or not a time period t corresponding to the counted number of strokes is shorter than the predetermined time period t1.

If it is determined in the step S903 that the time period t is shorter than the predetermined time period t1, the flow proceeds to the step S904. In the step S904, the transitional target air-fuel ratio AFT is calculated according to the equation (8) corresponding to the equation (6).

$$AFT=AFTI\times Qr/QI \quad (8)$$

where AFTI indicates a target air-fuel ratio AFTI just prior to the switching of the driving states, QI indicates an intake air amount just prior to the switching of the driving states, and Qr indicates an intake air amount used for the calculation of the transitional target air-fuel ratio.

The parameter Qr is derived by use of the following equation (9).

$$Qr=Qn-Qacc=Qn-(Qthne-QI) \quad (9)$$

where Qn indicates an intake air amount measured immediately before the calculation of the parameter Qr, and Qacc is an intake air amount correction value.

The correction value Qacc has its initial value of "0". Each time one stroke is effected in the engine combustion chamber, the correction value Qacc is derived based on a predetermined value Qthne, indicative of an intake air amount at the time of stoichiometric driving, and an intake air amount QI at the start of switching to the lean-burn driving. The predetermined value Qthne is derived with reference to a Qthne·Ne·TH map previously stored in the ECU 525. In the map, predetermined values Qthne corresponding to combinations of the engine rotation speeds Ne and the throttle opening degrees TH listed below are stored.

Ne (rpm)=750, 1000, 1250, 1500, 2000, 2500, 3000, 3500

TH (V)=0.635, 1.26, 1.885, 2.510, 3.135, 3.76, 4.385

Figure 39:
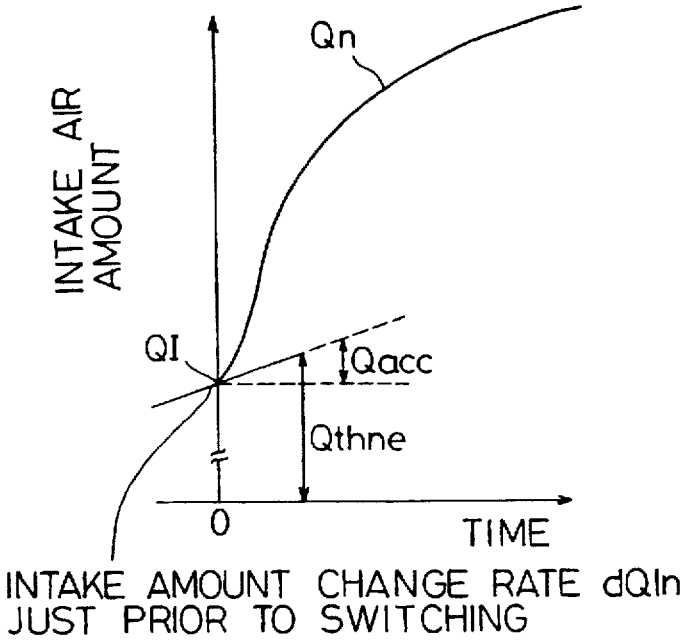
FIG. 39 is a graph for illustrating the fifth control mode.

As in the case of the fifth control mode, the correction value Qacc indicates an amount of change in the intake air amount from the intake air amount QI at the time of switching of the driving states to the intake air amount derived on the assumption that the intake air amount changes at the intake air amount changing rate dQIn just prior to the switching of the driving states (refer to FIG. 39). As shown in FIG. 39, the correction value Qacc corresponds to a value obtained by subtracting the intake air amount QI from the intake air amount Qthne.

As described above, the transitional target air-fuel ratio AFT is calculated according to the equation (8) corresponding to the equation (6). That is, as in the case of the calculation of the transitional target air-fuel ratio AFT according to the equation (6) in the fifth control mode, the transitional target air-fuel ratio AFT is set based on the intake air amount Qr which corresponds to a value obtained by subtracting the intake air amount Qacc, caused by a change in the throttle opening degree by an artificial operation, from the intake air amount Qn and which relates to the switching driving to the lean-burn driving. As a result, the influence of the artificial operation is eliminated, and the transitional target air-fuel ratio AFT increasingly changes from the target air-fuel ratio AFTI just prior to the switching with elapse of time (refer to FIG. 40).

Afterwards, if it is determined in the step S903 that a time period corresponding to the counted number of strokes is not shorter than the predetermined time period t1, the flow proceeds to the step S906. That is, when the predetermined time period t1 has elapsed, and therefore, the predetermined air-fuel ratio AFT1 corresponding to the upper limit on the lean side of the predetermined air-fuel ratio region in which nitrogen oxide tends to generate has been reached (refer to FIG. 49), the calculation (step S904) of the transitional target air-fuel ratio AFT according to the intake air amount Qr is completed.

In the step S906, the transitional target air-fuel ratio AFT is calculated according to the equation (10) corresponding to the equation (7a).

$$AFT=(1-AFTTL)\times AFT1+AFTTL\times AFTF \quad (10)$$

where AFTTL indicates a transitional target air-fuel ratio calculation coefficient. As is explained in the fifth control mode, the coefficient AFTTL takes an initial value "0", increases by an increment AFTTL1 each time one stroke is effected after the elapse of the predetermined time period t1, and takes a final value "1" when the final target air-fuel ratio AFTF is reached. Further, as in the case of the fifth control mode, the increment AFTTL1 is set according to the engine rotation speed Ne and the volumetric efficiency Ev just prior to the switching to the lean-burn driving.

After the calculation of the transitional target air-fuel ratio AFT in the step S906 is completed, the flow proceeds to the step S908. In the step S908, whether the transitional target air-fuel ratio AFT is equal to the final target air-fuel ratio AFTF or not is determined, and if the result of determination is "NO", the flow returns to the step S906.

Thus, after the transitional target air-fuel ratio AFT has exceeded the predetermined air-fuel ratio AFT1, the transitional target air-fuel ratio AFT is calculated according to the equation (10). In other words, the transitional target air-fuel ratio AFT is set by linear interpolation. As a result, the transitional target air-fuel ratio AFT properly increases towards the final target air-fuel ratio AFTF without any lag, whereby the final target air-fuel ratio AFTF can be attained at an appropriate timing.

Afterwards, when the transitional target air-fuel ratio AFT reaches the final target air-fuel ratio AFTF, the result of determination in the step S908 becomes "YES", and the transitional switching driving is terminated. After this, the air-fuel ratio is feedback-controlled to the final target air-fuel ratio AFTF.

According to the sixth control mode, the same operation and effects as those of the fourth and fifth control modes can be attained. Simply speaking, the air-fuel ratio control is effected such that the air-fuel ratio follows a change in the actual intake air amount while compensating for an artificial operation, thereby making it possible to prevent an occurrence of a deceleration feeling. The transitional target air-fuel ratio AFT is set according to the engine rotation speed Ne, and linearly increases in the latter stage of the switching control, thereby making it possible to properly effect the switching control and complete the same at a proper timing. Since the air-fuel ratio is changed towards the lean side with an increase in the actual intake air amount, an occurrence of a shock caused by the switching of the driving modes can be prevented. Further, it is not necessary to provide a special sensor and the control algorithm is simple.

This invention is not limited to the foregoing first to sixth embodiments, and may be variously modified.

For example, in the first to third embodiments, the target intake pressure P0 and the basic amounts D0, D10 and D20 of the opening degree (duty ratio, lift amount) of the ISC valve during the switching to the lean driving are set based on the throttle sensor output indicative of the throttle opening degree TPS. In setting the basic amounts and the target intake pressure, however, the volumetric efficiency $\eta v$ may be used instead of the throttle opening degree TPS. In this case, for example, the intake amount A/N for one intake stroke is derived based on outputs of an air-flow sensor and engine rotation speed sensor, and a value equivalent to volumetric efficiency is derived by dividing the thus derived A/N by the full opening A/N in the same engine rotation speed state.

In the first to third embodiments, the opening degrees of the air bypass valve are set to the basic amounts D0, D10 and D20, and the valve opening degree is feedback-controlled such that a deviation between the target intake pressure P0 and the actual intake pressure PB on the downstream side of the throttle valve or a deviation between the target valve opening degree L0 and the actual valve opening degree LA will be set to "0". Instead of the intake pressure, the intake amount for one intake stroke may be used as the control parameter in the feedback control in the first and second embodiments. The feedback control in the first to third embodiments may be omitted. That is, the valve opening degree or the like may be open-loop controlled to values D0, D10 and D20.

In the first and second embodiments, the air bypass valve opening degree or the like is increasingly or decreasingly corrected by a correction amount D1, D1, D21 corresponding to the pressure deviation P0–PB or opening deviation L0–LA. In this correction, however, a process for increasing or reducing the valve opening degree or the like by a correction amount which is predeterminedly set to a value smaller than the correction amount D1, D11, D21 may be repeatedly effected until the pressure deviation or opening deviation becomes "0". Further, the correction control process can be variously modified. For example, the air bypass valve opening degree or the like can be controlled by the PI control (proportional-integral control).

Figure 17:
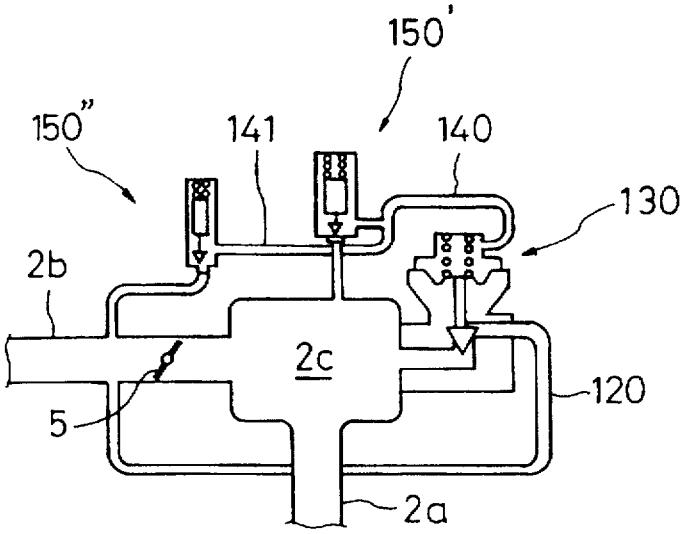
FIG. 17 is a fragmentary schematic view showing a modification of the air bypass valve shown in FIGS. 11 and 14.

In the second and third embodiments, as shown in FIGS. 11 and 14, the air bypass valve is constructed by the vacuum-sensitive valve 130 and the solenoid valve 150, but the air bypass valve is not limited to this. FIG. 17 shows a modification of the air bypass valve. This air bypass valve is constructed by a vacuum-sensitive pressure 130, and first and second solenoid valves 150' and 150". The first solenoid valve 150' is different from the solenoid valve 150 in that it does not have an air introduction passage. The second solenoid valve 150" is disposed in the middle of an air passage 141 which has one end thereof communicated with a vacuum passage 140 and the other end thereof communicated with the intake pipe **2*b* on the upstream side of the throttle valve 5. That is, the air bypass valve shown in FIG. 17 is arranged to permit negative pressure to be introduced into the vacuum chamber of the vacuum-sensitive valve 130 via the vacuum passage 140, and permit air to be introduced into the vacuum chamber via the air passage 141, and is arranged to control the pressure in the vacuum chamber by ON/OFF-duty-controlling the solenoid valves 150' and 150"**.

Further, the devices of the fourth and fifth embodiments can be applied to a drive-by-wire type throttle control system, i.e., throttle-valve-direct-drive type system.

In the fourth and fifth embodiments, the air amount supply control in the lean-driving control and the control of switching from the stoichiometric driving to the lean driving is effected by use of the bypass passage 20 and ISC valve 30 also used for idling speed control. Alternatively, the control may be effected by use of an exclusive-use bypass passage and valve. Further, an air bypass valve of small flow rate may be additionally used.

We claim:

1. A control device for a lean-burn engine, comprising:

load state detecting means for detecting a load state of the engine;

fuel supply means for supplying fuel to the engine;

intake air amount adjusting means for adjusting an amount of intake air supplied to the engine; and control means for controlling said intake air amount adjusting means according to the engine load state detected by said load state detecting means, so as to cause that change in the load state which permits a difference between output torques of the engine before and after switching to be reduced or canceled, when the switching is made from driving with a first air-fuel ratio which is set equal to a theoretical air-fuel ratio or on a fuel-rich side with respect thereto to driving with a second air-fuel ratio which is set on a fuel-lean side with respect to the theoretical air-fuel ratio, wherein said intake air amount adjusting means includes an intake flow rate control valve provided in an intake passage for introducing the intake air into a combustion chamber of the engine, said control means includes target air-fuel ratio setting means for setting a target air-fuel ratio according to a driving state of the engine, and fuel amount setting means for setting a fuel amount to realize the target air-fuel ratio thus set;

said fuel supply means supplies the fuel to the engine in accordance with the fuel amount set by said fuel amount setting means; and said target air-fuel ratio setting means includes follow-up changing means for successive iterative changing the air-fuel ratio to follow a change in an actual intake air amount at a time of switching from the driving with the first air-fuel ratio to the driving with the second air-fuel ratio.

2. A control device for a lean-burn engine according to claim 1, wherein the first air-fuel ratio is set to a first value which is substantially constant, and the second air-fuel ratio is set according to the engine load state detected by said load state detecting means.

3. A control device for a lean-burn engine according to claim 2, wherein the first air-fuel ratio is set to the theoretical air-fuel ratio.

4. A control device for a lean-burn engine according to claim 1, further including:

rotation speed detecting means for detecting a rotation speed of the engine;

wherein the first air-fuel ratio is set to a substantially constant value, the second air-fuel ratio is set according to at least the engine rotation speed detected by said rotation speed detecting means, and said control means controls said intake air amount adjusting means according to the engine rotation speed detected by said rotation speed detecting means and the engine load state detected by said load state detecting means.

5. A control device for a lean-burn engine according to claim 1, wherein the first air-fuel ratio is set to the theoretical air-fuel ratio.

6. The control device for a lean-burn engine according to claim 1, wherein said intake air flow rate control valve includes a bypass valve provided in a throttle bypass passage.

7. A control device for a lean-burn engine according to claim 6, further including:

rotation speed detecting means for detecting a rotation speed of the engine;

wherein said control means controls drive of said bypass valve according to that controlled amount of an opening degree which is set based on the engine rotation speed detected by said rotation speed detecting means and the engine load state detected by said load state detecting means, so as to increase the air amount by a quantity which is set based on the load state detected by said load state detecting means.

8. A control device for a lean-burn engine according to claim 7, wherein said load detecting means includes a throttle opening degree sensor.

9. A control device for a lean-burn engine according to claim 7, wherein said load detecting means includes a pressure sensor for detecting a negative pressure on a downstream side of a throttle valve.

10. A control device for a lean-burn engine according to claim 7, wherein said load detecting means includes an air flow sensor, and is operable to detect intake air amount information for one intake stroke in the engine based on an output of said air flow sensor.

11. A control device for a lean-burn engine according to claim 1, wherein said follow-up changing means includes transitional target air-fuel ratio setting means for setting a transitional target air-fuel ratio which gradually changes from the air-fuel ratio just prior to start of switching of driving states to reach a final target air-fuel ratio after the switching, and the transitional target air-fuel ratio is set such that a changing rate of the transitional target air-fuel ratio will become higher as a rotation speed of the engine becomes higher.

12. The control device for a lean-burn engine according to claim 1, wherein said follow-up changing means includes transitional target air-fuel ratio setting means for setting a transitional target air-fuel ratio which gradually changes from the air-fuel ratio Just prior to start of switching of driving states to a final target air-fuel ratio after the switching; and said transitional target air-fuel ratio setting means sets the transitional target air-fuel ratio such that a changing rate of the transitional target air-fuel ratio will be changed from a rate corresponding to a high rotation speed driving state of the engine to a rate corresponding to a low rotation speed driving state.

13. The control device for a lean-burn engine according to claim 1, wherein said follow-up changing means includes transitional target air-fuel ratio setting means for setting a transitional target air-fuel ratio which gradually changes from a air-fuel ratio Just prior to start of switching of driving states to a final target air-fuel ratio after the switching, and change inhibiting/suppressing means for inhibiting or suppressing a change in the transitional target air-fuel ratio in a time period immediately after the switching of the driving states.

14. A control device for a lean-burn engine according to claim 13, wherein said correction means includes memory means for storing intake air amounts which have no relation to the switching to the driving with the second air-fuel ratio in correspondence to throttle opening degrees and engine rotation speeds.

15. A control method for a lean-burn engine, comprising the steps of:

(a) detecting a load state of the engine; and (b) controlling an amount of intake air supplied to the engine according to the detected engine load state, so as to cause that change in the load state which permits a difference between output torques of the engine before and after switching to be reduced or canceled, when the switching is made from driving with a first air-fuel ratio which is set equal to a theoretical air-fuel ratio or on a fuel-rich side with respect thereto to driving with a second air-fuel ratio which is set on a fuel-lean side with respect to the theoretical air-fuel ratio, wherein said step (b) includes the sub-steps of:

(b1) setting a target air-fuel ratio according to a driving state of the engine;

(b2) setting a fuel amount to realize the target air-fuel ratio set in said sub-step (b1); and (b3) supplying fuel to the engine according to the fuel amount set in said sub-step (b2), and wherein said sub-step (b1) includes a sub-step (b11) of successive iterative changing air-fuel ratio to follow a change in actual intake air amount when the switching is made from the driving with the first air fuel ratio to the driving with the second air-fuel ratio.

16. A control method for a lean-burn engine according to claim 15, wherein said step (b) includes the sub-steps of:

detecting a rotation speed of the engine;

setting a quantity by which an air amount is to be increased based on the load state detected in said step (a);

setting a controlled amount of an opening degree based on the detected engine load state and the detected engine rotation speed; and controlling drive of a bypass valve, disposed in a bypass passage provided to bypass a throttle valve in an intake passage of the engine, according to the set controlled amount of the opening degree so as to permit the air amount to increase by the set quantity.

17. A control method for a lean-burn engine according to claim 15, wherein said step (b) includes the sub-steps of:

delaying ignition timing of the engine according to a change in an actual intake air amount towards an increasing side;

controlling the ignition timing towards an advance side and setting air-fuel ratio to increase of the ignition timing and controlling the air-fuel ratio towards a lean side, after execution of said sub-step of delaying the ignition timing.

18. A control method for a lean-burn engine according to claim 15, wherein said sub-step (b11) includes a sub-step of setting a transitional target air-fuel ratio which gradually changes from the air-fuel ratio just prior to start of the switching of driving states to reach a final target air-fuel ratio after the switching, and the transitional target air-fuel ratio is set such that a changing rate of the transitional target air-fuel ratio will become higher as a rotation speed of the engine becomes higher.

* * * * *